US011497272B2

(12) United States Patent
Bidal et al.

(10) Patent No.: US 11,497,272 B2
(45) **Date of Patent: *Nov. 15, 2022**

(54) GOLF SHOE OUTSOLE

(71) Applicant: Acushnet Company, Fairhaven, MA (US)

(72) Inventors: Jean-Marie Bidal, Bridgewater, MA (US); John F. Swigart, Portland, OR (US); Robert S. Bento, Raynham, MA (US)

(73) Assignee: Acushnet Company, Fairhaven, MA (US)

( * ) Notice: Subject to any disclaimer, the term of this patent is extended or adjusted under 35 U.S.C. 154(b) by 50 days.

This patent is subject to a terminal disclaimer.

(21) Appl. No.: 16/814,685

(22) Filed: Mar. 10, 2020

(65) Prior Publication Data

US 2020/0245716 A1 Aug. 6, 2020

Related U.S. Application Data

(63) Continuation-in-part of application No. 16/745,525, filed on Jan. 17, 2020, which is a continuation-in-part (Continued)

(51) Int. Cl.
*A43B 5/00* (2022.01)
*A43B 13/22* (2006.01)

(Continued)

(52) U.S. Cl.
CPC ..... *A43B 13/14* (2013.01); *A43B 5/001* (2013.01); *A43B 13/223* (2013.01); *A43C 15/162* (2013.01)

(58) Field of Classification Search
CPC ..... A43B 3/0036; A43B 5/001; A43B 5/02; A43B 13/22; A43B 13/223; A43C 15/16; A43C 15/162; A43C 15/165; A43C 15/18
See application file for complete search history.

(56) References Cited

U.S. PATENT DOCUMENTS

D259,595 S * 6/1981 Famolare, Jr. ..... D2/955
4,571,852 A * 2/1986 Lamarche ..... A43B 13/223 D2/951

(Continued)

FOREIGN PATENT DOCUMENTS

| | | |
|---|---|---|
| WO | WO 9922516 | 5/1999 |
| WO | WO 04802 | 2/2000 |
| WO | WO 177411 | 12/2012 |

*Primary Examiner* — Sharon M Prange
(74) *Attorney, Agent, or Firm* — Kristin D. Wheeler

(57) ABSTRACT

Golf shoes having improved outsole constructions are provided. The golf shoes include upper, midsole, and outsole sections. The outsole includes a first set of arc pathways extending along the outsole in one direction. A second set of arc pathways extend along the outsole in a second direction. When the first and second arc pathways are superposed over each other, four-sided tile pieces are formed, and these tiles contain protruding traction members. In one embodiment, the tiles comprise a first protruding traction member, an opposing second protruding traction member, and a non-protruding segment disposed between the first and second traction members. Different traction zones containing different traction members are provided on the outsole. These zones provide improved multi-surface traction. In one embodiment of the outsole, there is no channeling and no trenching of the golf course turf. There is less damage to the golf course for a given amount of traction. In another embodiment, a heel step region without traction members may be provided on the outsole. Additionally, spike receptacles may be provided on the outsole in addition to the traction members.

6 Claims, 38 Drawing Sheets

Related U.S. Application Data of application No. 16/226,861, filed on Dec. 20, 2018, now Pat. No. 11,019,874, which is a continuation-in-part of application No. 29/662,673, filed on Sep. 7, 2018, now Pat. No. Des. 894,563.

(51) Int. Cl.
*A43C 15/16* (2006.01)
*A43B 13/14* (2006.01)

(56) References Cited

U.S. PATENT DOCUMENTS 4,782,604 A 11/1988 Wen-Shown
6,082,023 A 7/2000 Dalton
6,665,961 B2 * 12/2003 Kobayashi ..... A43B 5/001 D2/954
6,705,027 B1 * 3/2004 Campbell ..... A43C 15/162 36/59 C
6,792,698 B2 * 9/2004 Kobayashi ..... A43B 13/223 D2/951
6,948,264 B1 9/2005 Lyden
D605,838 S * 12/2009 Foust ..... D2/951
7,762,009 B2 * 7/2010 Gerber ..... A43B 13/26 36/59 C
7,895,773 B2 3/2011 Robinson, Jr. et al.
8,011,118 B2 9/2011 Gerber
8,197,736 B2 6/2012 Frasson et al.
8,256,146 B2 * 9/2012 Loverin ..... A43B 3/30 D2/954
8,375,604 B2 2/2013 Eder et al.
8,677,657 B2 3/2014 Bacon et al.
8,776,403 B2 7/2014 Eder et al.
9,332,803 B2 5/2016 Kasprzak
10,004,294 B2 * 6/2018 Swegle ..... A43B 3/0078
11,206,893 B2 * 12/2021 Winskowicz ..... A43B 7/1425
2009/0188132 A1 7/2009 Fujikawa et al.
2011/0252669 A1 10/2011 Kasprzak
2012/0324762 A1 12/2012 Soumokil et al.

* cited by examiner

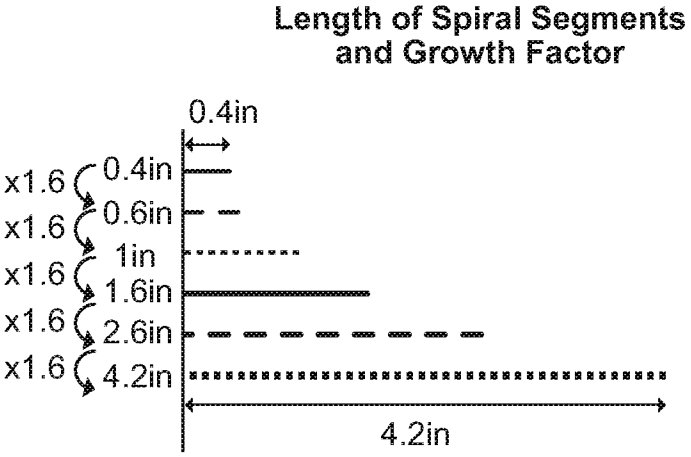
FIG. 4B (TABLE 1)
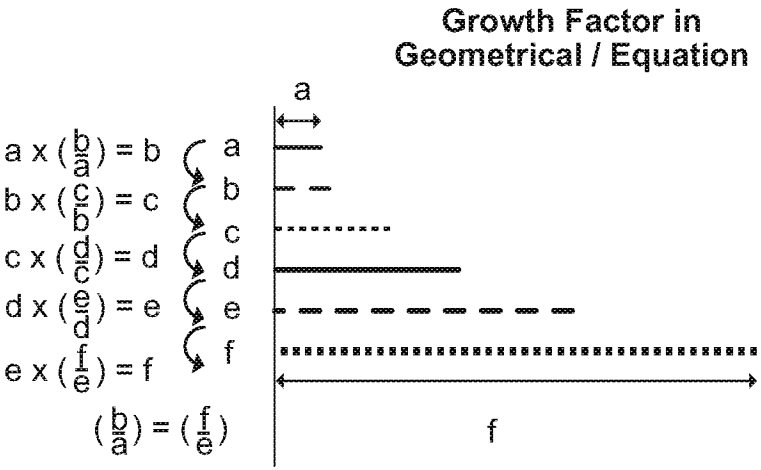
FIG. 4C (TABLE 2)
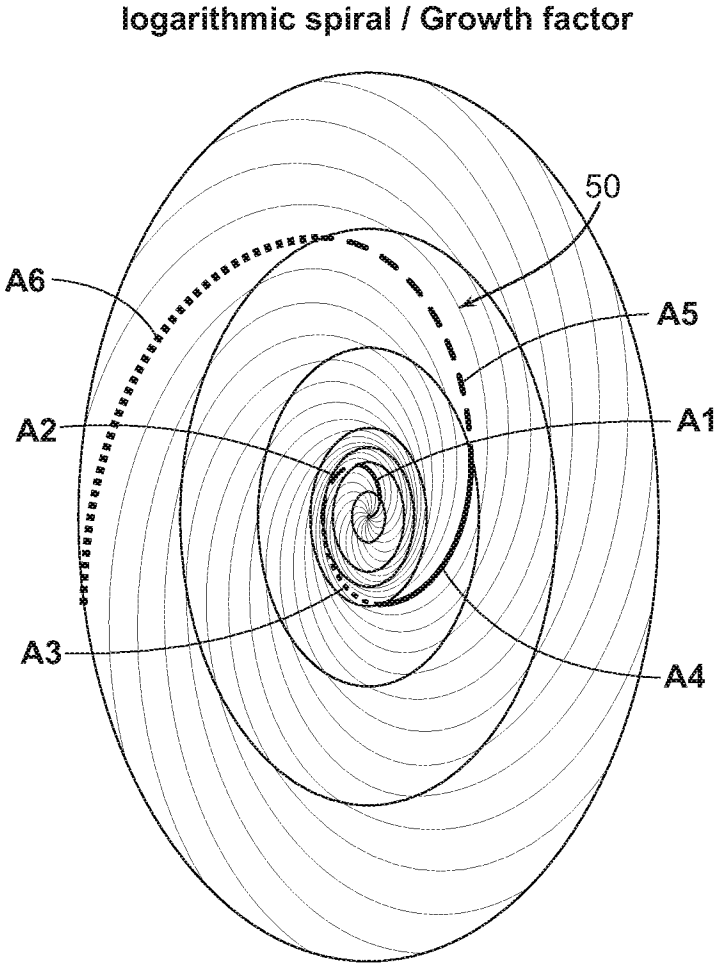
FIG. 4A

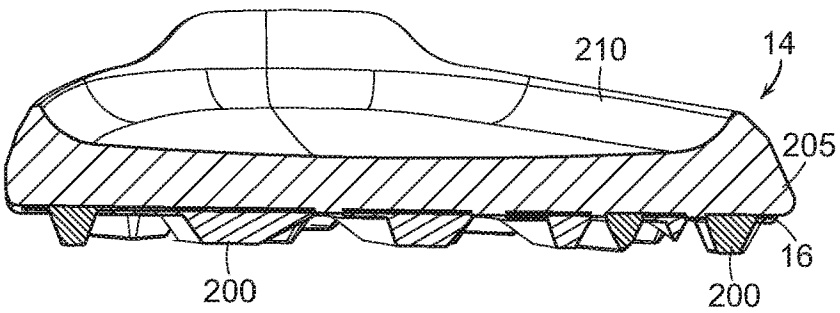
FIG. 26 B-B'
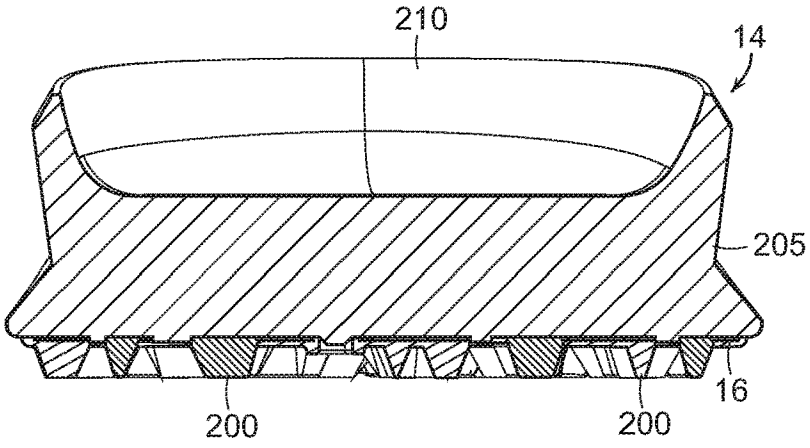
FIG. 25 A-A'

C-C'

Horizontal sidewalls configuration on Heel area provide resistance/traction while walking Down the Golf slopes or simply walking.

Vertical sidewalls disposition 1 provides Horizontal forces management resulting on more ground resistance/traction during a golf UP swing. (Right foot for right golfer)

Horizontal sidewalls configuration on Toe area provide resistance/traction while walking Up the Golf slopes or simply walking.

Vertical sidewalls disposition 2 provides Horizontal forces management resulting on more ground resistance/traction during a golf Down swing. (Right foot for right golfer)

GOLF SHOE OUTSOLE

CROSS-REFERENCE TO RELATED APPLICATIONS

This application is a continuation-in-part of U.S. patent application Ser. No. 16/745,525, filed on Jan. 17, 2020, which is a continuation-in-part of U.S. patent application Ser. No. 16/226,861, filed on Dec. 20, 2018, which is a continuation-in-part of U.S. patent application Ser. No. 29/662,673, filed on Sep. 7, 2018, the entire disclosures of which are hereby incorporated by reference.

BACKGROUND OF THE INVENTION

Field of the Invention

The present invention relates generally to shoes and more particularly to golf shoes having improved outsoles. The outsole has different regions or zones of traction members that provide traction for on-course and off-course activities. The traction members are arranged on the outsole in a non-channeled pattern. The traction members and their distinct pattern on the outsole help provide a shoe with high traction and low turf-trenching properties. The outsole further minimizes damage to putting greens for the given amount of traction.

Brief Review of the Related Art

Both professional and amateur golfers use specially designed golf shoes today. Typically, the golf shoe includes an upper portion and outsole portion along with a mid-sole connecting the upper to the outsole. The upper has a traditional shape for inserting a user's foot and thus covers and protects the foot in the shoe. The upper is designed to provide a comfortable fit around the contour of the foot. The mid-sole is relatively lightweight and provides cushioning to the shoe. The outsole is designed to provide stability and traction for the golfer. The bottom surface of the outsole may include spikes or cleats designed to engage the ground surface through contact with and penetration of the ground. These elements help provide the golfer with better foot traction as he/she walks and plays the course.

Often, the terms, "spikes" and "cleats" are used interchangeably in the golf industry. Some golfers prefer the term, "spikes," since cleats are more commonly associated with other sports such as baseball, football, and soccer. Other golfers like to use the term, "cleats" since spikes are more commonly associated with non-turf sports such as track or bicycling. In the following description, the term, "spikes" will be used for convenience purposes. Golf shoe spikes can be made of a metal or plastic material. However, one problem with metal spikes is they are normally elongated pieces with a sharp point extending downwardly that can break through the surface of the putting green thereby leaving holes and causing other damage. These metal spikes also can cause damage to other ground surfaces at a golf course, for example, the carpeting and flooring in a clubhouse. Today, most golf courses require that golfers use non-metal spikes. Plastic spikes normally have a rounded base having a central stud on one face. On the other face of the rounded base, there are radial arms with traction projections for contacting the ground surface. Screw threads are spaced about the stud on the spike for inserting into a threaded receptacle on the outsole of the shoe as discussed further below. These plastic spikes, which can be easily fastened and later removed from the locking receptacle on the outsole, tend to cause less damage to the greens and clubhouse flooring surfaces.

If spikes are present on the golf shoe, they are preferably detachably fastened to receptacles (sockets) in the outsole. The receptacles may be located in a molded pod attached to the outsole. The molded pods help provide further stability and balance to the shoe. The spike may be inserted and removed easily from the receptacle. Normally, the spike may be secured in the receptacle by inserting it and then slightly twisting it in a clockwise direction. The spike may be removed from the receptacle by slightly twisting it in a counter-clockwise direction.

In recent years, "spikeless" or "cleatless" shoes have become more popular. These shoe outsoles contain rubber or plastic traction members but no spikes or cleats. These traction members protrude from the bottom surface of the outsole to contact the ground. The shoes are designed for on the golf course and off the course. That is, the shoes provide good stability and traction for the golfer playing the course including on the tees, fairways, and greens. Furthermore, the shoes are lightweight, and comfortable and can be used off the golf course. The shoes can be worn comfortably in the clubhouse, office, or other off-course places.

When a golfer swings a club and transfers his/her weight, their foot absorbs tremendous forces. For example, when a right-handed golfer is first planting his/her feet before beginning any club swinging motion (that is, when addressing the ball), their weight is evenly distributed between their front and back feet. As the golfer begins their backswing, their weight shifts primarily to their back foot. Significant pressure is applied to the back foot at the beginning of the downswing. Thus, the back foot can be referred to as the driving foot and the front foot can be referred to as the stabilizing foot. As the golfer follows through with their swing and drives the ball, their weight is transferred from the driving foot to the front (stabilizing) foot. During the swinging motion, there is some pivoting at the back and front feet, but this pivoting motion must be controlled. It is important the feet do not substantially move or slip when making the shot. Good foot traction is important during the golf shot cycle. Thus, traditional golf shoes have traction members and spikes positioned at different locations across the outsole.

For example, Bacon et al., U.S. Pat. No. 8,677,657 discloses a golf shoe outsole having hard thermoplastic polyurethane pods molded to a relatively soft and flexible thermoplastic polyurethane in the forward section and molded to a relatively hard TPU in the heel section. Each pod contains a cleat receptacle for inserting and removing cleats. Robinson, Jr. et al., U.S. Pat. No. 7,895,773 discloses a golf shoe having a collapsible and supportable gel pad contained in a recess of the outsole proximate to the metatarsal bone. The shoe includes relatively soft plastic spikes that can be replaced and relatively hard rubber cleats that cannot be replaced. After a given time period (for example, 3 months), and the replacement spikes have worn down, the golfer can replace them to restore traction. If the golfer wishes, he/she can choose the height of the replacement spike to match the height of the non-replaceable cleats which also may have worn down.

In other examples, the outsole may contain traction members, spikes, and/or cleats that are arranged in linear patterns with transverse and longitudinal rows extending across the outsole. For instance, Wen-Shown, U.S. Pat. No. 4,782,604 discloses a golf shoe outsole having multiple removable metal spikes (nails) and multiple soft cleats arranged in a linear pattern. The metal cleats are positioned in the ball portion and heel portion of the outsole. The soft cleats are positioned around the sole for the purpose of positioning, bearing load, and providing elasticity.

Kasprzak, U.S. Pat. No. 9,332,803 discloses a golf shoe outsole having cleats distributed along the forefoot and heel areas. The cleats are arranged in transverse rows along a longitudinal length of the outsole. The cleats are essentially cross-shaped. The forefoot includes a ball area and toe area. The ball area and the heel area have cleats with greater heights and widths than other areas of the sole. The cleats along the ball area and the heel area are substantially equal in height.

In another version, the traction members are arranged in circular patterns, where each traction element that is positioned in a ring has substantially the same radius and center as the other traction element in the ring. For example, Gerber, U.S. Pat. No. 8,011,118 discloses a shoe having an outsole with a circular tread pattern. The circular tread pattern includes a first circular tread having a first radius, wherein the first circular tread extends less than 360 degrees in a circumferential direction around a center of the circular tread pattern. The circular tread pattern also includes a second circular tread having a second radius greater than the first; and where the second circular tread also extends less than 360 degrees in a circumferential direction around a center of the circular tread. According to the '118 Patent, the circular tread pattern provides sufficient traction in all directions but also allows the wearer to pivot about a pivot portion.

However, one drawback with some conventional golf shoes is these shoes can damage the golf course turf. For example, the traction members, spikes, and cleats can drag along the surface damaging grass blades and roots. This damage can be referred to as a trenching effect. This tearing-up of the grass and roots makes the putting green and other course surfaces uneven. There are relatively raised and lowered surfaces and this leads to discoloration and browning of the turf. The penetration of the ground surface and trenching of the turf by the shoe outsole causes problems for the golfer in all phases of the game. For example, turf-trenching can affect the golfer when he/she is driving the ball from the tee, making shots on the fairway, and putting on the greens, and even when walking the course. Even if golfers are careful, they can cause damage to the greens when walking and putting. Particularly, this is a problem when the putting greens are wet. The trenching of grass and soil can slow the overall flexibility and pivoting action of the shoe. Also, the digging-up and clogging of turf in the outsole can make the golfer feel awkward and uncomfortable when walking the course or swinging the club to make a shot. When traction members and cleats are arranged in a linear configuration across the outsole, this turf-trenching effect occurs in both the 90 degree and 0 degree directions as discussed in further detail below. On the other hand, when cleats are arranged in overlapping circular patterns (double-radial configuration), there tends to be little turf-trenching in the 90 degree directions, but there is more turf-trenching in the 0 degree directions. In yet another embodiment, when the cleats are arranged in a concentric circular pattern, there can be trenching in various directions including the rotational direction as also discussed in further detail below.

Thus, there is a need for a golf shoe having an improved outsole that can provide a high level of stability and traction. The shoe should hold and support the medial and lateral sides of the golfer's foot as they shift their weight when making a golf shot. The shoe should provide good traction so there is no slipping and the golfer can stay balanced. At the same time, the outsole of the shoe should have minimal turf-trenching properties. A golfer wearing the shoe should be able to comfortably walk and play the course with minimal damage to the course turf. The present invention provides new golf shoe constructions that provide improved traction to the golfer as well as other advantageous properties, features, and benefits including minimal turf trenching properties.

SUMMARY OF THE INVENTION

The present invention provides a golf shoe having an outsole comprising different zones of tiles. Each zone contains different traction members for gripping both golf course and off-golf course surfaces. The traction members are arranged on the outsole in a non-channeled pattern. The traction members and their distinct pattern on the outsole help provide a shoe with high traction and minimal turf-trenching properties. The outsole further minimizes damage to putting greens and other surfaces such as clubhouse flooring. The shoes provide less damage to the golf course for a given amount of traction.

The shoe includes an upper portion and outsole portion along with a midsole connecting the upper to the outsole. Looking at the bottom surface of the outsole, it contains sets of spiral pathways that intersect each other. For example, one set of spiral pathways can be referred to as Set A; and the other set can be referred to as Set B. Each spiral pathway in Set A has a common point of origin and contains a plurality of spiral segments radiating from that point. Each spiral segment in Set A has a different degree of curvature. Similar to the A set of spiral pathways, each spiral pathway in set B has a common point of origin and contains a plurality of spiral segments radiating from that point. Each spiral segment in Set B also has a different degree of curvature. The first set of spiral pathways (A) is logarithmic or normal, and the second set of spiral pathways (B) is an inverse of the first set (A). Thus, the sets of spiral pathways (A) and (B) can be superposed over each other. When the spiral pathways in sets (A) and (B) are superposed over each other, the curved sub-segments of spiral segments from set A and the curved sub-segments of spiral segments from set B are pieced together to create four-sided tile pieces. The intersecting points between the superposed sets of spiral pathways (A) and (B) form the corners of these tile pieces. In the outsole of this invention, these tile pieces contain projecting traction members.

For example, looking at the outsole of a right shoe, the forefoot region of the outsole includes a first (lateral) zone of tiles containing protruding traction members extending along the periphery of the forefoot region. These traction members in the lateral zone are primarily used for golf-specific traction, that is, these traction members help control forefoot lateral traction, and prevent the foot from slipping during a golf shot. A third (medial) zone of tiles contains protruding traction members extending along the opposing periphery of the forefoot region. These traction members in the medial zone provide a high contact surface area to prevent slipping on hard, wet, and smooth surfaces. All of the traction members provide maximum contact with the ground surface for the given amount of traction member material (for example, rubber) in that specific zone. A second (middle) zone of tiles containing protruding traction members is disposed between the first and third zones. These traction members in the middle zone are relatively softer and more compliant than the traction members in the neighboring lateral and medial zones. These traction members provide comfort and tend to distribute pressure from the middle (second) zone out to the periphery of the sole, that is, toward the lateral (first) and medial (third) zones. Thus, the middle zone acts as a comfort zone relieving the pressure placed on the center of the sole and pushing it to the lateral and medial sides of the sole. The pattern of the traction members in the lateral and medial zones provides improved traction on both hard and soft surfaces as discussed further below. In one preferred embodiment, the traction members are made from a rubber material and the traction members in all of the zones provide maximum gripping power per volume of rubber material used. The mid-foot and rear-foot regions of the outsole include similar zones and traction members as discussed further below.

There also can be an oval pattern (OV1) having a center point superposed on the spiral pathways, the center point of the oval pattern (OV1) and the point of origin of the first set of spiral pathways (A) being the same fixed point; wherein the first segment in each spiral pathway has a proximal end and distal end, and the oval pattern intersects the distal ends of the first segments. There also can be an oval pattern (OV2) having a center point superposed on the spiral pathways, the center point of the oval pattern (OV2) and the point of origin of the second set of spiral pathways (B) being the same fixed point; wherein the second segment in each spiral pathway has a proximal end and distal end, and the oval pattern intersects the distal ends of the second segments.

In one embodiment, the tile pieces contain traction members, wherein a plurality of tile pieces comprise a first protruding traction member, an opposing second protruding traction member, and a non-protruding segment disposed between the first and second traction members, first traction member has a hardness greater than the second traction. Preferably, the first and second traction members each comprise a thermoplastic polyurethane composition. In one embodiment, the first and second traction members have different hardness values. In another embodiment, the first and second traction members have substantially the same hardness. Also, the first and second traction members can have different or substantially the same heights. The non-protruding segment (window) disposed between the first and second traction members preferably comprises an ethylene vinyl acetate composition.

In the forefoot region, the outsole may comprise a first zone of tiles containing protruding traction members extending along the anterior portion of the forefoot region; a second zone of tiles containing protruding traction members extending along the periphery of the forefoot region; and a third zone of tiles containing protruding traction members extending along the opposing periphery of the forefoot region, the second and third zones being adjacent to the first zone and the traction members in the first, second, and third zones having different dimensions. The outsole also may comprise a zone of tiles containing protruding traction members extending along the mid-foot region. Further, in the rear-foot region, the outsole may comprise a first zone of tiles containing protruding traction members extending along the posterior portion of the rear-foot region; a second zone of tiles containing protruding traction members extending along the periphery of the rear-foot region; and a third zone of tiles containing protruding traction members extending along the opposing periphery of the rear-foot region, the second and third zones being adjacent to the first zone and the traction members in the first, second, and third zones having different dimensions.

The traction members in the zones may have different structures, geometric shapes and dimensions. In one embodiment, the traction members have a triangular-shaped, non-recessed top surface that forms a ground contacting surface, and wherein the total ground contact surface area is in the range of about 10 to about 70% based on total surface area of the tile.

BRIEF DESCRIPTION OF THE DRAWINGS

The novel features that are characteristic of the present invention are set forth in the appended claims. However, the preferred embodiments of the invention, together with further objects and attendant advantages, are best understood by reference to the following detailed description in connection with the accompanying drawings in which:

FIG. 4A is a top plan view of one example of a first set of logarithmic (normal) spiral pathways (A) showing a spiral pathway containing different spiral pathway segments, wherein the length of the spiral segments increases by a growth factor;

FIG. 4B is Table 1 showing the length of the spiral pathway segments as shown in FIG. 4A, and their respective growth factor;

FIG. 4C is Table 2 showing the length of the spiral pathway segments as shown in FIG. 4A, and their respective growth factor in a geometrical equation;

FIG. 25 is a cross-sectional view of the outsole in FIG. 24 along Line A-A';

FIG. 26 is a cross-sectional view of the outsole in FIG. 24 along Line B-B';

DETAILED DESCRIPTION OF THE INVENTION

Figure 1:
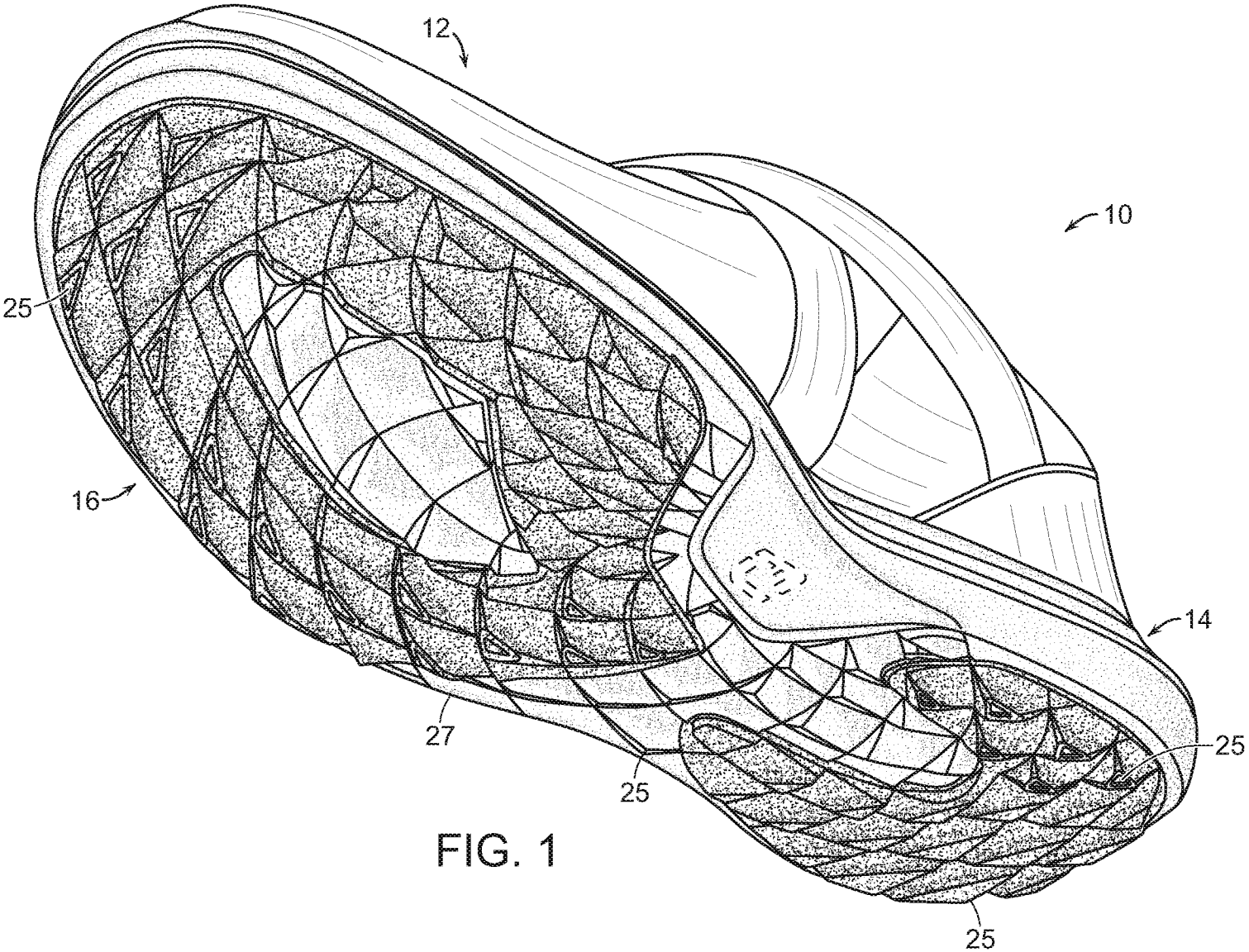
FIG. 1 is a perspective view of one embodiment of a golf shoe of the present invention showing the outsole in detail.

Referring to the Figures, where like reference numerals are used to designate like elements, and particularly FIG. 1, one embodiment of the golf shoe (10) of this invention is shown. The shoe (10) includes an upper portion (12) and outsole portion (16) along with a midsole (14) connecting the upper (12) to the outsole (16). The views shown in the Figures are of a right shoe and it is understood the components for a left shoe will be mirror images of the right shoe. It also should be understood that the shoe may be made in various sizes and thus the size of the components of the shoe may be adjusted depending upon the shoe size.

Figure 1A:
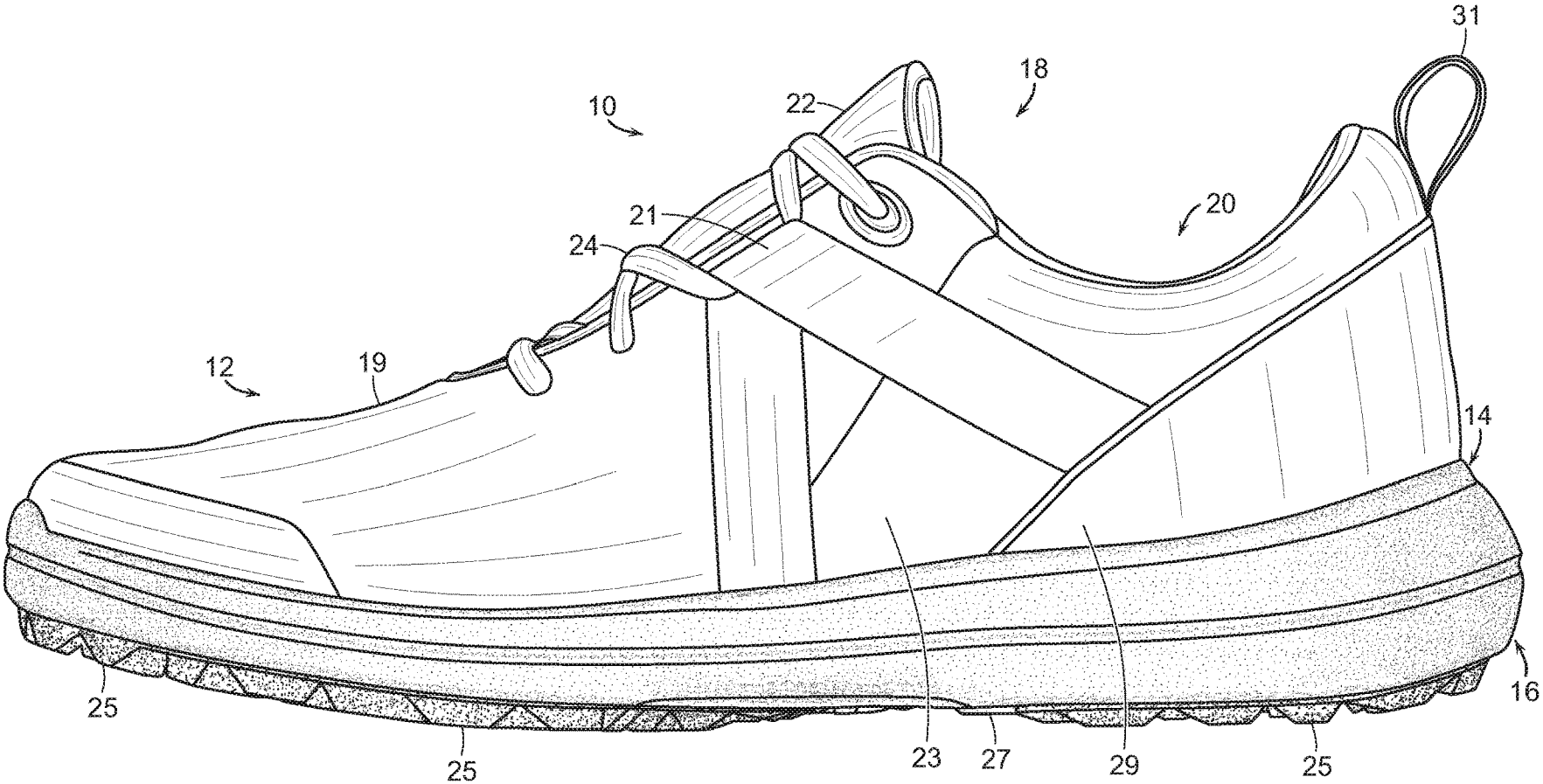
FIG. 1A is a medial side view of one embodiment of a golf shoe of the present invention showing the upper in detail.

The upper (12) has a traditional shape and is made from a standard upper material such as, for example, natural leather, synthetic leather, non-woven materials, natural fabrics, and synthetic fabrics. For example, breathable, mesh, and synthetic textile fabrics made from nylons, polyesters, polyolefins, polyurethanes, rubbers, and combinations thereof can be used. The material used to construct the upper is selected based on desired properties such as breathability, durability, flexibility, and comfort. In one preferred example, the upper (12) is made of a mesh material. The upper material is stitched or bonded together to form an upper structure. Referring to FIG. 1A, the upper (12) generally includes an instep region (18) with an opening (20) for inserting a foot. The upper includes a vamp (19) for covering the forepart of the foot. The instep region includes a tongue member (22) and a saddle strip (21) overlying the quarter section (23) of the upper and attached to the foxing (29) in the heel region. The upper (12) may include an optional ghille strip or pull strap (31) extending from the rear area of the instep region (18). Normally, laces (24) are used for tightening the shoe around the contour of the foot. However, other tightening systems can be used including metal cable (lace)-tightening assemblies that include a dial, spool, and housing and locking mechanism for locking the cable in place. Such lace tightening assemblies are available from Boa Technology, Inc., Denver, Colo. 80216. It should be understood that the above-described upper (12) shown in FIGS. 1 and 1A represents only one example of an upper design that can be used in the shoe construction of this invention and other upper designs can be used without departing from the spirit and scope of this invention.

The midsole (14) is relatively lightweight and provides cushioning to the shoe. The midsole (14) can be made from a standard midsole material such as, for example, foamed ethylene vinyl acetate copolymer (EVA) or polyurethane. In one manufacturing process, the midsole (14) is molded on and about the outsole. Alternatively, the midsole (14) can be molded as a separate piece and then joined to the top surface (not shown) of the outsole (16) by stitching, adhesives, or other suitable means using standard techniques known in the art. For example, the midsole (14) can be heat-pressed and bonded to the top surface of the outsole (16).

In general, the outsole (16) is designed to provide stability and traction for the shoe. The bottom surface (27) of the outsole (16) includes multiple traction members (25) to help provide traction between the shoe and grass on the course. The bottom surface of the outsole and traction members can be made of any suitable material such as rubber or plastics and combinations thereof. Thermoplastics such as nylons, polyesters, polyolefins, and polyurethanes can be used. Suitable rubber materials that can be used include, but are not limited to, polybutadiene, polyisoprene, ethylene-propylene rubber ("EPR"), ethylene-propylene-diene ("EPDM") rubber, styrene-butadiene rubber, styrenic block copolymer rubbers (such as "SI", "SIS", "SB", "SBS", "SIBS", "SEBS", "SEPS" and the like, where "S" is styrene, "I" is isobutylene, "E" is ethylene, "P" is propylene, and "B" is butadiene), polyalkenamers, butyl rubber, nitrile rubber, and blends of two or more thereof. The structure and functionality of the outsole (16) of the present invention is described in further detail as follows.

Figures 2A, 2B, 2C:
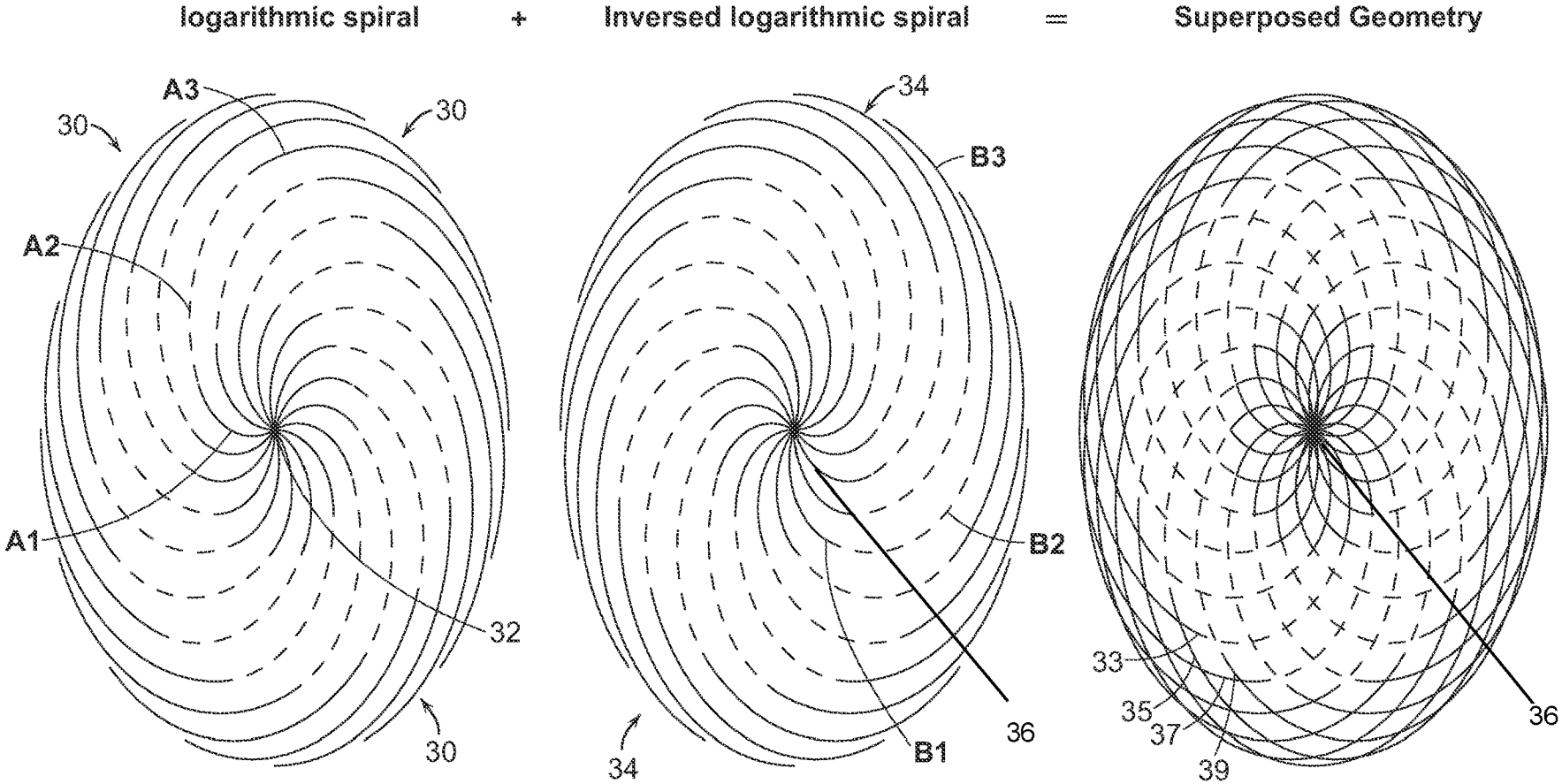
FIG. 2A is a top plan view of a first set of logarithmic (normal) spiral pathways (A) for one embodiment of a golf shoe of the present invention.
FIG. 2B is a top plan view of a second set of logarithmic (inversed) spiral pathways (B) and is an inverse of the first set of logarithmic (normal) spiral pathways (A) shown in FIG. 2A.
FIG. 2C is a top plan view of the second set of logarithmic (inversed) spiral pathways (B) shown in FIG. 2B superposed over the first set of logarithmic (normal) spiral pathways (A) shown in FIG. 2A.

In FIG. 2A, a first set of spiral pathways (A) is shown. Each spiral pathway (30) has a common point of origin (32) and contains a plurality of spiral segments (for example, A1, A2, and A3) radiating from that point (32). Each segment (A1, A2, and A3) has a different degree of curvature. Turning to FIG. 2B, a second set of spiral pathways (B) is shown. Similar to the (A) set of spiral pathways, each spiral pathway (34) in set (B) has a common point of origin (36) and contains a plurality of spiral segments (for example, B1, B2, and B3) radiating from that point (36). Each segment (B1, B2, and B3) has a different degree of curvature. The first set of spiral pathways (A) is logarithmic or normal, and the second set of spiral pathways (B) is an inverse of the first set (A). Thus, the sets of spiral pathways (A) and (B) can be superposed over each other as shown in FIG. 2C.

When the spiral pathways in sets (A) and (B) are superposed over each other, the curved sub-segments of spiral segments from set A and the curved sub-segments of spiral segments from set B are pieced together to create four-sided tile pieces. In FIG. 2C, a four-sided tile having spiral sub-segment sides (33, 35, 37, and 39) is shown. The intersecting points between the superposed sets of spiral pathways (A) and (B) form the corners of these tile pieces. In the shoe of this invention, these tile pieces are positioned on the outsole and contain projecting traction members—they are described in further detail below.

Figure 3B:
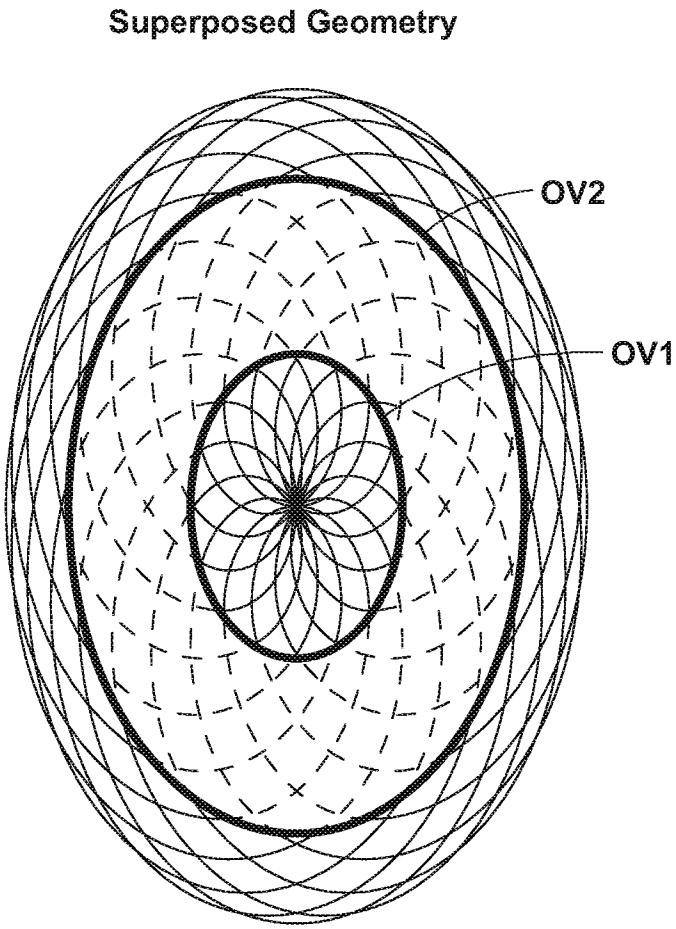
FIG. 3B is a top plan view of the superposed first set of logarithmic (normal) spiral pathways (A) and second set of logarithmic (inversed) spiral pathways (B) as shown in FIG. 2C with oval pattern (OV1) and oval pattern (OV2) overlying the superposed spiral pathways with the understanding that these oval patterns are for illustration purposes only and do not appear as visible marks or indicia on the outsole of the shoe.
Figure 3A:
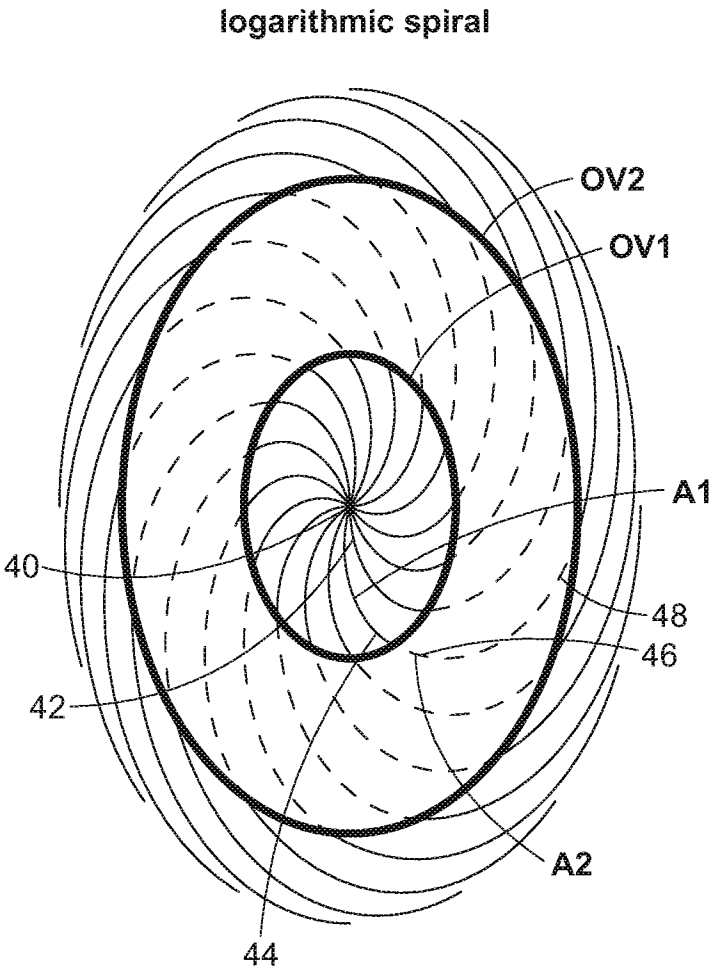
FIG. 3A is a top plan view of a first set of logarithmic (normal) spiral pathways (A) shown in FIG. 2A with oval pattern (OV1) and oval pattern (OV2) overlying the spiral pathways with the understanding that these oval patterns are for illustration purposes only and do not appear as visible marks or indicia on the outsole of the shoe.

The geometry of the spiral pathways is shown in further detail in FIG. 3A. In this view, the first set of logarithmic (normal) spiral pathways (A) (FIG. 2A) includes oval pattern (OV1) and oval pattern (OV2) intersecting the different spiral pathways. It should be understood that the oval patterns (OV1 and OV2) are used herein to further describe the spiral pathways (A and B) and are intended for illustration purposes only. The oval patterns (OV1 and OV2) do not appear as visible marks or indicia on the outsole of the shoe. More particularly, the oval pattern (OV1) has a center point (40), and, as shown in FIG. 3A, the center point (40) of the oval pattern (OV1) and point of origin (32) of the first segment (A1) of spiral pathway (A) are the same fixed point.

The first segment (A1) in each spiral pathway (A) also has a proximal end (42) and distal end (44). The oval pattern (OV1) intersects the distal ends (44) of the first segments (A1) of spiral pathway (A).

As further shown in FIG. 3A, an oval pattern (OV2) having the same center point (40) also overlies the spiral pathways (A). The center point of the oval pattern (OV2) and the point of origin (32) of the second segment (A2) of spiral pathway (A) are the same fixed point. The second segment (A2) in each spiral pathway (A) also has a proximal end (46) and distal end (48). The oval pattern (OV2) intersects the distal ends (48) of the second segments (A2) of the spiral pathways (A).

The first set of logarithmic (normal) spiral pathways (A) and second set of logarithmic (inversed) spiral pathways (B), which are superposed over each other as shown in FIG. 2C, are shown with overlying and intersecting oval patterns (OV1 and OV2) for illustration purposes in FIG. 3B. It should be understood that the number of spiral pathways in the pattern and number of spiral segments in a given spiral pathway is unlimited. In FIGS. 3A and 3B, a spiral pathway containing three spiral segments (A1, A2, and A3) is shown for illustration purposes, but there can be an ad infinitum number of segments and these segments can be scaled to any size as described further below.

Referring to FIGS. 4A-4C, the path lengths of some exemplary spiral segments comprising the spiral pathways are shown in more detail. In FIG. 4A, one example of a first set of logarithmic (normal) spiral pathways (A) with a spiral pathway containing multiple spiral segments is shown. The length of the spiral path segments increases by a constant growth factor. In particular, for this example, the spiral pathway (50) comprises a first spiral segment (A1); a second spiral segment (A2); a third spiral segment (A3); a fourth spiral segment (A4); a fifth spiral segment (A5); and a sixth spiral segment (A6). These spiral segments increase by a constant growth factor along the entire spiral pathway. For example, if the length of the spiral segment A1 is 0.4 inches; and the length of spiral segment A2 is 0.6 inches; and the length of spiral segment A3 is 1 inch, the growth factor is 1.6. This growth factor of the different segments stays the same as the spiral pathway continues to grow as shown in Table 1 of FIG. 4B. That is, the growth factor stays consistent (for example, the growth factor can be 1.6) throughout the full spiral pathway. This example of a growth factor can be expressed in a geometrical equation as shown in Table 2 of FIG. 4C. As shown in FIGS. 4A-4C, there can be multiple spiral segments and there can be multiple oval patterns intersecting the different segments of the spiral pathways.

Figure 5B:
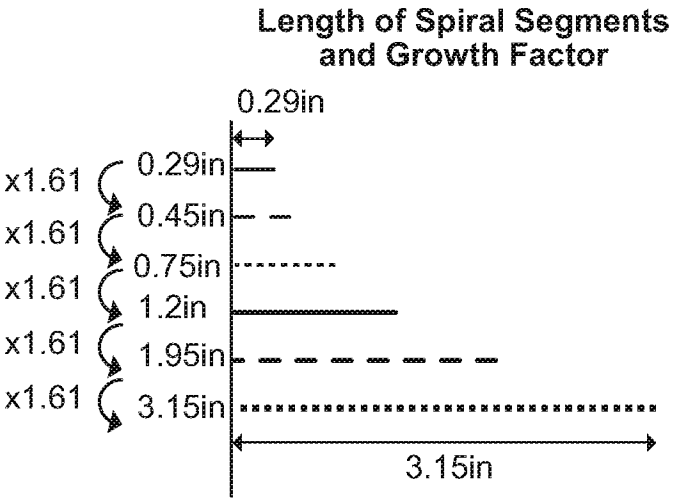
FIG. 5B is Table 3 showing the length of the spiral pathway segments as shown in FIG. 5A, and their respective growth factor.
Figure 5C:
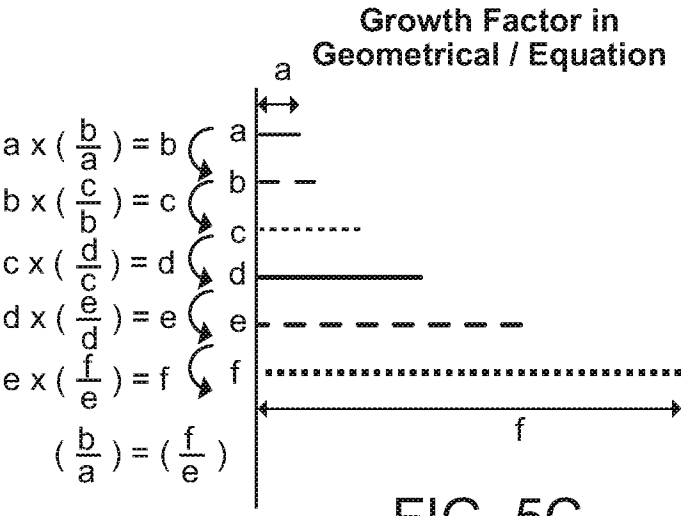
FIG. 5C is Table 4 showing the length of the spiral pathway segments as shown in FIG. 5A, and their respective growth factor in a geometrical equation.
Figure 5A:
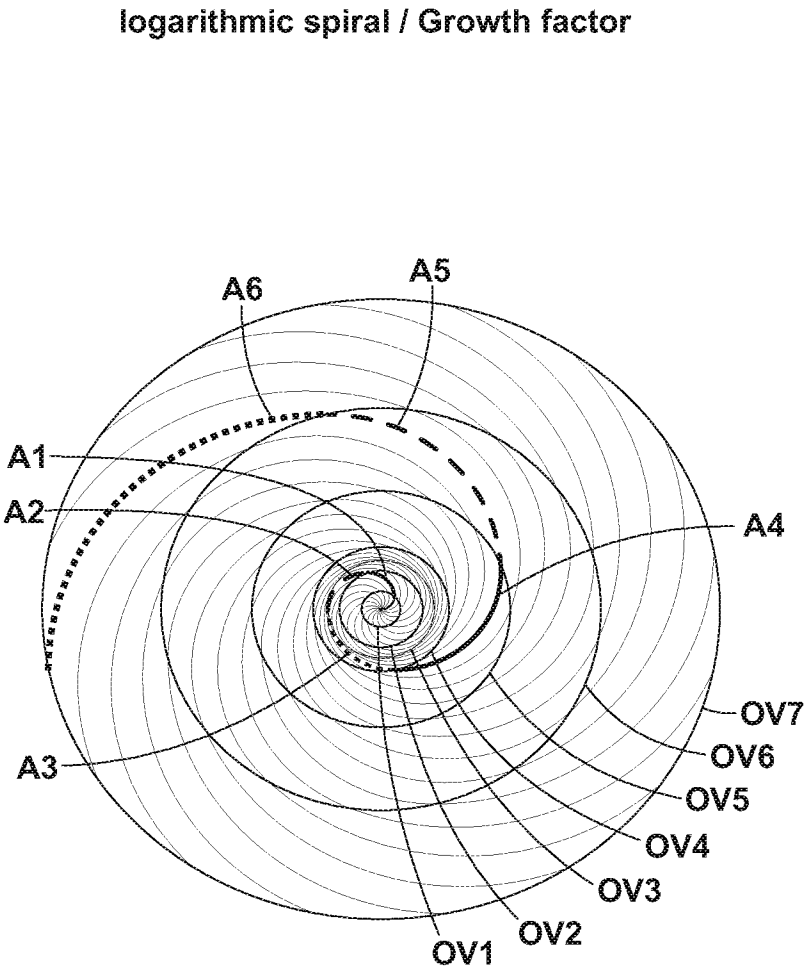
FIG. 5A is a top plan view of a second example of a first set of logarithmic (normal) spiral pathways (A) showing a spiral pathway containing different spiral pathway segments, wherein the length of the spiral segments increases by a growth factor.

In FIGS. 5A-5C, another example of a spiral pathway containing multiple spiral pathway segments (A1, A2, A3, A4, A5, and A6) with a different growth factor is shown. In this example, the length of the spiral segment A1 is 0.29 inches; and the length of spiral segment A2 is 0.45 inches; and the length of spiral segment A3 is 0.75 inches, with a growth factor is 1.61. This growth factor of the different segments stays the same as the spiral pathway grows and extends outwardly as shown in Table 3 of FIG. 5B. That is, the growth factor stays consistent (in this example, the growth factor is 1.61) throughout the spiral pathway. This growth factor can be expressed in a geometrical equation as shown in Table 4 of FIG. 5C. Thus, the growth of the spiral pathways is organic and clean and can be expressed in mathematical equations as shown in the examples of FIGS. 4A-4C and FIGS. 5A-5C. The spiral pathways provide the outsole of the shoe with a natural and organic look.

Figure 6D:
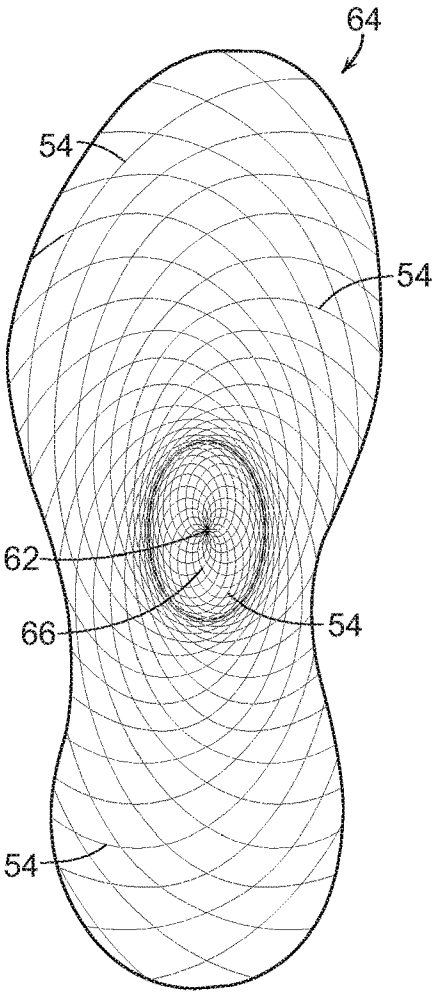
FIG. 6D is a bottom plan view of one example of an outsole of the present invention showing the point of origin of the spiral pathways in the central mid-foot region of the outsole, wherein the spiral pathways are on a smaller scale than the spiral pathways shown in FIGS. 6A-6C.
Figure 6C:
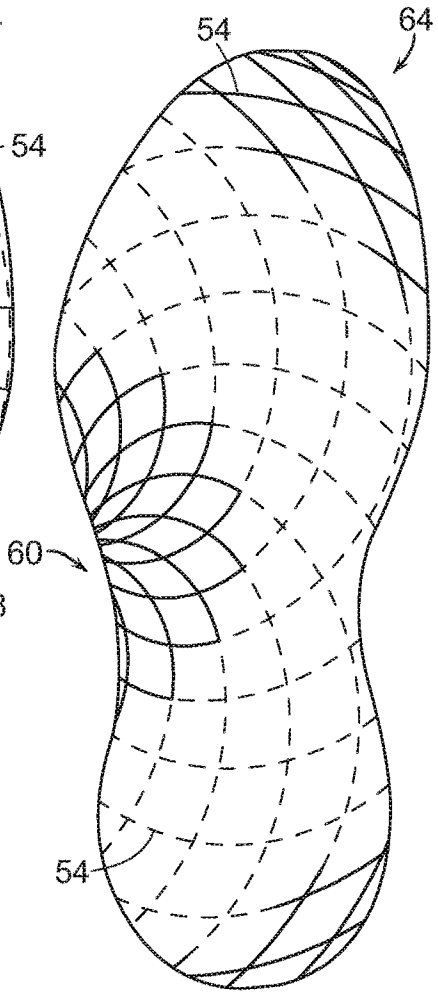
FIG. 6C is a bottom plan view of one example of an outsole of the present invention showing the point of origin of the spiral pathways outside the lateral mid-foot region of the outsole.
Figure 6B:
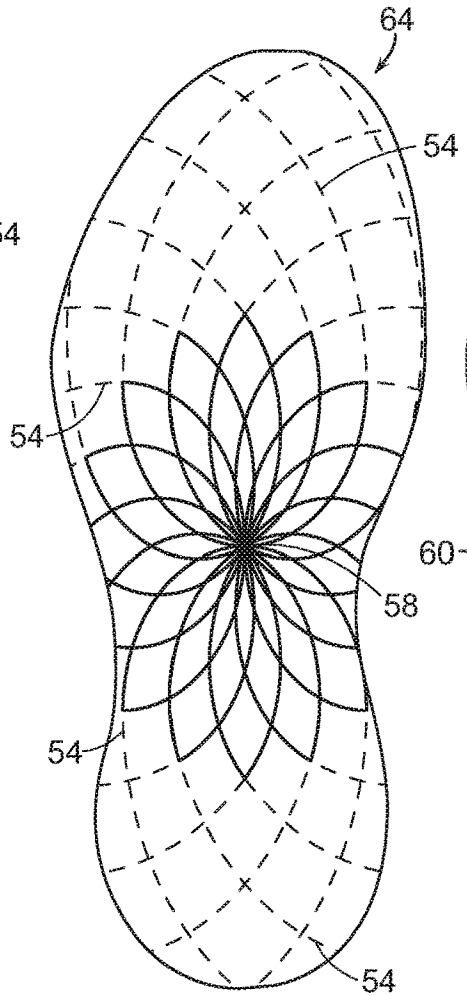
FIG. 6B is a bottom plan view of one example of an outsole of the present invention showing the point of origin of the spiral pathways in the central mid-foot region of the outsole.
Figure 6A:
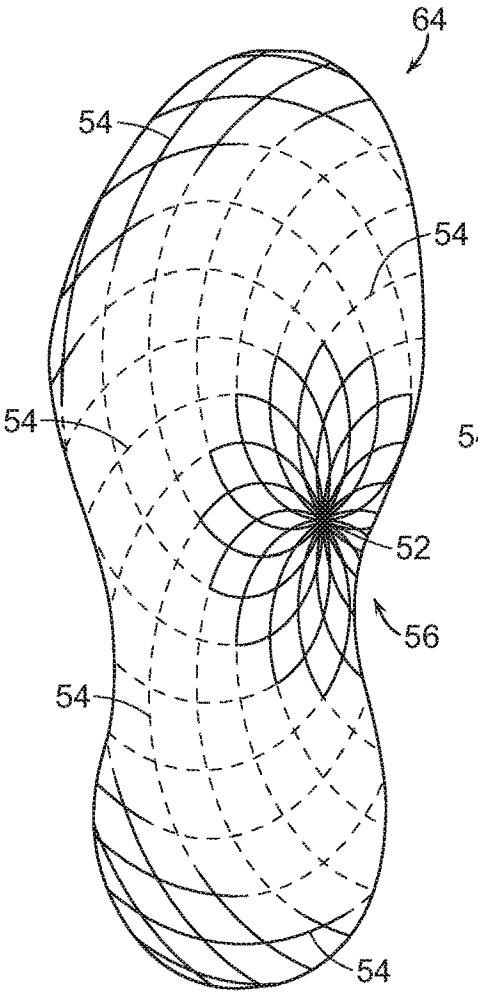
FIG. 6A is a bottom plan view of one example of an outsole of the present invention showing the point of origin of the spiral pathways in the arch area of the outsole.

It should be understood that the point of origin of the spiral pathways can be at various locations. Referring to FIGS. 6A-6D, an outsole of a right shoe (64) is shown containing the spiral pathways superposed over each other as discussed above. In FIG. 6A, the point of origin (52) of the spiral pathways (54) is shown in the arch area (56) of the outsole. In FIG. 6B, the point of origin (58) of the spiral pathways (54) is shown in the central mid-foot region of the outsole. In FIG. 6C, the point of origin of the spiral pathways (54) is outside the lateral edge (60) of the mid-foot region of the outsole; and in FIG. 6D, the point of origin (62) is shown in the central mid-foot region of the outsole, wherein the lengths of the spiral segments and spiral pathways are miniaturized (66). The spiral segments and spiral pathways shown in FIG. 6D are on a much smaller scale than the spiral segments and spiral pathways shown in FIGS. 6A-6C.

Figure 7:
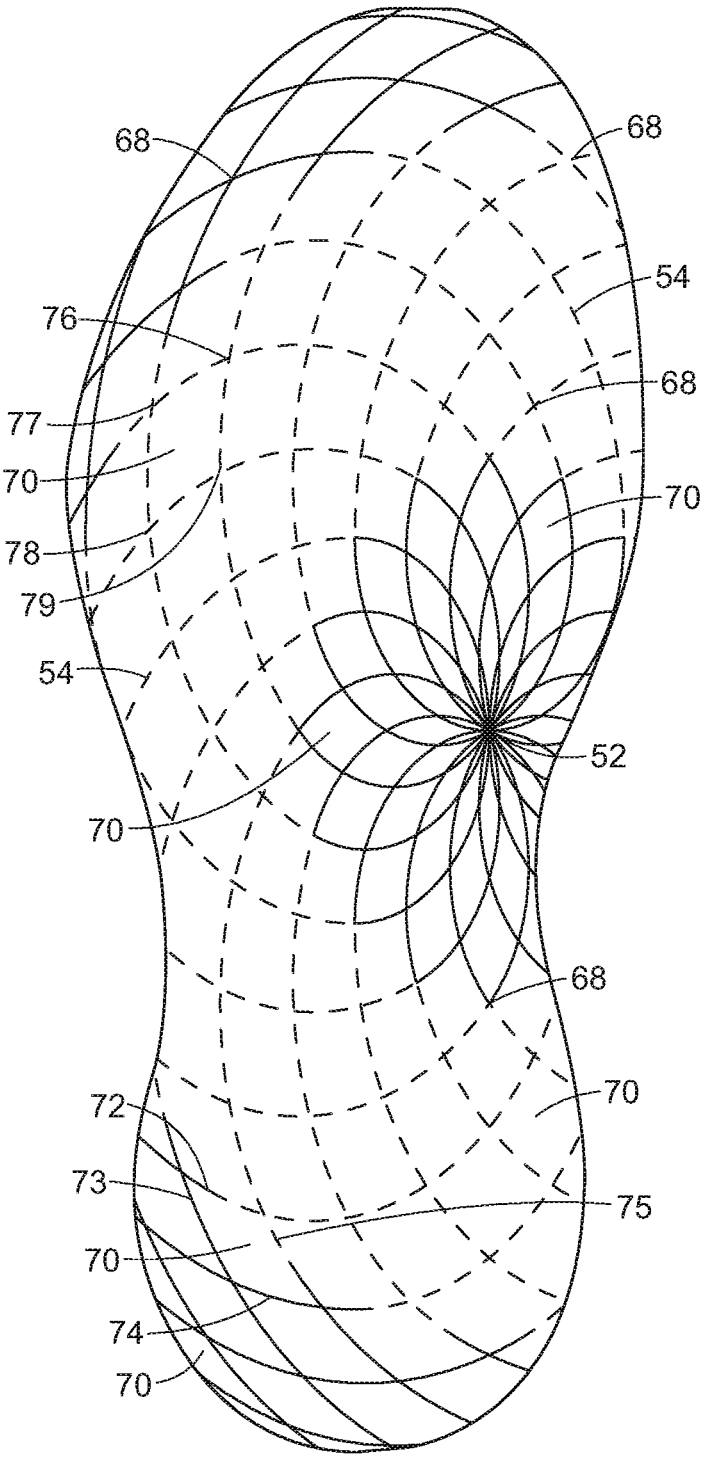
FIG. 7 is a close-up view of the outsole shown in FIG. 6A, where the focal point of the spiral pathways is on the medial side and in the arch area of the outsole.

Referring to FIG. 7, the outsole of FIG. 6A, where the focal point (52) of the spiral pathways (54) is on the medial side and in the arch area of the outsole is shown in more detail. Here, the intersecting points (68) between the different arc pathways (54) and the generation of the four-side tile pieces (70) is shown in more detail. The curved sub-segments (72, 73, 74, and 75) of a spiral segment are pieced together to create substantially four-sided tile pieces (70) on the outsole of the shoe. The intersecting points between the superposed sets of spiral pathways (A) and (B) form the corners of these tile pieces (for example, the corners can be seen as 76, 77, 78, and 79.) These individual tile pieces (70) contain different traction members (not shown in FIG. 7) as discussed further below.

As described above, in one example, the outsole comprises a first set of arc pathways having a center point located on the medial side of the forefoot region and extending along the forefoot region in a generally longitudinal direction. The radius of each arc pathways increases from the center point as the arcs extend along the forefoot region. A second set of arc pathways have a center point located on the posterior end of the forefoot region and extend along the forefoot region in a generally transverse direction. The radius of each arc pathway increases from the center point as the arcs extend along the forefoot region.

When the first and second arc pathways are superposed over each other, four-sided tile pieces are formed on the surface of the forefoot region. In one embodiment, the first and second arc pathways with their varying radii and their intersection points can be limited to the forefoot region. That is, in one embodiment, only the forefoot region may contain the four-sided tile pieces with the projecting traction members. The other regions (for example, the mid-foot and rear-foot regions) may contain no traction members or different configurations of traction members. In other embodiments, as discussed above, the entire outsole may contain the arc pathways, intersecting points, and resulting four-sided tiles. In still other embodiments, select regions of the outsole other than the forefoot region may contain the arc pathways, intersecting points, and tile pieces.

For example, the outsole may comprise a first set of arc pathways having a center point located on the medial side of the rear-foot region and extending along the rear-foot region in a generally longitudinal direction. The radius of each arc pathways increases from the center point as the arcs extend along the rear-foot region. A second set of arc pathways have a center point located on the posterior end of the rear-foot region and extend along the rear-foot region in a generally transverse direction. The radius of each arc pathway increases from the center point as the arcs extend along the rear-foot region. When the first and second arc pathways are superposed over each other, intersecting points between the first and second set of arc pathways are formed. The intersecting points form four-sided tile pieces on the surface of the rear-foot region.

In general, the anatomy of the foot can be divided into three bony regions. The rear-foot region generally includes the ankle (talus) and heel (calcaneus) bones. The mid-foot region includes the cuboid, cuneiform, and navicular bones that form the longitudinal arch of the foot. The forefoot region includes the metatarsals and the toes. Referring back to FIG. 1, the outsole (16) has a top surface (not shown) and bottom surface (27). The midsole (14) is joined to the top surface of the outsole (16). The upper (12) is joined to the midsole (14).

Figure 8:
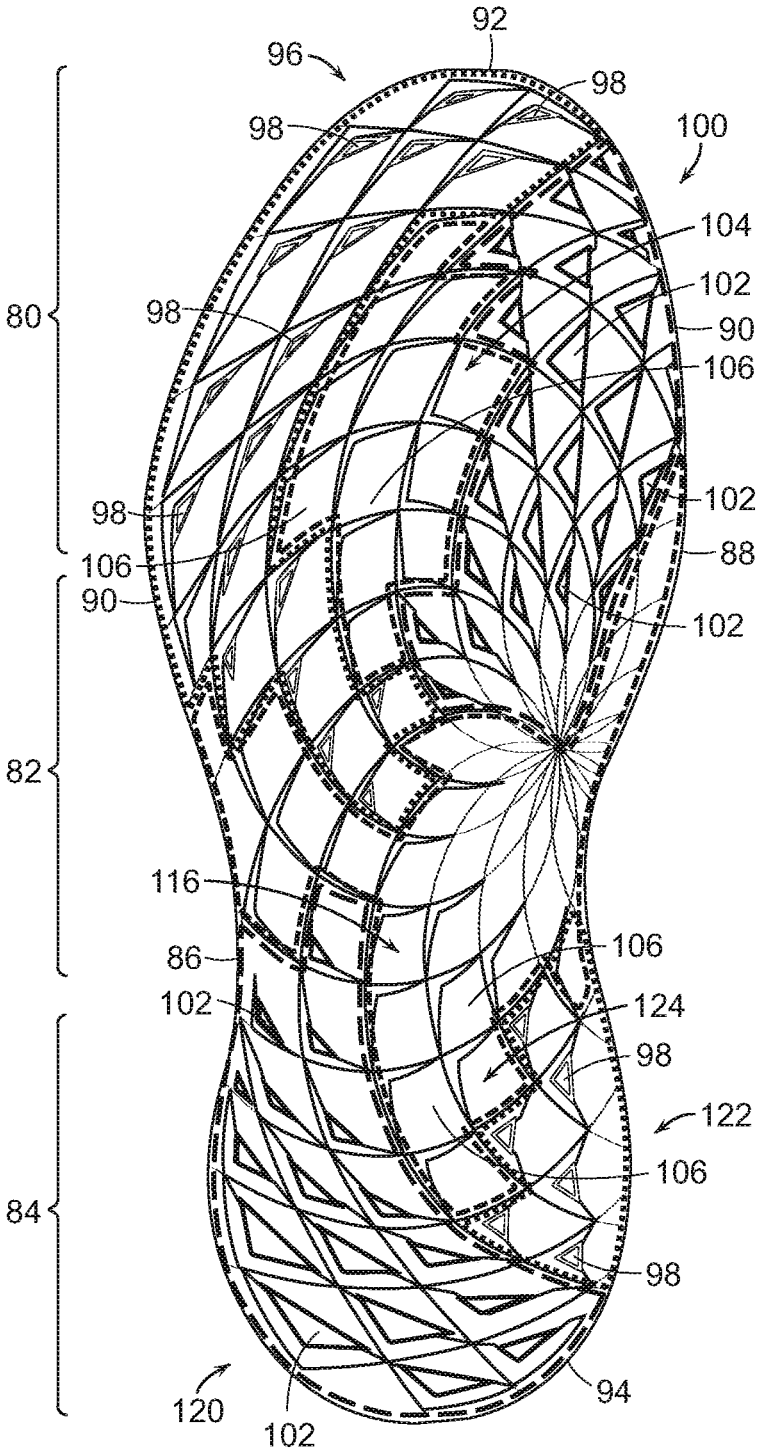
FIG. 8 is a bottom plan view of one example of an outsole of the present invention showing tiles containing different traction members, wherein the tiles are arranged in different zones on the outsole.

Turning to FIG. 8, the outsole (16) generally includes a forefoot region (80) for supporting the forefoot area; a mid-foot region (82) for supporting the mid-foot including the arch area; and rearward region (84) for supporting the rear-foot including heel area. In general, the forefoot region (80) includes portions of the outsole corresponding with the toes and the joints connecting the metatarsals with the phalanges. The mid-foot region (82) generally includes portions of the outsole corresponding with the arch area of the foot. The rear-foot region (84) generally includes portions of the outsole corresponding with rear portions of the foot, including the calcaneus bone.

The outsole also includes a lateral side (86) and a medial side (88). Lateral side (86) and medial side (88) extend through each of the foot regions (80, 82, and 84) and correspond with opposite sides of the outsole. The lateral side or edge (86) of the outsole is the side that corresponds with the outer area of the foot of the wearer. The lateral edge (86) is the side of the foot of the wearer that is generally farthest from the other foot of the wearer (that is, it is the side closer to the fifth toe [little toe].) The medial side or edge (88) of the outsole is the side that corresponds with the inside area of the foot of the wearer. The medial edge (88) is the side of the foot of the wearer that is generally closest to the other foot of the wearer (that is, the side closer to the hallux [big toe].)

More particularly, the lateral and medial sides extend around the periphery or perimeter (90) of the outsole (16) from the anterior end (92) to the posterior end (94) of the outsole. The anterior end (92) is the portion of the outsole corresponding to the toe area, and the posterior end (94) is the portion corresponding to the heel area. Measuring from the lateral or medial edge of the outsole in a linear direction towards the center area of the outsole, the peripheral area generally has a width of about 3 to about 6 mm. The width of the periphery may vary along the contour of the outsole and change from the forefoot to mid-foot to rear-foot regions (80, 82, and 84).

The regions, sides, and areas of the outsole as described above are not intended to demarcate precise areas of the outsole. Rather, these regions, sides, and areas are intended to represent general areas of the outsole. The upper (12) and midsole (14) also have such regions, sides, and areas. Each region, side, and area also may include anterior and posterior sections.

Forefoot Region

As further shown in FIG. 8, the forefoot region (80) of the outsole includes a first (lateral) zone of tiles (96) containing protruding traction members (98) extending along the periphery of the forefoot region; a third (medial) zone of tiles (100) containing protruding traction members (102) extending along the opposing periphery of the forefoot region; and a second (middle) zone of tiles (104) containing protruding traction members (106) disposed between the first and third zones.

Figure 9A:
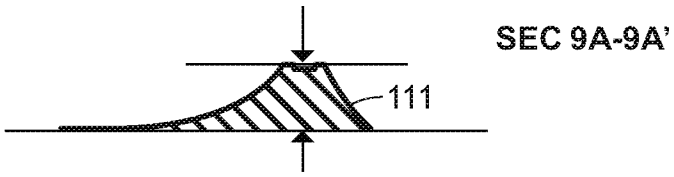
FIG. 9A is a cross-sectional view of the traction member in FIG. 9 along Line A-A'.
Figure 9:
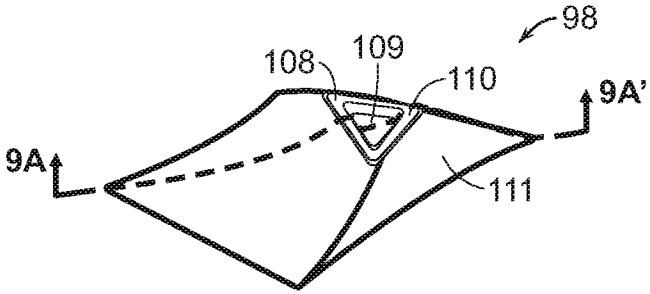
FIG. 9 is a perspective view of one example of a traction member shown in the outsole of FIG. 8.

Referring to FIGS. 8, 9, and 9A, the traction members (98) in the first (lateral) zone of tiles (96) have sloping sides with a triangular-shaped top surface (108) containing recessed (109) and non-recessed areas (110), the non-recessed areas (110) forming a ground contacting surface, and wherein the total ground contact surface area is in the range of about 10 to about 35% based on total surface area of the tile (70). In one preferred embodiment, the total ground contact surface area is in the range of about 17 to about 28%. These traction members (98) are primarily used for golf-specific traction, that is, these traction members help control forefoot lateral traction, and prevent the foot from slipping during a golf shot.

For example, during normal golf play, a golfer makes shots with a wide variety of clubs. As the golfer swings a club when making a shot and transfers their weight, the foot absorbs tremendous forces. In many cases, when a right-handed golfer is addressing the ball, their right and left feet are in a neutral position. As the golfer makes their backswing, the right foot presses down on the medial forefoot and heel regions, and, as the right knee remains tucked in, the right foot creates torque with the ground to resist external foot rotation. Following through on a shot, the golfer's left shoe rolls from the medial side (inside) of their left foot toward the lateral side (outside) of the left foot. Meanwhile, their right shoe simultaneously flexes to the forefoot and internally rotates as the heel lifts. As discussed above, significant pressure is applied to the exterior of the foot at various stages in the golf shot cycle. In the present invention, the first zone of the outsole is designed to provide support and stability to the sides of the foot. That is, the first zone provides support around the lateral edges of the outsole. This first zone helps hold and support the lateral side of the golfer's foot as he/she shifts their weight when making a shot. The shoe provides good traction and control of lateral movement. Thus, the golfer has better stability and balance in all phases of the game.

Figure 10A:
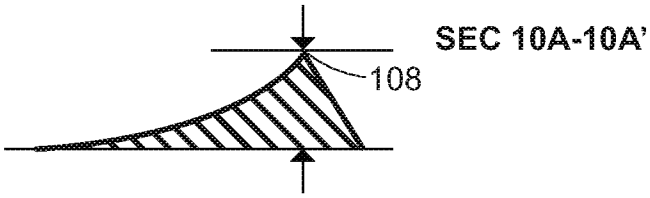
FIG. 10A is a cross-sectional view of the traction member in FIG. 10 along Line A-A'.
Figure 10:
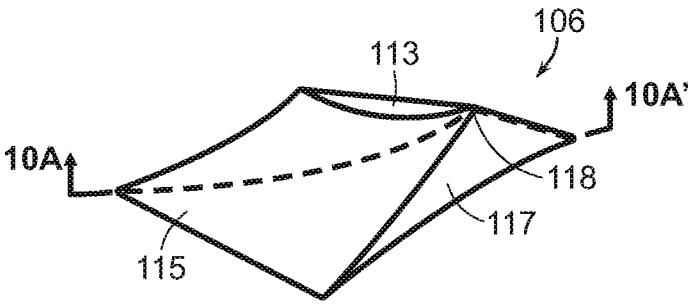
FIG. 10 is a perspective view of a second example of a traction member shown in the outsole of FIG. 8.

Next, referring to FIGS. 8, 10, and 10A, the traction members (106) in the second (middle) zone of tiles (104) have a three-sided pyramid-like shape with three sloping surfaces (113, 115, 117) extending from a pyramid-like base and an apex (118), and wherein the total ground contact surface area is in the range of about 5 to about 40% based on total surface area of the tile (70). In one preferred embodiment, the total ground contact surface area is in the range of about 12 to about 33%. Only one edge (118) of the traction member (106) is in contact with the ground so the gripping power per volume of tile (70) is maximized. These traction members (106) provide comfort and tend to distribute pressure from the middle (second) zone out to the periphery of the sole, that is, to the lateral (first) and medial (third) zones. These traction members (106) in the middle zone are relatively softer and more compliant than the traction members in the neighboring lateral and medial zones. Thus, the middle zone acts as a comfort zone relieving the pressure placed on the center of the outsole and pushing it to the lateral and medial sides of the outsole. Also, if sufficient shoe pressure is applied and the traction members (106) in the middle zone are compressed and flattened to a certain degree, they will make relatively good contact with the ground and provide some grip.

Figure 11A:
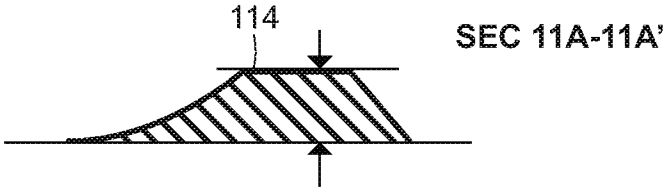
FIG. 11A is a cross-sectional view of the traction member in FIG. 11 along Line A-A'.
Figure 11:
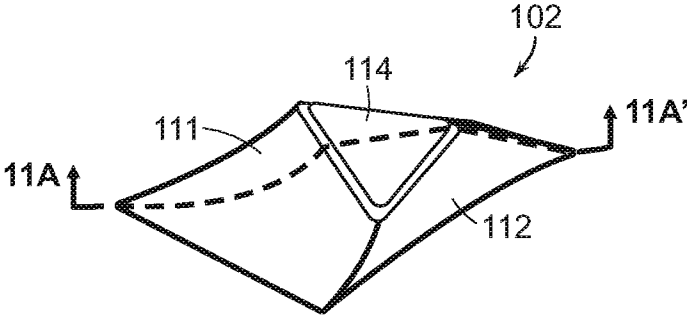
FIG. 11 is a perspective view of a third example of a traction member shown in the outsole of FIG. 8.

Lastly, referring to FIGS. 8, 11, and 11A, the traction members (102) in the third (medial) zone of tiles (100) have two sloping surfaces (111, 112) with a triangular-shaped, non-recessed top surface (114) that forms a ground contacting surface, and wherein the total ground contact surface area is in the range of about 20 to about 60% based on total surface area of the tile (70). In one preferred embodiment, the total ground contact surface area is in the range of about 27 to about 53%. These traction members (102) provide a high contact surface area to prevent slipping on hard, wet, and smooth surfaces. Maximum contact by the traction members (102) is maintained in this third zone (100). The traction members (102) also help to push water away from the shoe as a person follows their normal walking gait cycle as described in further detail below.

Typically, when a person starts naturally walking, the outer part of his/her heel strikes the ground first with the foot in a slightly supinated position. As the person transfers his/her weight to the forefoot, the arch of the foot is flattened, and the foot is pressed downwardly. The foot also starts to rolls slightly inwardly to a pronated position. In some instances, the foot may roll inwardly to an excessive degree and this is type of gait is referred to as over-pronation. In other instances, the foot does not roll inwardly to a sufficient degree and this is referred to as under-pronation. Normal foot pressure is applied downwardly and the foot starts to move to a normal pronated position and this helps with shock absorption. After the foot has reached this neutral (mid-stance) position, the person pushes off on the ball of his/her foot and continues walking. At this point, the foot also rolls slightly outwardly again. The above-described traction members in the third (medial) zone of tiles are particularly effective in providing maximum contact with the ground to help prevent a person from slipping and losing their balance when walking.

Mid-Foot Region

As also shown in FIG. 8, the mid-foot region (82) of the outsole further comprises a zone of tiles (116) containing protruding traction members (106) extending along the mid-foot region, and wherein the traction members have a three-sided pyramid-like shape with three sloping surfaces (113, 115, 117) extending from a pyramid-like base and an apex (118) (See FIGS. 10 and 10A), and wherein the total ground contact surface area is in the range of about 5 to about 40% based on total surface area of the tile (70). Thus, the traction members (106) in the mid-foot region zone of tiles (116) are similar to the traction members (106) found in the second (middle) zone of tiles (104) located in the forefoot region (80). In one preferred embodiment, the total ground contact surface area is in the range of about 12 to about 33%. As discussed above, these traction members (106) provide comfort and tend to distribute pressure from the central area of the mid-foot region toward the peripheral edges of the outsole.

Rear-Foot Region

Turning to the rear-foot region (84) and FIG. 8, the traction members found in this region (84) are similar to the traction members found in the forefoot region (80). However, the zones in the rear-foot region (84) are reversed from the zones in the forefoot region (80). Thus, as shown in FIG. 8, there is a first (lateral) zone of tiles (120) containing protruding traction members (102) extending along the periphery of the rear-foot region (84); a third (medial) zone of tiles (122) containing protruding traction members (98) extending along the opposing periphery (medial side) of the rear-foot region (84); and a second (middle) zone of tiles (124) containing protruding traction members (106) disposed between the rear-foot first (120) and third (122) zones.

First, the traction members (102) in the rear-foot first (lateral) zone of tiles (120) have sloping sides (111, 112) with a triangular-shaped, non-recessed top surface (114) that forms a ground contacting surface, and wherein the total ground contact surface area is in the range of about 20 to about 60% based on total surface area of the tile (70). (See FIGS. 11 and 11A.) Thus, the traction members (102) in the rear-foot first (lateral) zone of tiles (120) are similar to the traction members (102) found in the third (medial) zone of tiles (100) located in the forefoot region (80). As discussed above, these traction members (102) provide a high contact surface area to prevent slipping on hard, wet, and smooth surfaces. Further, the horizontal-facing sidewalls of the traction members help prevent the golfer from slipping when he/she is walking downwardly on golf course slopes. Maximum contact by the traction members (102) is maintained in this rear-foot first (lateral) zone of tiles (120) and the forefoot third (medial) zone of tiles (100).

Meanwhile, as also shown in FIG. 8, the traction members (106) in the rear-foot second (middle) zone of tiles (124) have a three-sided pyramid-like shape with three sloping surfaces (113, 115, 117) extending from a pyramid-like base and an apex (118) (See FIGS. 10 and 10A), and wherein the total ground contact surface area is in the range of about 5 to about 40% based on total surface area of the tile (70). Thus, the traction members (106) in the rear-foot second (middle) zone of tiles (124) are similar to the traction members (106) found in the second (middle) zone of tiles (104) located in the forefoot region (80). As discussed above, these traction members (106) provide comfort and tend to distribute pressure from the middle zone in the rear-foot region out to the periphery of the sole.

Finally, in FIG. 8, the traction members (98) in the rear-foot third (medial) zone of tiles (122) have a triangular-shaped top surface (108) containing recessed (109) and non-recessed (110) areas, the non-recessed areas forming a ground contacting surface (See FIGS. 9 and 9A), and wherein the total ground contact surface area is in the range of about 10 to about 35% based on total surface area of the tile (70). As discussed above, these traction members (98) are primarily used for golf-specific traction, that is, these traction members help control forefoot and rear-foot lateral traction, and prevent the foot from slipping while playing.

Figure 12:
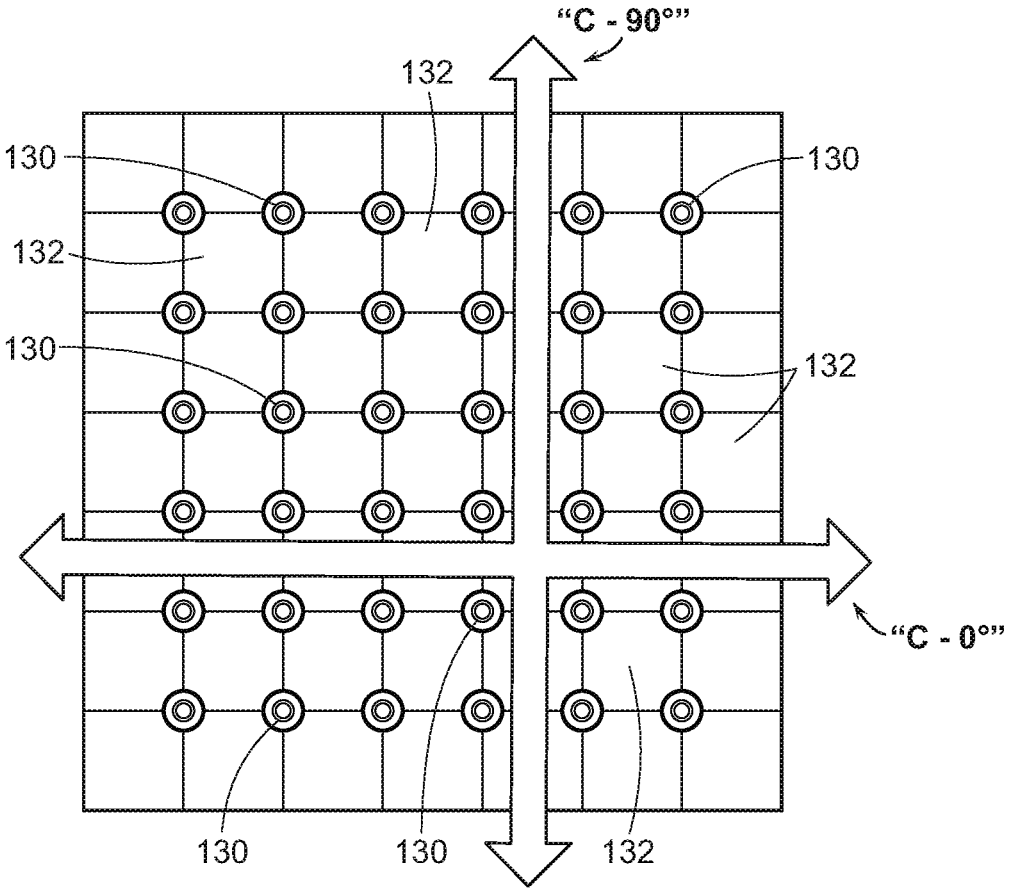
(PRIOR ART) FIG. 12
FIG. 12 is a bottom plan view of an outsole of the prior art, wherein the traction members are arranged in a linear configuration with channels and showing that a turf-trenching effect occurs in the 90 degree and 0 degree directions.
Figure 13:
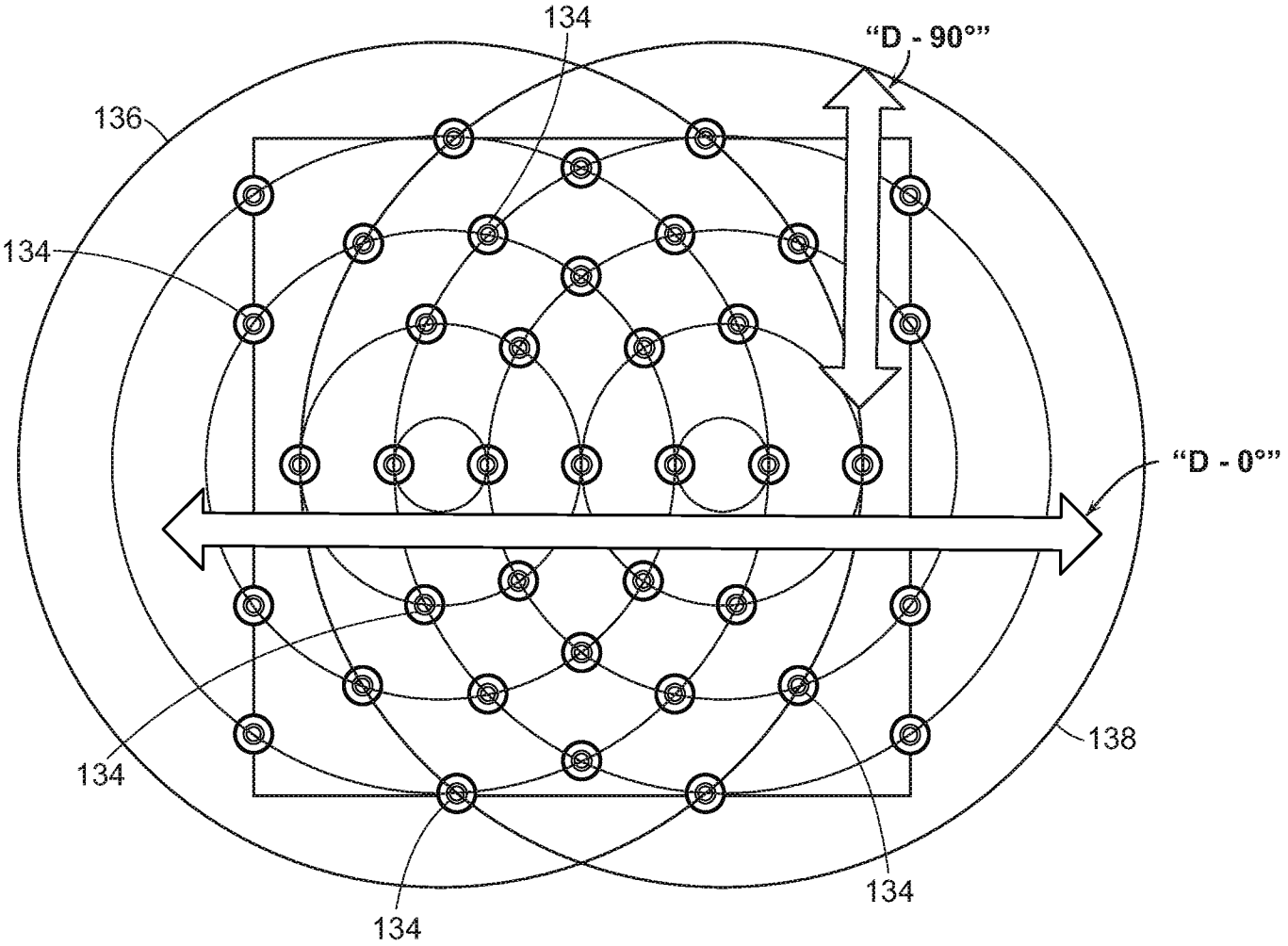
(PRIOR ART) FIG. 13
FIG. 13 is a bottom plan view of an outsole of the prior art, wherein the traction members are arranged in a double-radial configuration with channels, and showing that a turf-trenching effect occurs in the 90 degree and 0 degree directions.
Figure 14:
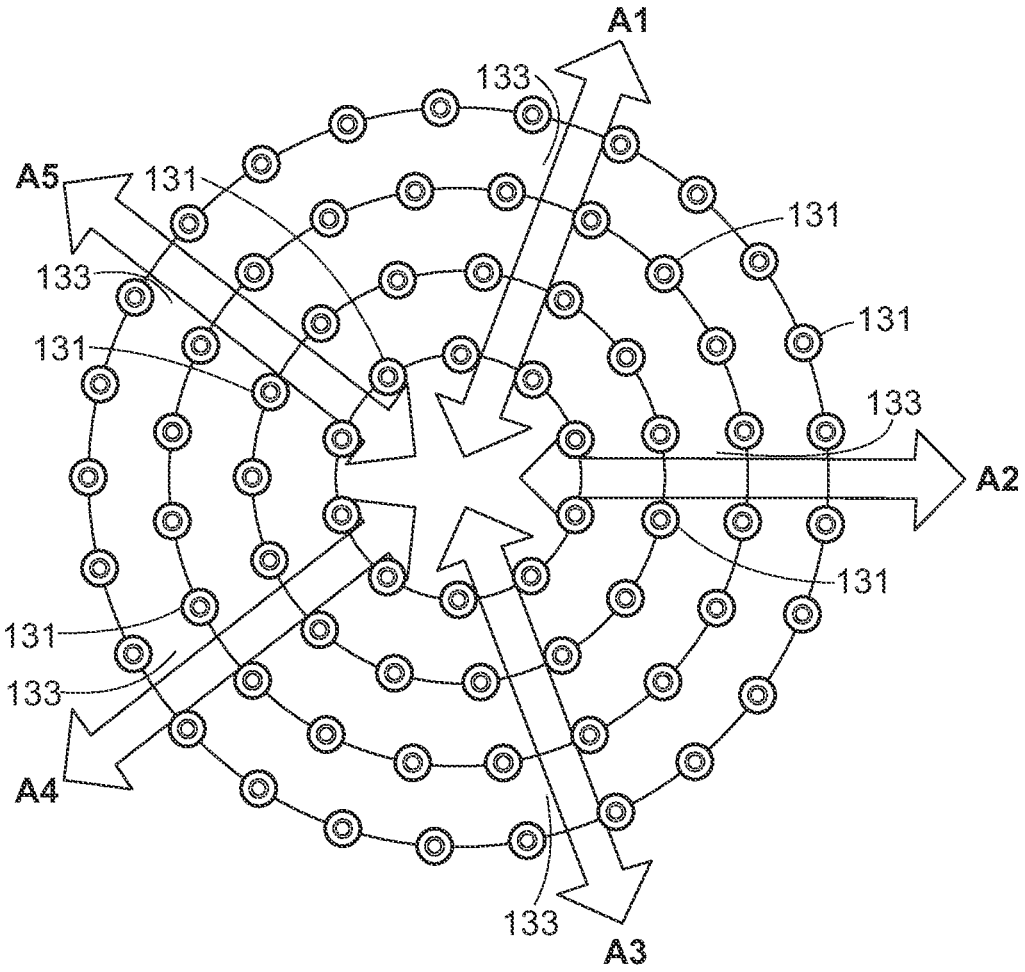
(Prior Art) FIG. 14
FIG. 14 is a bottom plan view of an outsole of the prior art, wherein the traction members are arranged in a circular configuration with channels; and showing that a turf-trenching effect occurs in various directions including a rotational direction.
Figure 15:
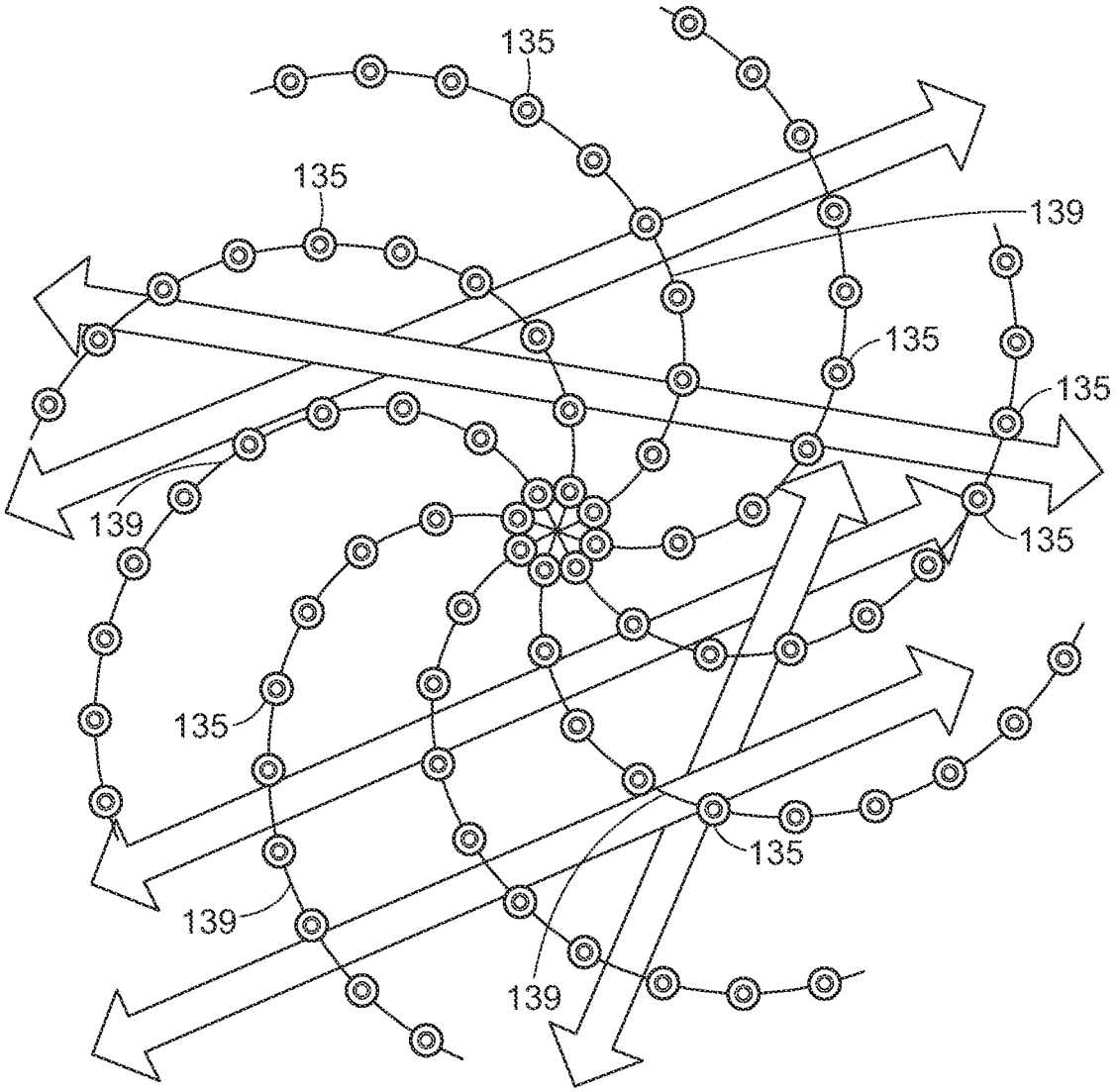
(Prior Art) FIG. 15
FIG. 15 is a bottom plan view of an outsole of the prior art, wherein the traction members are arranged in a single logarithmic spiral configuration with channels; and showing that a turf-trenching effect occurs in the 90 degree and 0 degree directions.

The above-described traction zones in the shoe outsoles of this invention help provide improved traction on all surfaces. Furthermore, these shoes are optimally suited for use on the golf course, because they reduce turf-trenching per the amount of traction provided. The shoes of this invention help prevent damage to the course turf, particularly to putting greens. In contrast, many prior art golf shoes contain traction members arranged in a linear or double-radial configuration. These traditional channeled outsole structures provide less traction per total traction member penetration area; and this can result in more turf damage per amount of traction. In addition, these conventional shoe outsoles may not have good traction on all surfaces. Such channeled outsoles can provide less than optimum traction for the damage that they create on the course. As shown in FIG. 12, this turf-trenching effect for prior art outsoles containing traction members (130) and channels (132) in a linear configuration (transverse rows along a longitudinal length of the outsole) occurs substantially in both the 90 degree (Arrow C-90°) and 0 degree (Arrow C-0°) directions. Next, as shown in FIG. 13, with traction members (134) arranged in overlapping circular patterns (136, 138) (double-radial configuration) on prior art outsoles, there can be low turf-trenching in the 90 degree directions (Arrow D-90°), but there is substantial turf-trenching in the 0 degree directions (Arrow D-0°). Turning to FIG. 14, with traction members (140) arranged in a concentric circular pattern, there are still channels in this geometric configuration, and there can be trenching in various directions. For example, there can be trenching in linear directions (Arrows D-x°); and rotational directions (Arrows D-y°). Thus, as shown in FIG. 14, trenching can occur in both linear and arcing patterns. In yet another example of a prior art outsole, as shown in FIG. 15, traction members (140) can be arranged in a single logarithmic spiral and channels are still created. With this geometric configuration, trenching occurs substantially in both the 90 degree (Arrow D-90°) and 0 degree (Arrow D-0°) directions.

More particularly, as shown in FIG. 12, when the traction members (130) are arranged in a co-linear pattern and there is close proximity between the members, this tends to cause turf-trenching. Secondly, the outsole structure in FIG. 12 contains linear channels (132), where no traction members are located, and these channeled areas provide no traction. Turf-trenching causes concentrated damage to the turf, while poor traction causes no damage to the turf. But, turf-trenching and traction properties are related. If the shoe slips enough so that one traction member reaches the position of the neighboring traction member, then traction will drop-off due to the traction members pushing through weakened or damaged turf. This slipping of multiple traction members through the same turf causes turf-trenching. Meanwhile, the linear channels do not provide any traction. Since these linear channels do not contain any traction members, the outsole (for example, rubber material) directly contacts the ground surface and there is no gripping strength.

Figure 16:
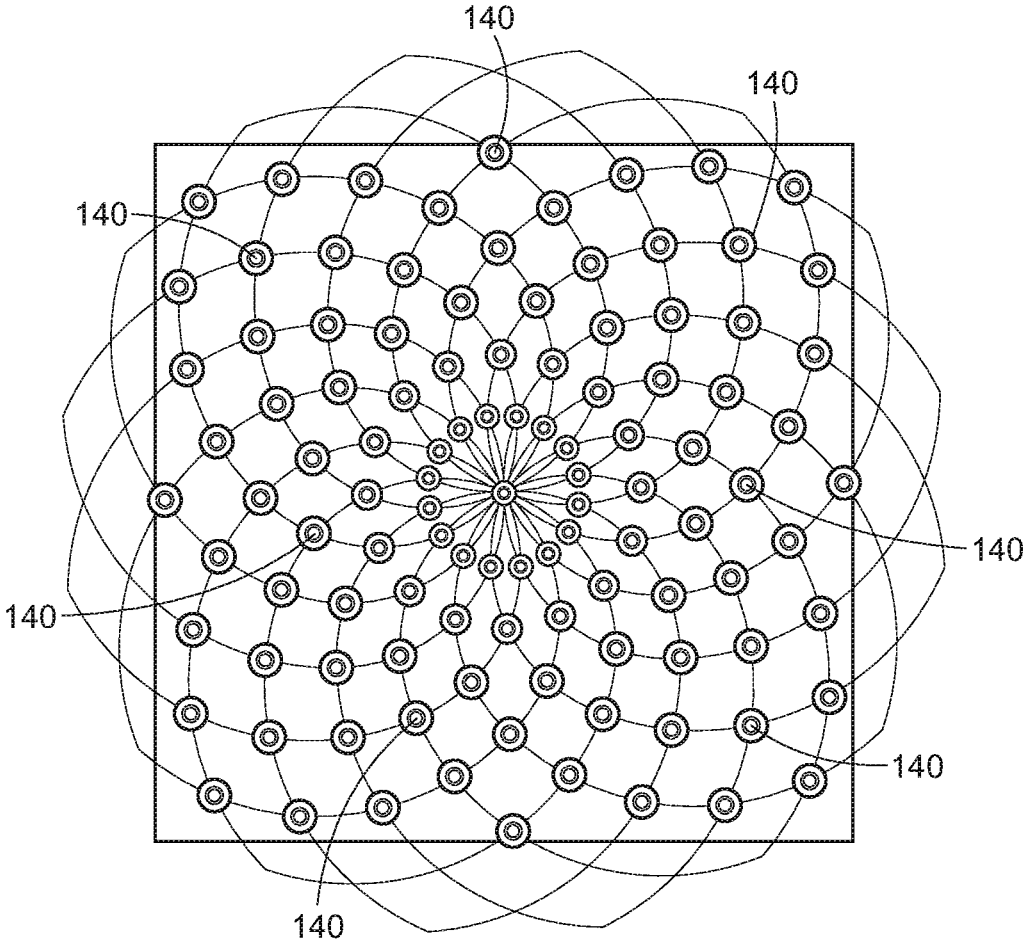
FIG. 16 is a bottom plan view of one example of an outsole of the present invention, wherein the traction members are arranged in different arc pathways with no channeling, and showing that there is no turf-trenching effect.

In the present invention, as shown in FIG. 16 and discussed above, the traction members (140) of the outsole are arranged in an eccentric configuration and each adjacent traction member is positioned at a different radius from a given center of rotation. This results in improved traction for the shoe on all surfaces—there is no channeling and little or no trenching of the turf for the amount of traction provided. The shoe outsoles of this invention do not have a linear channel configuration with closely spaced-apart traction members that can cause turf-trenching. Rather, the shoe outsoles of this invention have traction members that provide optimal traction given the number of traction members in the outsole. That is, these outsoles impart less damage to the golf course for a given amount of traction.

Another advantage of the shoe of this invention is it can be worn when engaging in activities off the golf course. For example, the shoes can be worn as a casual, "off-course" shoe in the clubhouse, office, home, and other ordinary places. On all flooring and other surfaces, the outsole construction has a high traction per volume of traction members for the amount of traction provided. Furthermore, the shoe is lightweight and comfortable so it can be worn easily while walking and in other activities. For example, the shoe can be worn while playing recreational sports such as tennis, squash, racquetball, street hockey, softball, soccer, football, rugby, and sailing. Thus, shoe can be worn when engaging in many different activities on many different surfaces. The shoe provides unique traction and gripping strength on both firm and soft surfaces.

It should be understood that the above-described outsole which generally includes: a) a forefoot region containing first, second (middle), and third zone of tiles with traction members; b) a mid-foot region containing a zone of tiles with traction members; and c) a rear-foot region containing first, second (middle), and third zone of tiles with traction members represents only one example of an outsole structure that can be used in the shoe construction of this invention. As discussed above, the unique pattern of the traction members in the lateral, medial, and middle zones provides improved traction on both hard and soft surfaces. This geometric configuration of traction members helps provide a shoe with high traction per volume of traction members and minimal turf-trenching properties for the amount of traction provided. However, it is recognized that other patterns of traction members can be used without departing from the spirit and scope of this invention.

Furthermore, the traction members disposed on the outsole can have different shapes than the shapes described above to provide optimal traction given the number of traction members. That is, the outsoles can contain a wide variety of traction members so that the gripping power for a particular surface is maximized and less damage is done to that surface for the amount of traction provided. The traction members can have many different shapes including for example, but not limited to, annular, rectangular, triangular, square, spherical, elliptical, star, diamond, pyramid, arrow, conical, blade-like, and rod shapes. Also, the height and area of the traction members and volume of traction member per given tile on the outsole can be adjusted as needed. As discussed above, these different-shaped traction members are arranged on the outsole in a non-channeled pattern. The different traction members and their distinct pattern on the outsole, with no channeling, help provide a shoe with high traction and low turf-trenching properties.

Figure 17B:
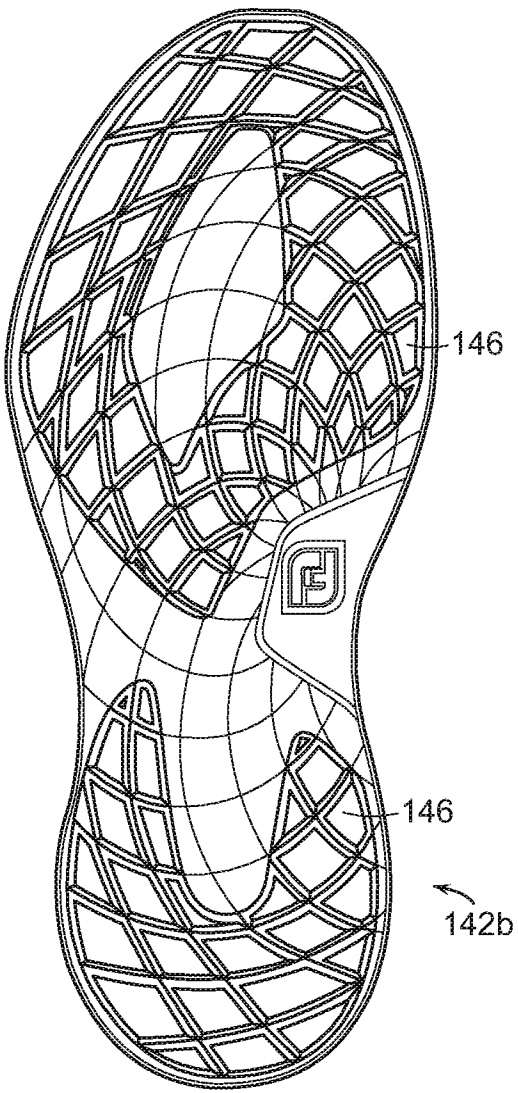
FIG. 17B is a bottom plan view of a third example of an outsole of the present invention, containing different types of traction members than the members found in the outsole of FIGS. 16 and 17A, but wherein the members are arranged in a similar configuration with no channeling, and no turf-trenching effect.
Figure 17A:
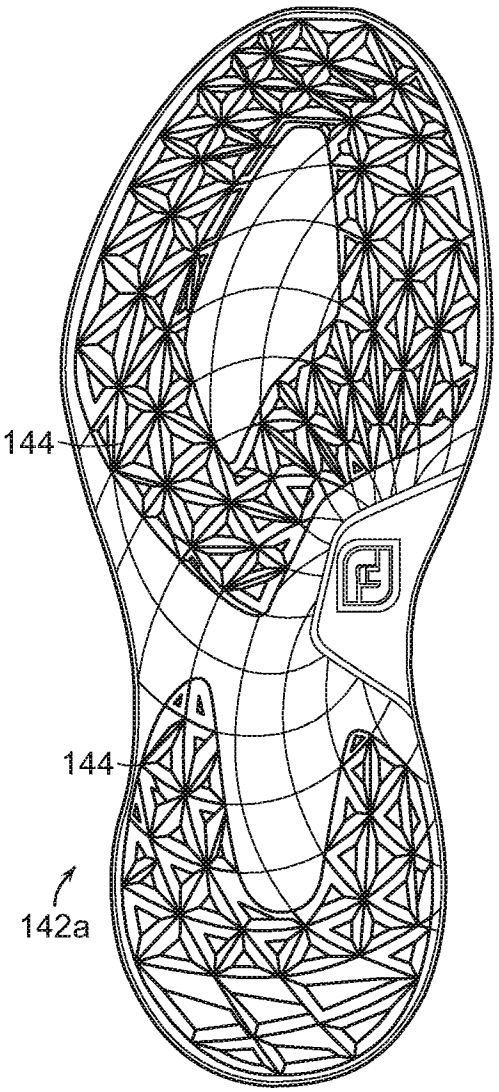
FIG. 17A is a bottom plan view of a second example of an outsole of the present invention, containing different types of traction members than the members found in the outsole of FIG. 16, but wherein the members are arranged in a similar configuration with no channeling, and no turf-trenching effect.

For example, referring to FIGS. 17*a* and 17*b*, two outsole constructions (142*a*, 142*b*) having different sets of traction members are shown. In FIG. 17*a*, the outsole construction (142*a*) has a set of traction members (144) designed particularly for providing good traction on soft surfaces such as a soccer pitch, and lacrosse, rugby, and football fields, and the like. These traction members (144) have specific shapes and dimensions for providing a high level of stability and traction on the course. This outsole construction helps hold and support the medial and lateral sides of the golfer's foot as he/she shifts their weight when making a golf shot. This shoe outsole (142*a*) provides good traction so there is no slipping and the golfer can stay balanced.

Turning to FIG. 17*b*, the outsole construction (142*b*) has a set of traction members (146) designed particularly for providing high traction on firm and particularly smooth and even more particularly hard, wet, and smooth surfaces such as boat decks, polished concrete and marble flooring in sidewalks, painted surfaces of sidewalks, and the like. These traction members (146) have specific shapes and dimensions for providing good gripping strength and traction on a variety of surfaces. For example, the shoes can be worn while walking and in the clubhouse, office, and at home, or in various recreational activities as described above. The traction members (146) maintain high contact with the surface and provide stability. The traction members (146) help prevent slipping on hard, wet, and smooth surfaces.

It should be understood that the outsoles (142*a*, 142*b*) can have different traction members (144, 146), as shown in FIGS. 17*a* and 17*b*, to optimize the outsole for either on-course or off-course wear, that is, for both firm and soft surfaces. However, in both outsole constructions (142*a*, 142*b*), the outsoles generally have a tread pattern as described above: a) a forefoot region containing first, second (middle), and third zone of tiles with traction members; b) a mid-foot region containing a zone of tiles with traction members; and c) a rear-foot region containing first, second (middle), and third zone of tiles with traction members. That is, the type of traction members (144, 146) in the outsoles is different; however, the geometric configuration of traction members is similar to the non-channeled pattern described above. Non-channeling patterns. This pattern helps provide a shoe with a high traction per volume of traction members and minimal turf-trenching properties for the amount of traction provided.

As discussed above, there is a need to provide outsole structures that can achieve high traction on firm and particularly hard, wet, and smooth surfaces such as boat decks, polished concrete and marble flooring, painted surfaces of sidewalks, and the like. These surfaces can be referred to as "off-course" surfaces. At the same time, there is need for outsole structures that provide high traction on various natural turf surfaces, particularly golf courses. These shoes can be referred to as "on-course" surfaces. The present invention provides such multi-surface traction (MST) outsole structures.

More particularly, for multi-surface traction (MST) shoes, the Horizontal Contact Area Ratio (HCAR) and the Vertical Contact Area Ratio (VCAR) of the outsole structures should be considered. These ratios can be applied to any portion of the net outsole area. For this discussion the "net" area refers to the area of a specified portion of outsole normally projected on to the surface of the substratum. The HCAR refers to the ratio of the sum horizontal surface contact area between the traction members and the hard, flat surface with regard to any specified portion of outsole area divided by the total net area of that same specified portion of outsole area. The VCAR refers to the ratio of the sum vertical surface contact area between the ground and the portion of each traction member area that penetrates into the substratum and that is normal to the direction of horizontal ground reaction force divided by the total net area of that same specified portion of outsole area. As the traction members of the outsole penetrate the ground (for example, natural soft and firm grasses, soil, sand, clay and the like), a vertical contact area is generated between the sides of the traction members and the ground.

HCAR

In some instances, it is desirable to maximize the HCAR of a shoe. For example, the "off-course" shoes can have a high HCAR. These outsole structures attempt to maximize contact with typically smoother, firmer surfaces and thus provide greater surface area and friction between the outsole and surface. This helps improve the slip-resistance properties of the outsole. For example, outsoles containing block-like traction members are known in the art. Typically, these block-like traction members have a relatively large width and a relatively low height so they can better grip a hard surface. They are closely packed with little space separation from neighboring traction members. Such outsole structures and traction members are normally composed of a rubber material. These block-like traction members are not easily compressed and generally have good bending-resistance so they do not fold over when horizontal force is generated between the footwear and the substratum. In a sense, these block-like traction members make contact and "ride" on the hard surface to provide gripping strength between the shoe and surface.

VCAR

In some instances, it is desirable to maximize the VCAR of a shoe. These outsole structures attempt to maximize penetration of the ground surface and thus provide greater traction. For example, outsoles containing thin, peg-like cleats are known in the art. Typically, these peg-like traction members have a relatively large height and a relatively small cross-sectional area so they can better penetrate the ground. Such outsole structures and traction members are often composed of a thermoplastic polyurethane material.

For illustration purposes, the VCAR of any given traction member can be considered a rectangle. First, if the traction member has a relatively large length (height), then it will penetrate the ground surface more deeply and provide more traction than a traction member having a relatively short length (height). The length of the rectangle has increased and thus the VCAR has increased. In general, longer, thinner peg-like traction members will penetrate the ground more easily than the shorter, wider, blade-like traction members. This is due to greater pressure acting on the small cross-sectional surface areas of the long, thin peg-like traction members.

A high HCAR outsole tread pattern typically is not a high VCAR outsole tread pattern and vice-versa. Many conventional golf shoes either emphasize on-course playability and sacrifice off-course slip-resistance or emphasize better suitability for off-course traction but sacrifice on-course performance. It is common knowledge that conventional golf shoes are not highly capable of both on-course playability and off-course grip.

In contrast to such conventional on-course and off-course shoes that trade-off certain properties for others, the inventors have built a balanced shoe that optimally combines high slip-resistance surface and high ground-penetration/traction properties. The shoes of this invention have both desirable on-course and off-course properties. Moreover, the shoes of this invention do not severely damage the turf grasses of golf courses, particularly putting greens as discussed further below.

Geometric Pattern of Outsole

The outsoles of this invention are optimized for multi-surface traction by providing regional outsole tread patterns that align with functional foot anatomy and the requirements of swinging a golf club as well as walking on smooth, hard, wet surfaces. The outsoles generally have a tread pattern with: a) a forefoot region containing first, second (middle), and third zone of tiles with traction members; b) a mid-foot region containing a zone of tiles with traction members; and c) a rear-foot region containing first, second (middle), and third zone of tiles with traction members.

The traction members are arranged in an eccentric arcing configuration and each adjacent traction member is positioned at a different radius from a given center of rotation. This results in improved traction for the shoe on all surfaces (MST)—there is no channeling and little or no trenching of the turf for the amount of traction provided as discussed above. Different types of traction members can be used, for example, the traction members can have a relatively short, wide, blade-like structure. However, the geometric pattern of the traction members is similar to the non-channeled pattern described above. The shoe outsoles of this invention do not have a linear channel configuration with closely spaced-apart traction members that can cause turf-trenching. This non-channeled pattern helps provide a shoe with high traction per volume of traction members and minimal turf-trenching properties for the amount of traction provided.

Material Properties and Geometry of Traction Members

Figure 30:
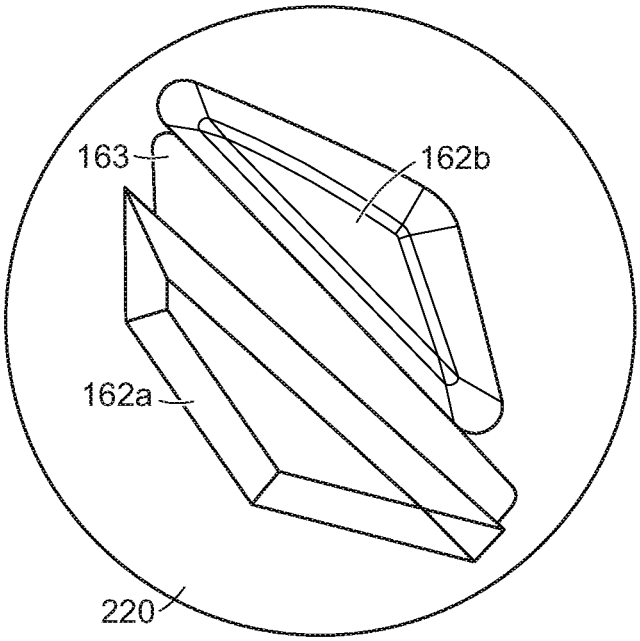
FIG. 30 is a perspective view of an example of a tile piece in the outsole of the present invention showing two traction members and a flat segment (window) disposed between the traction members.

Referring to FIG. 30, one embodiment of the traction members of this invention is shown. In this embodiment, the tile structure (154) located on the outsole (16) comprises a first protruding traction member (162*b*); an opposing second protruding traction member (162*a*); and a non-protruding, base segment (window) (163) disposed between the first and second traction members (162*b*, 162*a*).

The traction members of this invention can have various sizes, shapes, and/or material properties. For example, the different traction members can have separate and distinct material properties so that some traction members are relatively hard and rigid; and other traction members are relatively soft and flexible. The traction members also can have different dimensions (for example, the length or height of the traction members can vary); and the traction members can have different shapes and geometries.

For example, the first traction members (162*b*) can be made from a relatively hard, first thermoplastic polyurethane composition having a hardness of greater than 80 Shore A; and the second traction members (162*a*) can be made from a relatively soft, second thermoplastic polyurethane composition having a hardness of 80 Shore A or less. Such first and second traction members (162*b*, 162*a*) can be made from commercially-available polyurethane compositions such as, for example, Estane® TRX thermoplastic polyurethanes, available from the Lubrizol Corporation.

By varying the hardness of the different traction members, each traction member may be tuned so that it responds differently upon contacting a ground surface. The traction members are configured so they deform differently when pressed against a ground surface. For example, one traction member may have a relatively low hardness that is optimal for maximizing traction with a hard, wet surface; and a second traction member may have a relatively high hardness making it optimal for maximizing traction with soft natural grass. The hardness of the second traction members is preferably greater than the hardness of the first traction members. For example, the hardness of the second traction members can be at least 5% greater than the hardness of the first traction members. In some embodiments, the hardness of the second traction members can be at least 10% or 15% greater; and in other embodiments, at least 20% or 25% greater.

Figure 29:
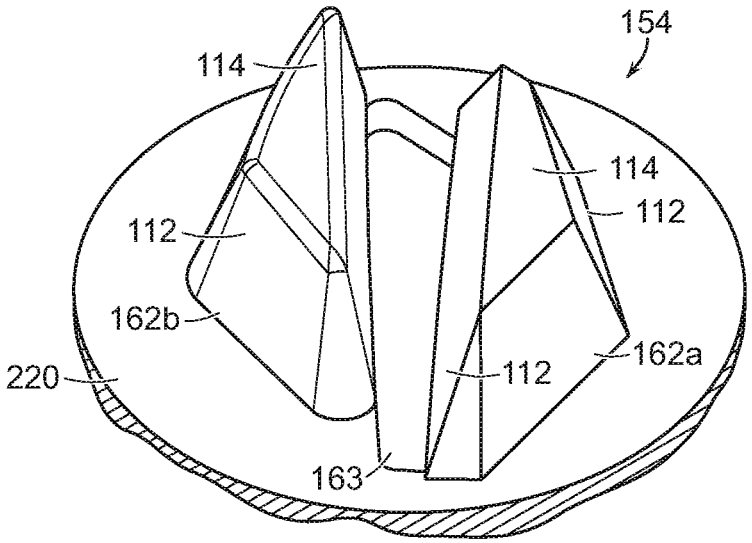
FIG. 29 is a perspective view of an example of a tile piece in the outsole of the present invention showing two traction members and a flat segment disposed between the traction members.

The traction members also can have various dimensions. For example, in one embodiment as shown in FIGS. 29 and 30, the lengths (heights) of the relatively hard traction members (162*b*) and lengths (heights) of the relatively soft traction members (162*a*) are substantially the same. For example, the heights of the relatively hard and soft traction members can be in the range of about 2 mm to about 6 mm. Preferably, the heights of the relatively hard and soft traction members are in the range of about 2.5 mm to about 4.5 mm.

In a second embodiment, the heights of the relatively hard traction members are greater than the heights of the relatively soft traction members. For example, the heights of the relatively hard traction members can be in the range of about 2 mm to about 6 mm; and the heights of the relatively soft traction members can be in the range of about 1.75 mm to about 5.75 mm. Preferably, the difference between traction member heights is in the range of about 0 mm to about 6 mm. In this manner, the firm traction members contact the ground and penetrate the grass and soil more easily. Meanwhile, the relatively soft traction members contact the ground, compress more easily, and help provide some flexibility to the shoe. This outsole structure is particularly effective for on-course use.

In yet another embodiment, the heights of the relatively hard traction members are less than the heights of the relatively soft traction members. For example, the heights of the relatively soft traction members can be in the range of about 2 mm to about 6 mm; and the heights of the relatively hard traction members can be in the range of about 1.75 mm to about 5.75 mm. Preferably, the difference between traction member heights is in the range of about 0 mm to about 6 mm.

By varying the length (height) of the different traction members, each traction member may be tuned so that it penetrates to a different depth when making contact with the ground surface. For example, in one embodiment, the first traction members may have a relatively greater height that is optimized for penetrating the ground surface deeply. Meanwhile, the second traction members may have a relatively lesser height that is optimized for riding on the surface or penetrating the ground to a shallow extent.

The traction members can have various sizes and shapes. The outsole structures (16) of this invention can contain a wide variety of traction members so that the gripping power for a particular surface is maximized and less damage is done to that surface for the amount of traction provided. The traction members can have many different shapes including for example, but not limited to, annular, rectangular, triangular, square, spherical, elliptical, star, diamond, pyramid, arrow, conical, blade-like, and rod shapes. Also, the height and area of the traction members and volume of traction member per given tile structure on the outsole can be adjusted as needed. For example, in one embodiment as shown in FIGS. 29 and 30, the first traction members (162*b*) can have three sidewalls with sloping surfaces and a triangular-shaped, non-recessed top surface that forms a ground contacting surface. The second traction members (162*a*) can also have three sidewalls with sloping surfaces and a larger sized triangular-shaped, non-recessed top surface than the first traction members. The traction tile structure (154) further includes a flexible window (163) disposed between the first and second traction members (162*b*, 162*a*); and a surrounding hard base material (220) as described further below.

The total ground contact surface area is preferably in the range of about 5 to about 80% based on total surface area of the traction tile structure. That is, the first and second traction members contact the ground surface such that the total ground contact surface area is preferably in the range of about 5 to about 80% based on total surface area of the tile. In one preferred embodiment, the total ground contact surface area is in the range of about 10 to about 70%, and in another preferred embodiment, the total ground contact surface area is in the range of about 20 to about 60%. In another preferred embodiment, the total ground contact surface area is in the range of about 15 to about 55%. The flat, base segment (window) (163) of the traction tile structure, which is located between the first and second traction members (162*b*, 162*a*), constitutes about 1% to about 70% of the tile. In some cases, the window (163) can constitute about 70 to about 100% of the traction tile structure as shown in FIG. 18, wherein there are no traction members in the tile structures (156).

Traction Zones

Figure 18:
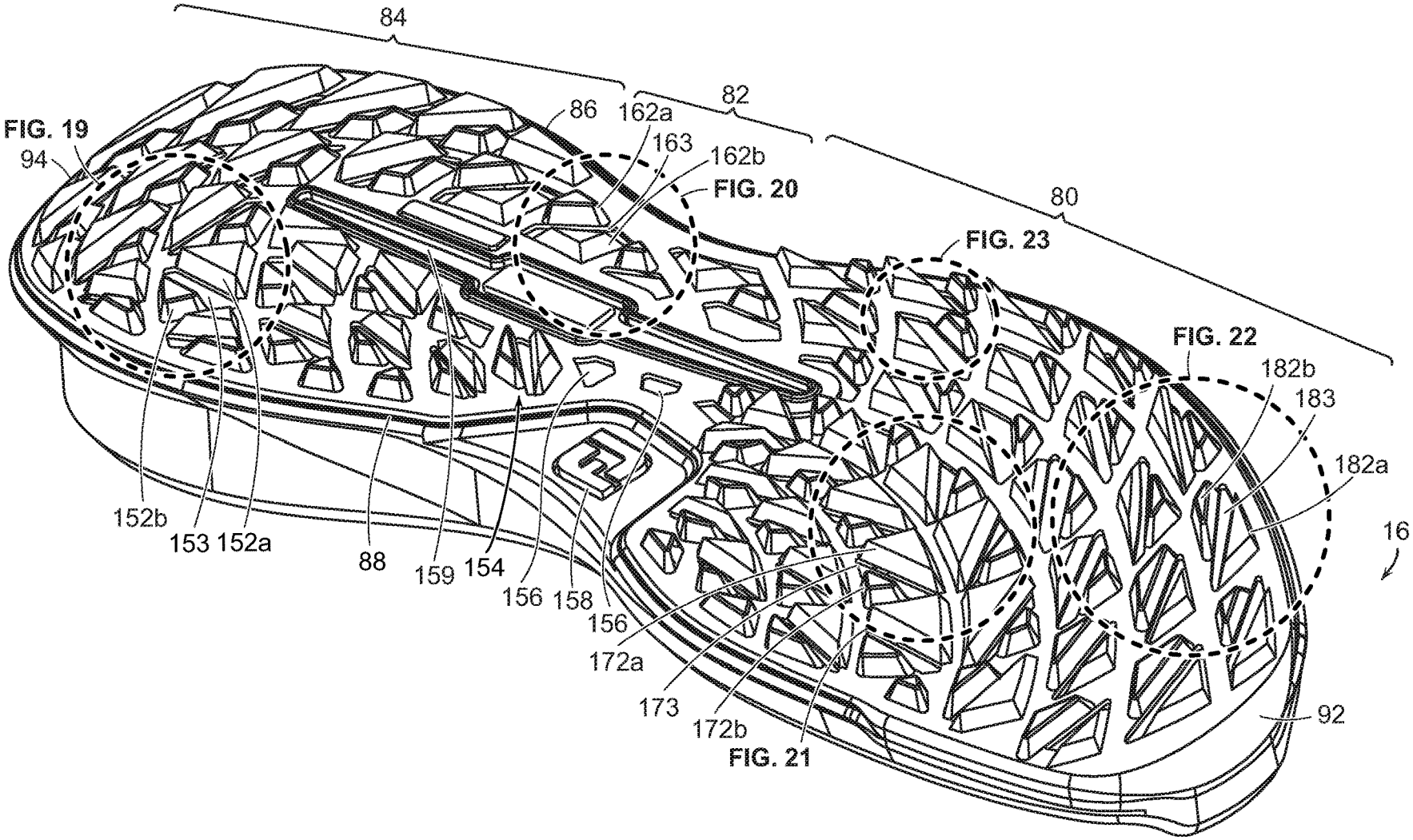
FIG. 18 is a bottom perspective view of another example of a golf shoe of the present invention showing the outsole in detail.

Turning to FIG. 18, the outsole (16) generally includes a forefoot region (80) for supporting the forefoot area; a mid-foot region (82) for supporting the mid-foot including the arch area; and rearward region (84) for supporting the rear-foot including heel area. In general, the forefoot region (80) includes portions of the outsole corresponding with the toes and the joints connecting the metatarsals with the phalanges. The mid-foot region (82) generally includes portions of the outsole corresponding with the arch area of the foot. The rear-foot region (84) generally includes portions of the outsole corresponding with rear portions of the foot, including the calcaneus.

The outsole also includes a lateral side (86) and a medial side (88). Lateral side (86) and medial side (88) extend through each of the foot regions (80, 82, and 84) and correspond with opposite sides of the outsole. The lateral side or edge (86) of the outsole is the side that corresponds with the outer area of the foot of the wearer. The lateral edge (86) is the side of the foot of the wearer that is generally farthest from the other foot of the wearer (that is, it is the side closer to the fifth toe [little toe].) The medial side or edge (88) of the outsole is the side that corresponds with the inside area of the foot of the wearer. The medial edge (88) is the side of the foot of the wearer that is generally closest to the other foot of the wearer (that is, the side closer to the hallux [big toe].)

More particularly, the lateral and medial sides extend around the periphery or perimeter (90) of the outsole (16) from the anterior end (92) to the posterior end (94) of the outsole. The anterior end (92) is the portion of the outsole corresponding to the toe area, and the posterior end (94) is the portion corresponding to the heel area.

The regions, areas, and zones of the outsole as described above are not intended to demarcate precise areas of the outsole. Rather, these regions, areas, and zones are intended to represent general areas of the outsole. The upper (12) and midsole (14) also have such regions, areas, and zones. Each region, area, and zone also may include anterior and posterior sections.

Rear-Foot Region

Figure 18A:
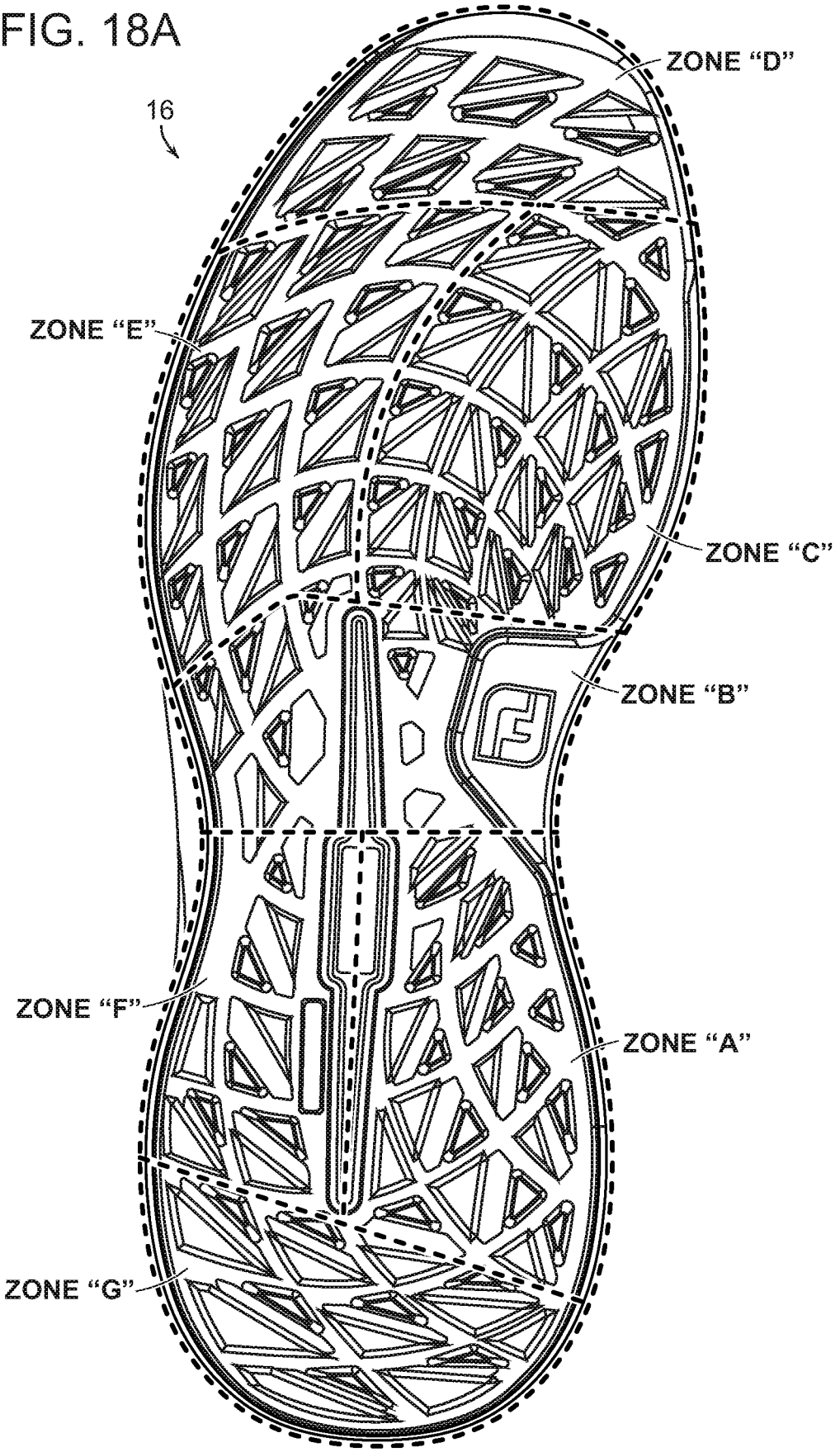
FIG. 18A is a bottom plan view of the golf shoe shown in FIG. 18 showing the tile outsole with tile pieces containing different traction members, wherein the tiles are arranged in different zones.
Figure 19:
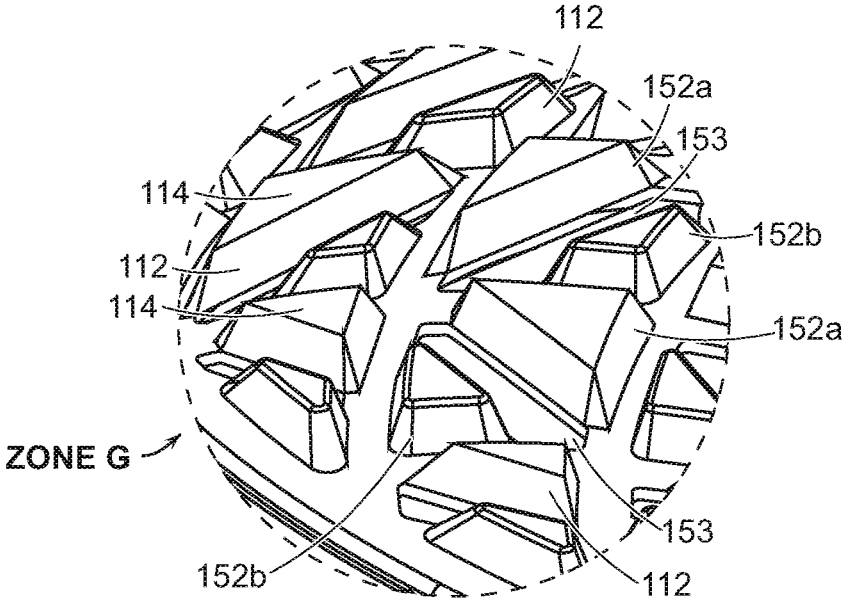
FIG. 19 is a close-up view of a portion of the outsole shown in FIG. 18, as marked by the "FIG. 19" broken circle in FIG. 18.

In FIGS. 18 and 18A, turning to the rear-foot region (84), the traction tile structures found in this Zone "G" comprise a first protruding traction member; an opposing second protruding traction member; and a non-protruding, flexible window disposed between the first and second traction members. More particularly, two traction tile structures in Zone G are shown in an enlarged view in FIG. 19. In this example, the first traction members (152*b*) are relatively hard and can be made, for example, from a hard, first thermoplastic polyurethane composition. In one embodiment, the hard, thermoplastic polyurethane composition has a hardness of greater than 70 Shore A. The second traction members (152*a*) are relatively soft and can be made, for example, from a soft, second thermoplastic polyurethane composition. In one embodiment, the soft, second thermoplastic compositions have a hardness of 70 Shore A or less. A flexible window (153) is disposed between the first and second traction members (152*b*, 152*a*).

The first and second traction members (152*b*, 152*a*) have sloping sides (112) with a triangular-shaped, non-recessed top surface (114) that forms a ground contacting surface. Preferably, the total ground contact surface area is in the range of about 10 to about 70% based on total surface area of the tile. These traction members in Zone G (crash-pad) provide a high contact surface area to prevent slipping on hard, wet, and smooth surfaces. In other word, these traction members provide a "crash-pad" for the outsole; they have a relatively wide ground-contacting surface and have a relatively high Horizontal Contact Area Ratio (HCAR). Maximum contact by the traction members is maintained in this rear-foot zone of tiles. Also, in Zone G, the horizontal sidewalls of the traction members help prevent the golfer from slipping when he/she is walking downwardly on a golf slope or simply when he/she is walking on any surface.

As also shown in FIG. 18A, Zones A and F are located in the rear-foot region (84), and the traction tile structures in these Zones also comprise a first protruding traction member; an opposing second protruding traction member; and a non-protruding, flexible window disposed between the first and second traction members. For example, the first traction members (162*b*) can be relatively hard and can be made, for example, from a hard, first thermoplastic polyurethane composition. The second traction members (162*a*) are relatively soft and can be made, for example, from a soft, second thermoplastic polyurethane composition. In one embodiment, the soft, thermoplastic polyurethane composition has a hardness of 70 Shore A or less. A flexible window (163) is disposed between the first and second traction members. These traction members (162*a*, 162*b*) have a have a pyramid-like shape with sloping sides (112) and a triangular-shaped, non-recessed top surface (114) that forms a ground-contacting surface. In one embodiment, the total ground contact surface area is in the range of about 1 to about 70% based on total surface area of the traction tile structure.

When a golfer swings a club and transfers his/her weight, their foot absorbs tremendous forces. For example, when a right-handed golfer is first planting his/her feet before beginning any club swinging motion (that is, when addressing the ball), their weight is evenly distributed between their lead (front) and trail (back) feet. As the golfer begins their backswing (upswing), their weight shifts primarily to their back foot. Significant pressure is applied to the back foot at the beginning of the downswing. Thus, the back foot can be referred to as the driving foot and the front foot can be referred to as the stabilizing foot. As the golfer follows through with their swing (downswing) and drives the ball, their weight is transferred from the driving foot to the front (stabilizing) foot. During the swinging motion, there is some pivoting at the back and front feet, but this pivoting motion must be controlled. It is important the feet do not substantially move or slip when making the shot. Good foot traction is important during the golf upswing and downswing.

The traction members in Zones A and F as described above have vertical sidewalls that help manage strong horizontal forces applied against the outsole during the golf swing resulting in more resistance/traction, particularly during a golf upswing. The traction members in Zones C and E, which are located in the Forefoot Region and discussed in detail below, also help stabilize the foot against this pressure, thus providing more resistance/traction during the golf swing.

Mid-Foot Region

Figure 20:
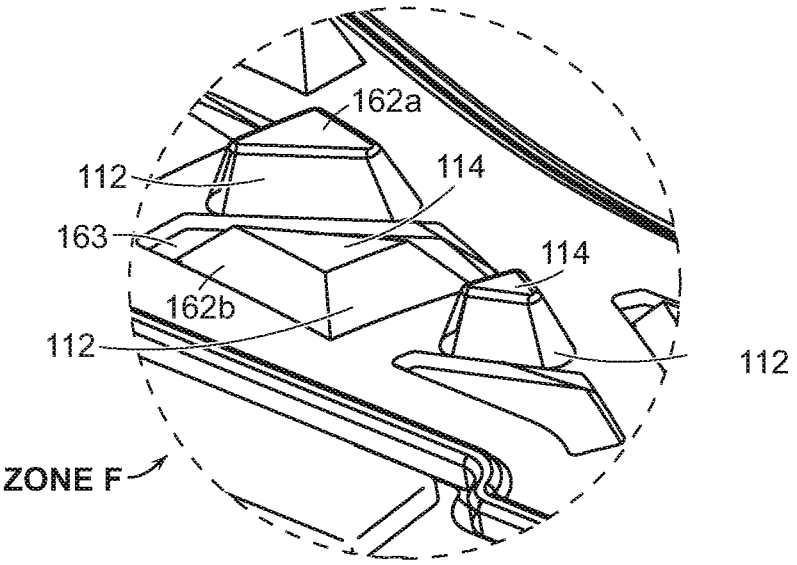
FIG. 20 is a close-up view of a portion of the outsole shown in FIG. 18, as marked by the "FIG. 20" broken circle in FIG. 18.

As also shown in FIGS. 18 and 18A, the mid-foot region (82) of the outsole (16) further comprises traction tile structures extending along this region, which can be referred to as Zone "B". More particularly, two traction tile structures in Zone B are shown in enlarged in FIG. 20. In this example, the first traction members (165*b*) are relatively hard and can be made, for example, from a hard, first thermoplastic polyurethane composition. In one embodiment, the hard, thermoplastic polyurethane composition has a hardness of greater than 70 Shore A. The second traction members (165*a*) are relatively soft and can be made, for example, from a soft, second thermoplastic polyurethane composition. A flexible window (163) is disposed between the first and second traction members. In some cases, the window (163) can constitute about 70 to about 100% of the traction tile structure, wherein there are no traction members in the tile structures (156, 156). Also, in the mid-foot region (82), there may be a visible logo (158) which can be made from various materials, preferably thermoplastic polyurethane. Also, a shank (footbridge) (159) can be included in the outsole (16). In turn, this outsole (16), with its high mechanical strength properties, gives the golfer more stability and balance while walking on and off the course.

These traction members also have a have a pyramid-like shape with sloping sides (112) and a triangular-shaped, non-recessed top surface (114) that forms a ground-contacting surface. In one embodiment, the total ground contact surface area is in the range of about 1 to about 60% based on total surface area of the traction tile structure. In one preferred embodiment, the total ground contact surface area is in the range of about 5 to about 50%. These traction members in the mid-foot region (82) provide comfort and tend to distribute pressure from the central area of the mid-foot region toward the peripheral edges of the outsole (16).

Forefoot Region

As further shown in FIGS. 18 and 18A, the forefoot region (80) of the outsole (16) includes a first (medial) zone of tiles (Zone "C") containing traction tile structures extending along the periphery of the forefoot region; a second zone of tiles (Zone "D") containing traction tile structures disposed in the anterior portion of the forefoot region; and a third (lateral) zone (Zone "E") containing protruding traction tile structures extending along the opposing periphery of the forefoot region.

Figure 21:
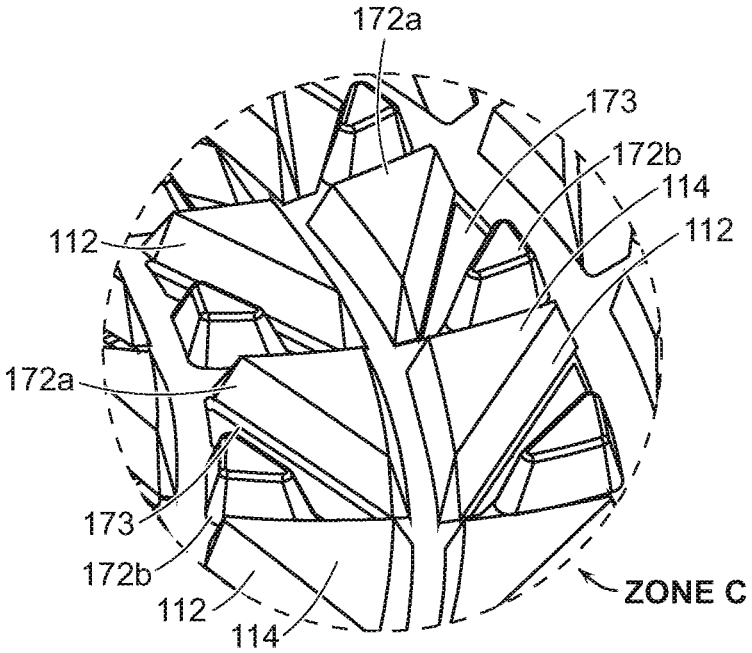
FIG. 21 is a close-up view of a portion of the outsole shown in FIG. 18, as marked by the "FIG. 21" broken circle in FIG. 18.

Referring to FIG. 21, the traction tile structures in this medial Zone C are shown having first and second traction members (172*b*, 172*a*) with sloping sides (112) and a triangular-shaped, non-recessed top surface (114) that forms a ground contacting surface. A flexible window (173) is disposed between the first and second traction members. In this example, the first traction members (172*b*) are relatively hard and can be made, for example, from a hard, first thermoplastic polyurethane composition. In one embodiment, the hard, thermoplastic polyurethane composition has a hardness of greater than 70 Shore A. The second traction members (172*a*) are relatively soft and can be made, for example, from a soft, second thermoplastic polyurethane composition. In one embodiment, the soft, thermoplastic polyurethane composition has a hardness of 70 Shore A or less. Preferably, the total ground contact surface area is in the range of about 10 to about 70% based on total surface area of the traction tile structure. These traction members are located under the ball of the foot, which is a high-pressure area.

Figure 22:
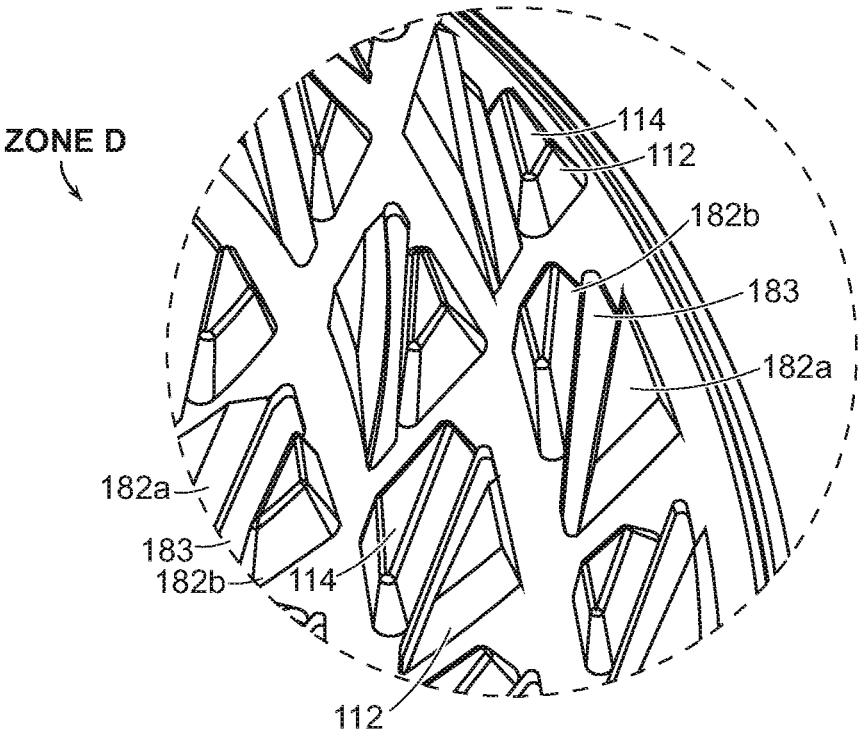
FIG. 22 is a close-up view of a portion of the outsole shown in FIG. 18, as marked by the "FIG. 22" broken circle in FIG. 18.

Turning to FIG. 22, an enlarged view of the traction tile members in anterior Zone D is shown. These first and second traction members (182*b*, 182*a*) also have sloping sides (112) and a triangular-shaped, non-recessed top surface (114) that forms a ground contacting surface. A flexible window (183) is disposed between the first and second traction members. In this example, the first traction members (182*b*) are relatively hard and can be made, for example, from a hard, first thermoplastic polyurethane composition with a hardness as discussed above. The second traction members (182*a*) are relatively soft and can be made, for example, from a soft, second thermoplastic polyurethane composition with a hardness as discussed above. Preferably, the total ground contact surface area is in the range of about 10 to about 70% based on total surface area of the traction tile structure. These traction members are located under the toes of the foot, and help provide good traction and toe push-off.

Figure 23:
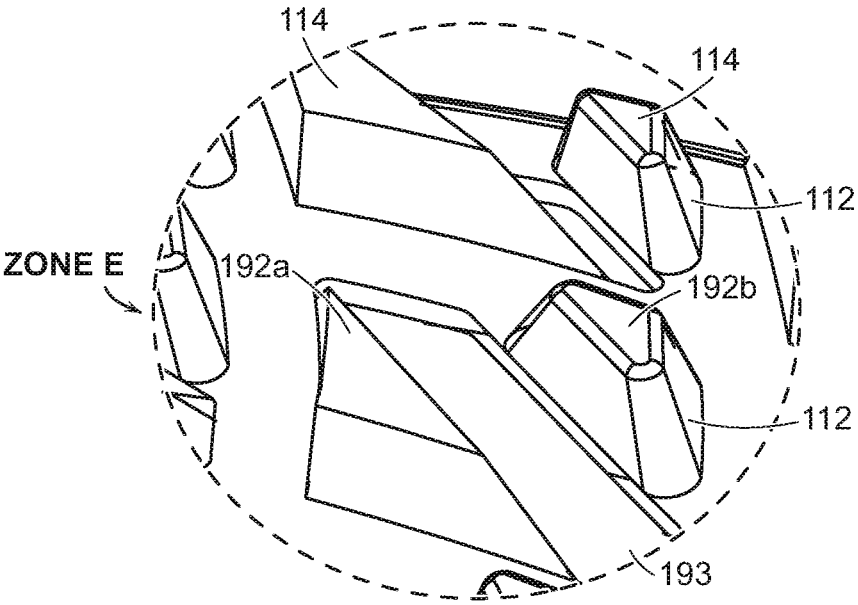
FIG. 23 is a close-up view of a portion of the outsole shown in FIG. 18, as marked by the "FIG. 23" broken circle in FIG. 18.
Figure 24:
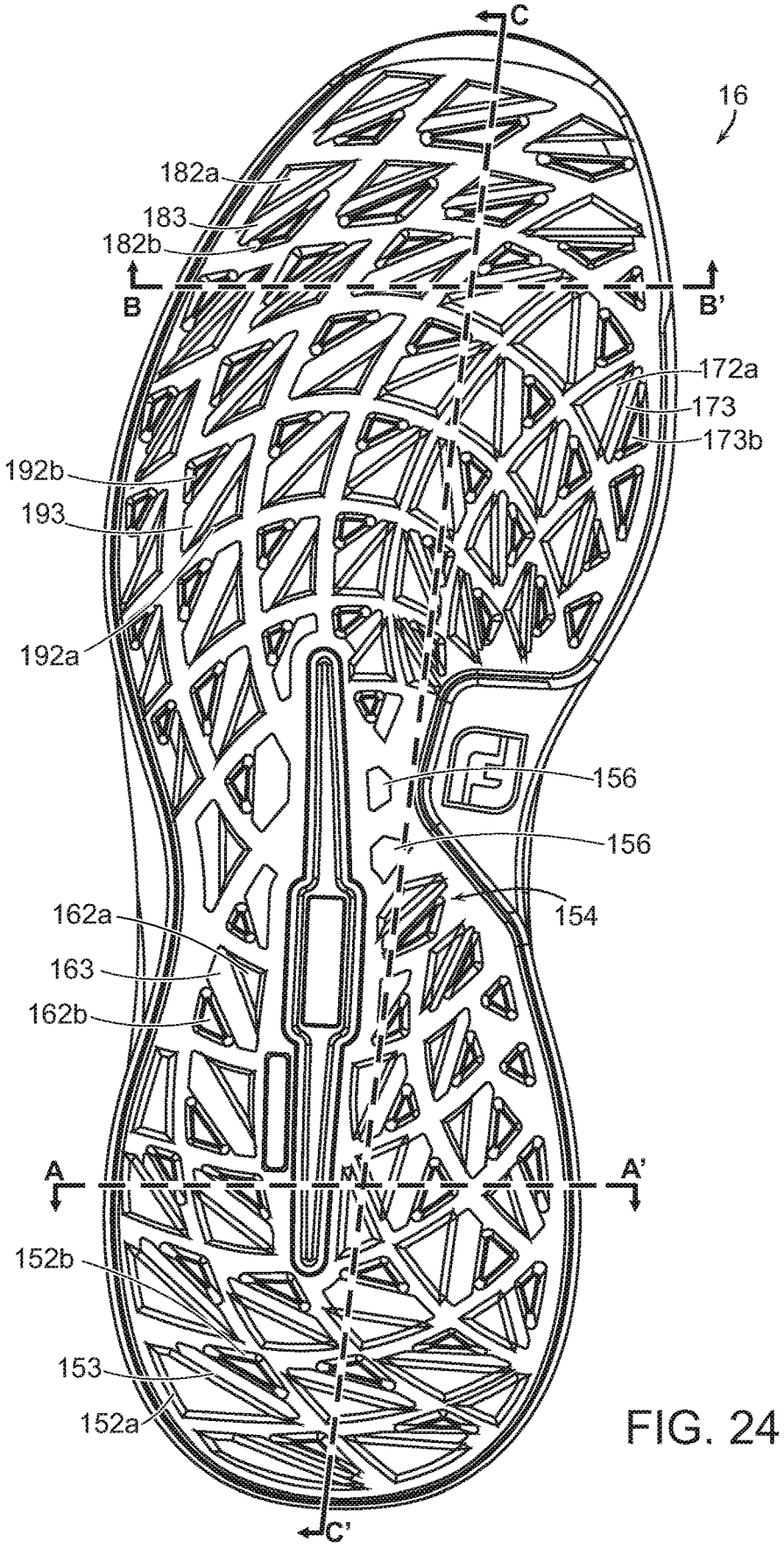
FIG. 24 is a bottom plan view of one example of an outsole of the present invention showing traction members extending along the forefoot, midfoot, and rear-foot regions.

Turning to FIG. 23, an enlarged view of the traction tile members in lateral Zone E is shown. These first and second traction members (192*b*, 192*a*) also have sloping sides (111, 112) and a triangular-shaped, non-recessed top surface (114) that forms a ground contacting surface. A flexible window (193) is disposed between the first and second traction members. In this example, the first traction members (192*b*) are relatively hard and can be made, for example, from a hard, first thermoplastic polyurethane composition with a hardness as discussed above. The second traction members (192*a*) are relatively soft and can be made, for example, from a soft, second thermoplastic polyurethane composition with a hardness as discussed above. Preferably, the total ground contact surface area is in the range of about 10 to about 70% based on total surface area of the tile.

The traction tile structures in Zone C (medial) and Zone E (lateral) are primarily used for golf-specific traction, that is, these traction members help control forefoot lateral and medial traction, and prevent the foot from slipping during a golf shot. As discussed above, significant pressure is applied to the exterior of the foot at various stages in the golf shot swing. In the present invention, the Zones C and E of the outsole (16) are designed to provide support and stability to the sides of the foot. In particular, as the golfer follows through with their swing (downswing) and drives the ball, their weight is transferred from the back (driving) foot to the front (stabilizing) foot. During the swinging motion, there is some pivoting at the back and front feet, but this pivoting motion must be controlled. The Zones C and E help hold and support the lateral and medial sides of the golfer's foot as he/she shift their weight when making a shot. Thus, the golfer has better stability and balance in all phases of the game. The traction members in Zones C and E have vertical sidewalls that help manage strong horizontal forces applied against the outsole during the golf swing resulting in more resistance/traction, particularly during a golf downswing. The traction members in Zones A and F, which are located in the Rear-Foot Region and discussed in detail above, also help stabilize the foot stabilize the foot against this pressure, thus providing more resistance/traction during the golf swing.

At the same time, the Zones D, E, and C in the Forefoot Region have good active phase thrust generation, so the golfer is better able to push-off their foot. These features help the golfer with playing performance and walking the course. The golfer is able to engage in golf-specific activities comfortably and naturally. All of these different traction members in the outsole help impart a high level of stability and traction as well as high flexibility to the golf shoe of this invention. The unique geometry and structure of the upper (12), midsole (14), and outsole (16) including the traction members provides the golfer with a shoe having many beneficial properties.

Figure 27:
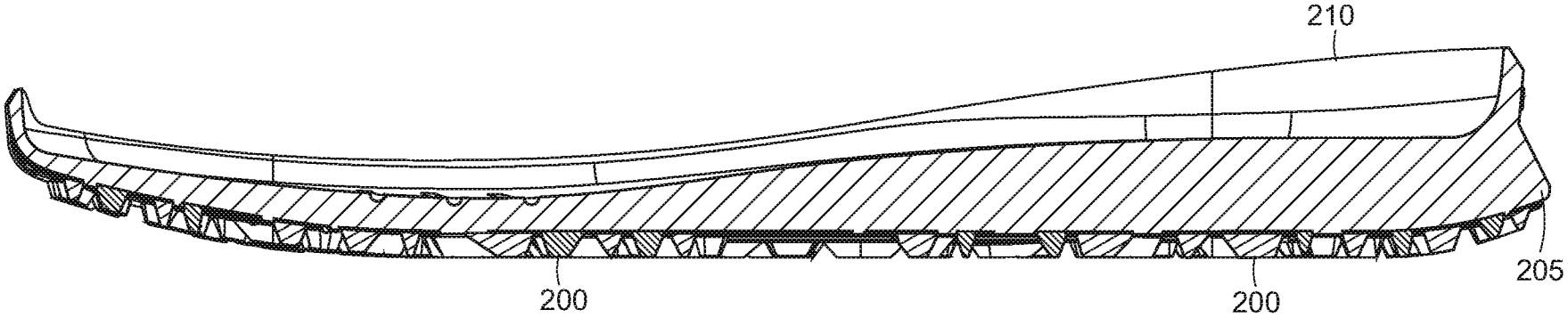
FIG. 27 is a cross-sectional view of the outsole in FIG. 24 along Line C-C'.

Turning to FIGS. 24-27, the outsole (16) and midsole (14) structures are shown in more detail. As discussed above, the outsole (16) is designed to provide stability and traction for the shoe. The bottom surface of the outsole (16) includes multiple traction members, generally indicated at (200) in FIGS. 25-27, to help provide traction between the shoe and grass on the course. The bottom surface of the outsole (16) and traction members (200) can be made of any suitable material such as rubber or plastics and combinations thereof as discussed above. The midsole (14) is relatively lightweight and provides cushioning to the shoe. The midsole (14) can be made from midsole materials such as, for example, foamed ethylene vinyl acetate copolymer (EVA) or foamed polyurethane compositions. In one preferred embodiment, the midsole (14) is constructed using a foam blend composition of ethylene vinyl acetate (EVA) and polyolefin as further described below. Commercially-available foam blend compositions such as, for example, Engage® PO-EVA, available from the Dow Chemical Company can be used. Different foaming additives and catalysts are used to produce the EVA foam. The EVA blend foam compositions have various properties making them particularly suitable for constructing midsoles including good cushioning and shock absorption; high water and moisture-resistance; and long-term durability. In FIGS. 25-27, the midsole (14) is shown having a lower region (205) and upper region (210). These lower and upper regions (205, 210) can be made of the same or different materials. For example, one region can be made of a relatively hard foamed EVA composition; and the other region can be made of a relatively soft foamed EVA composition. The lower region (205) forms the sidewalls of the midsole, and these firm, strong sidewalls help hold and support the medial and lateral sides of the golfer's foot as they shift their weight when making a golf shot. In this embodiment of the invention, the outsole structure (16) is a dual-grid structure comprising relatively hard traction members and relatively soft traction members as discussed further below.

Figure 28:
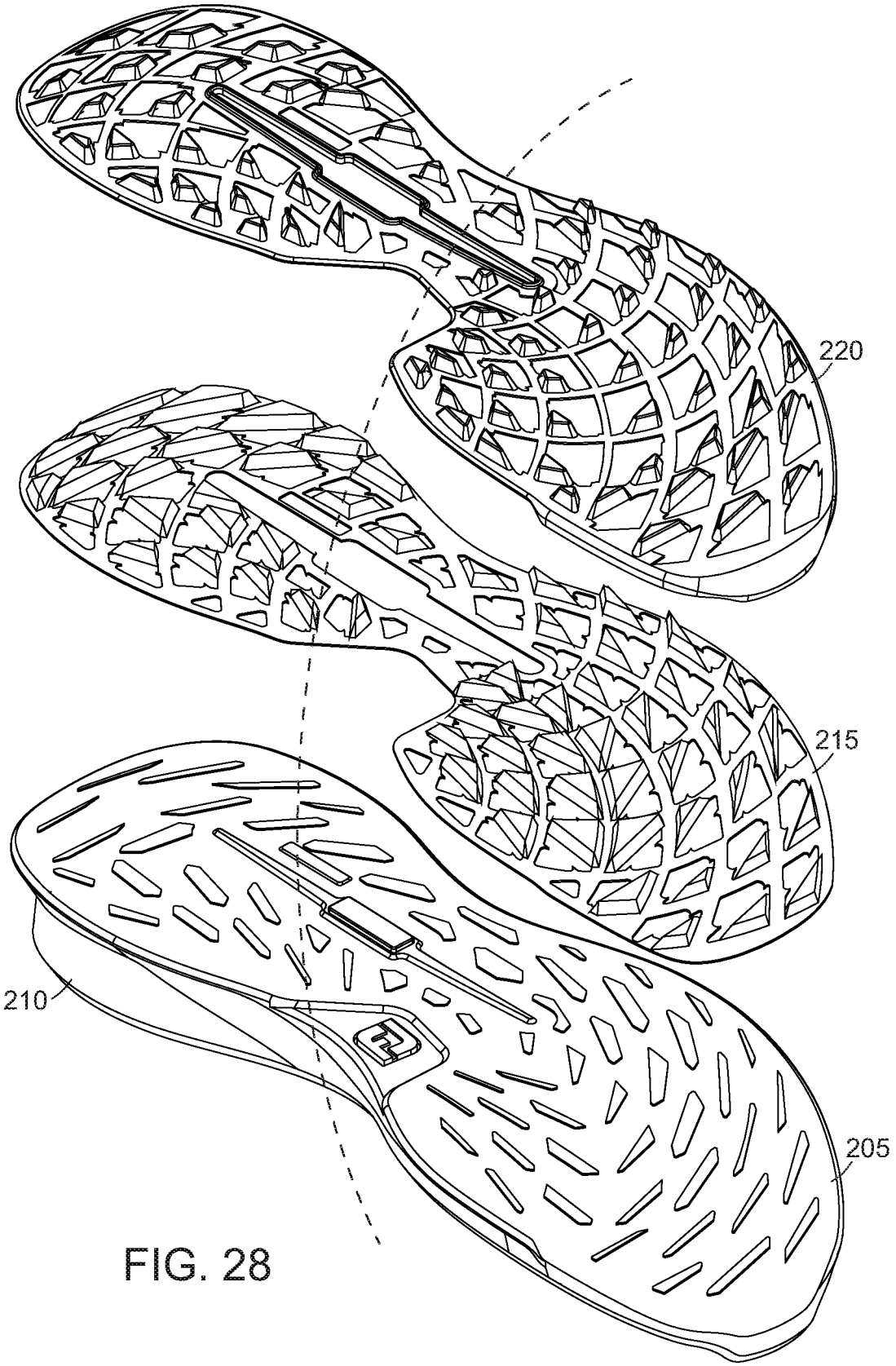
FIG. 28 is an exploded view of one example of a midsole and outsole of the golf shoe of the present invention showing the different components of the midsole and outsole.

More particularly, referring to FIG. 28 the outsole section containing the hard, thermoplastic polyurethane traction members (220); outsole section containing the soft thermoplastic polyurethane traction members (215); and the midsole section (205) are shown in an exploded view. In one manufacturing process, the midsole (14) can be molded as a separate piece and then joined to the top surface of the outsole by stitching, adhesives, or other suitable means using standard techniques known in the art. For example, the midsole (14) can be heat-pressed and bonded to the top surface of the outsole (16). The outsole can be molded using a 'two-shot' mold, wherein the hard, thermoplastic polyurethane (TPU) used to make the outsole section containing the hard, thermoplastic polyurethane traction members is injected into the mold first; and the soft thermoplastic polyurethane (TPU) used to make the outsole section containing the soft traction members is injected into the mold secondly. In one embodiment, the harder thermoplastic polyurethane is molded over the softer thermoplastic polyurethane to provide a U-shaped beam-like structure having high structural capacity. The harder thermoplastic polyurethane provides a protective shell around the softer thermoplastic polyurethane. This dual-grid structure of the outsole helps provide high structural support and mechanical strength. The dual-grid structure has high structural rigidity an yet it does not sacrifice flexibility as discussed further below.

Figure 32:
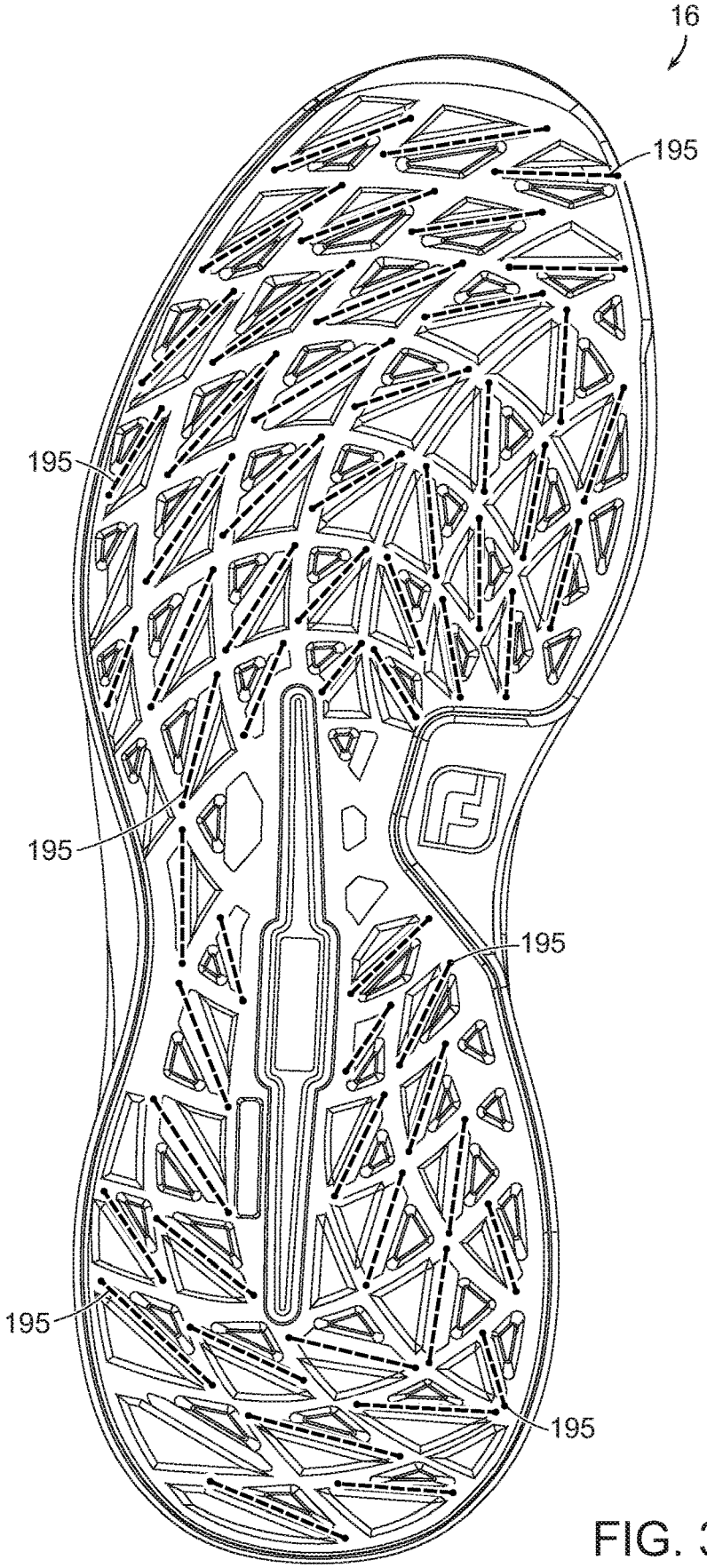
FIG. 32 is a bottom plan view of one example of an outsole of the present invention showing traction members extending along the forefoot, midfoot, and rear-foot regions with the flex points shown in detail.

Turning to FIGS. 29 and 30, the traction tile segment (220) comprises a first protruding traction member; an opposing second protruding traction member; and a non-protruding, level base segment (window) disposed between the first and second traction members. The first traction member (162*b*) is relatively hard and the second traction member (162*a*) is relatively soft. The open window (163) provides a flex point in between the two traction members. As shown in FIG. 32, these flex points (195) are oriented in various directions across the dual-grid structure. The flex points (195) have different axes and this provides a three-hundred and sixty-degree (360°) flex feel to the dual-grid structure. The flex points (195) form discrete flex zones throughout the outsole; as a result, the outsole (16) is able to flex slightly in multiple directions as opposed to many traditional shoes that flex only in a single direction. The outsole (16) of this invention does not have hinge points, wherein major sections of the outsole flex; rather, the outsole has many minor flex points oriented at many different angles. Thus, the outsole (16) provides a three-hundred and sixty-degree (360°) flex feel to the person wearing the shoes. The outsole of this invention provides an optimum combination of structural rigidity and flexibility.

As shown in FIGS. 29 and 30, the first traction members (162*b*) have sidewalls with sloping surfaces and a triangular-shaped, non-recessed top surface that forms a ground contacting surface. The second traction members (162*a*) can also have sidewalls with sloping surfaces and a larger sized triangular-shaped, non-recessed top surface than the first. The flat surface helps provide a relatively high Horizontal Contact Area Ratio (HCAR) and the sidewalls help provide a relatively high Vertical Contact Area Ratio (VCAR).

Figure 33A:
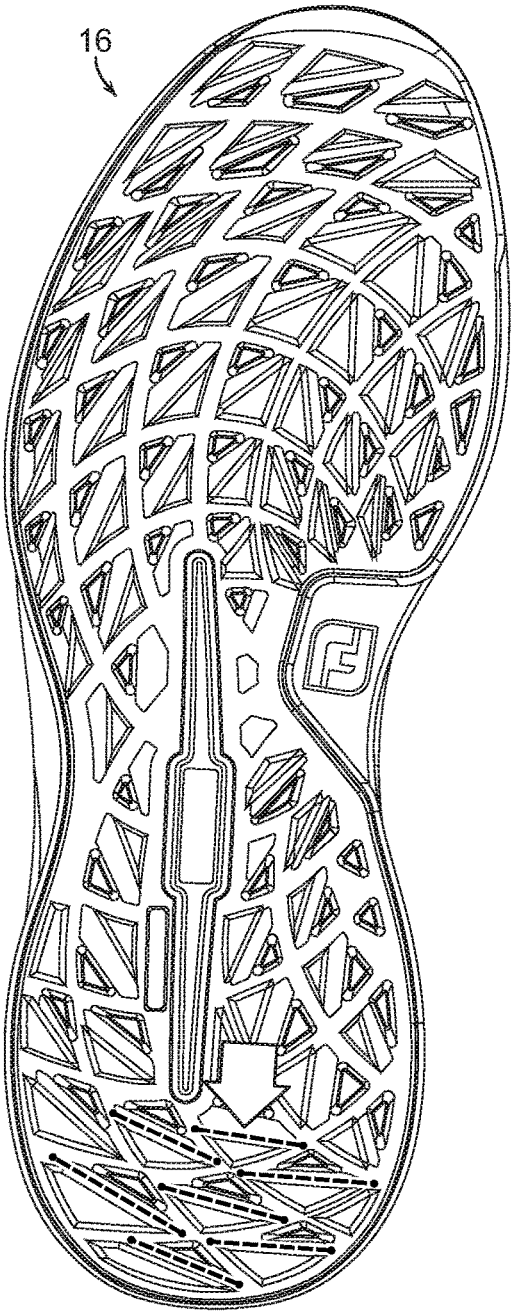
FIG. 33A is a schematic diagram of one example of the outsole of this invention showing horizontal sidewalls of selected traction members in Zone G in detail.
Figure 33B:
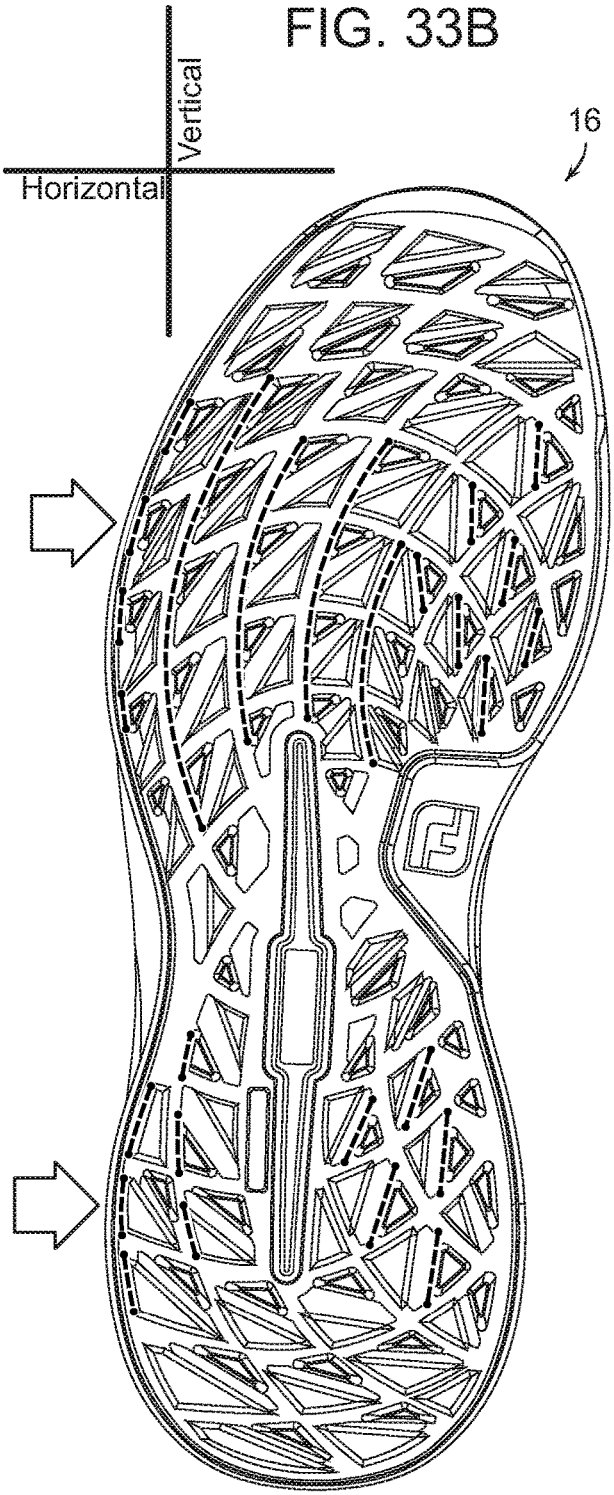
FIG. 33B is a schematic diagram of one example of the outsole of this invention showing vertical sidewalls of selected traction members in Zones A, C, E, and F in detail.
Figure 33C:
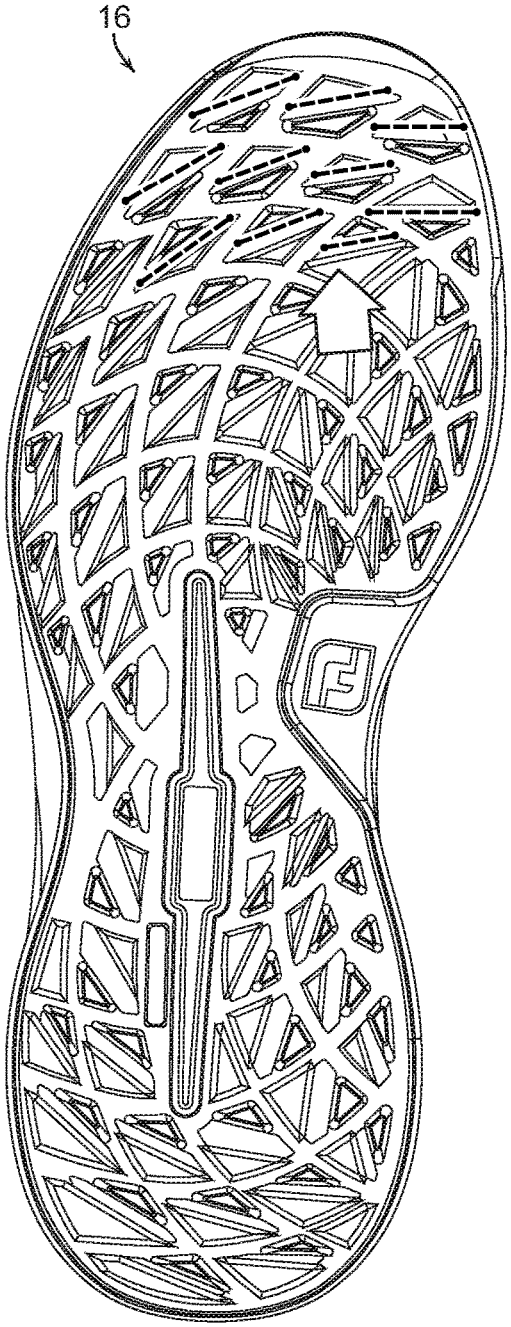
FIG. 33C is a schematic diagram of one example of the outsole of this invention showing horizontal sidewalls of selected traction members in Zone D in detail.
Figure 33D:
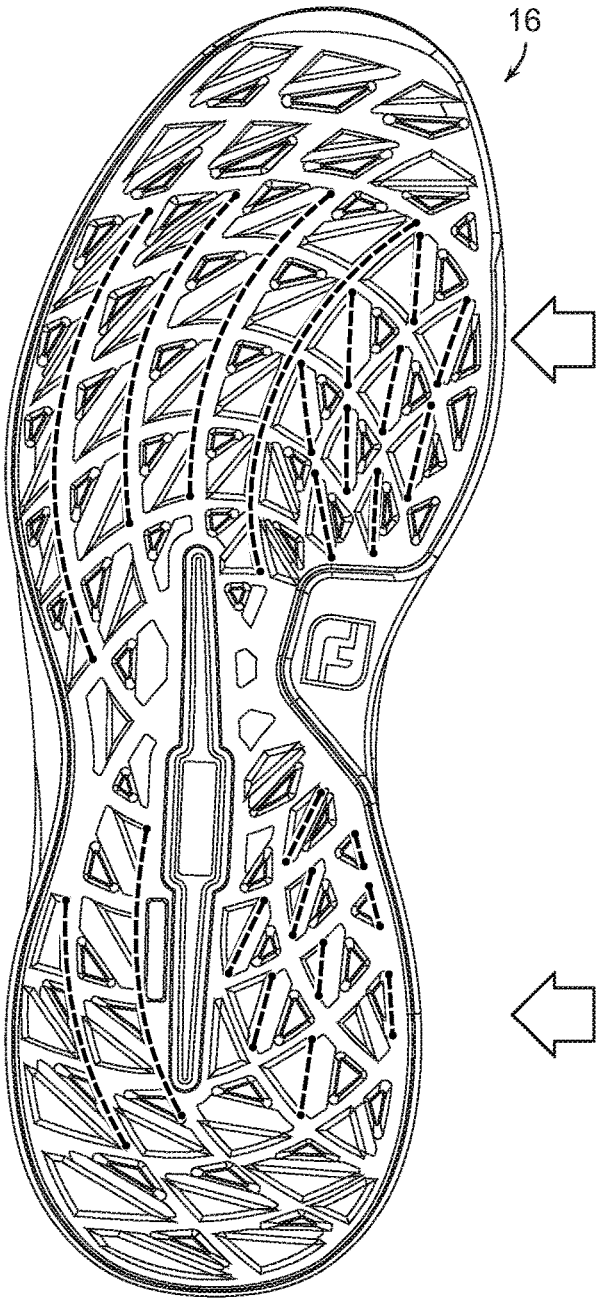
FIG. 33D is a schematic diagram of one example of the outsole of this invention showing vertical sidewalls of other traction members in Zones A, C, E, and F in detail.

Referring to FIGS. 33A, 33B, 33C, and 33D, the horizontal and vertical sidewalls of the traction members in the outsole (16) also provide other benefits for the traction members in the different regions. For example, as shown in FIG. 33A, in Zone G (crash-pad) of the heel area, the horizontal sidewalls of the traction members help prevent the golfer from slipping when he/she is walking downwardly on a golf slope or simply walking on or off-course. In FIG. 33B, the vertical sidewalls in Zones A, C, E, and F also help stabilize the foot against the significant horizontal pressure and forces that are exerted against the foot (shown by directional arrows in FIG. 33B), particularly during the golf backswing (upswing). In FIG. 33C, the horizontal sidewalls in Zone D helps provide good traction and prevent slipping, particularly when a golfer is walking upwardly on a golf slope or simply walking on or off-course. A golfer wearing the shoe can comfortably walk and play the course. The shoe (10) has high forefoot flexibility, and yet it does not sacrifice stability, traction, and other important properties. Lastly, referring to FIG. 33D, the opposing vertical sidewalls in Zones A, C, E, and F help stabilize the foot against the significant horizontal pressure and forces that are exerted against the foot (shown by directional arrows in FIG. 33D), particularly during the golf downswing. Zones A, C, E, and F are golf-specific Zones that provide support and stability to the sides of the foot so the golfer does not slip during the golf swing. The golfer needs a stable platform so that he/she can maintain their balance as they perform their swinging action. At the same time, a golfer wearing the shoe can comfortably walk and play the course. The shoe is lightweight and comfortable so it can be worn easily while walking and in other activities. A person can easily and comfortably wear the shoe away from the golf course. The shoe has high flexibility, and yet it does not sacrifice stability, traction, and other important properties. As discussed above, the Horizontal Contact Area Ration (HCAR) is optimized in specific outsole traction zones for walking on hard, flat surfaces, particularly "off-course" surfaces such as boat decks, polished concrete and marble flooring, painted surfaces of sidewalks, and the like. In the remaining outsole traction zones, the HCAR is managed and tuned so that a maximum VCAR (Vertical Contact Area Ratio) can be reached for a given HCAR.

The shoe of this invention has an optimum combination of structural rigidity and flexibility. The unique geometry, materials, and structure of the upper (12), midsole (14), and outsole (16) including the traction members provides the golfer with a multi-surface (MST) shoe. The shoes of this invention achieve high traction on firm and particularly hard, wet, and smooth "off-course" surfaces. The shoes also provide high traction on various natural turf surfaces, particularly golf courses or "on-course" surfaces.

Heeled Outsole

Figure 34:
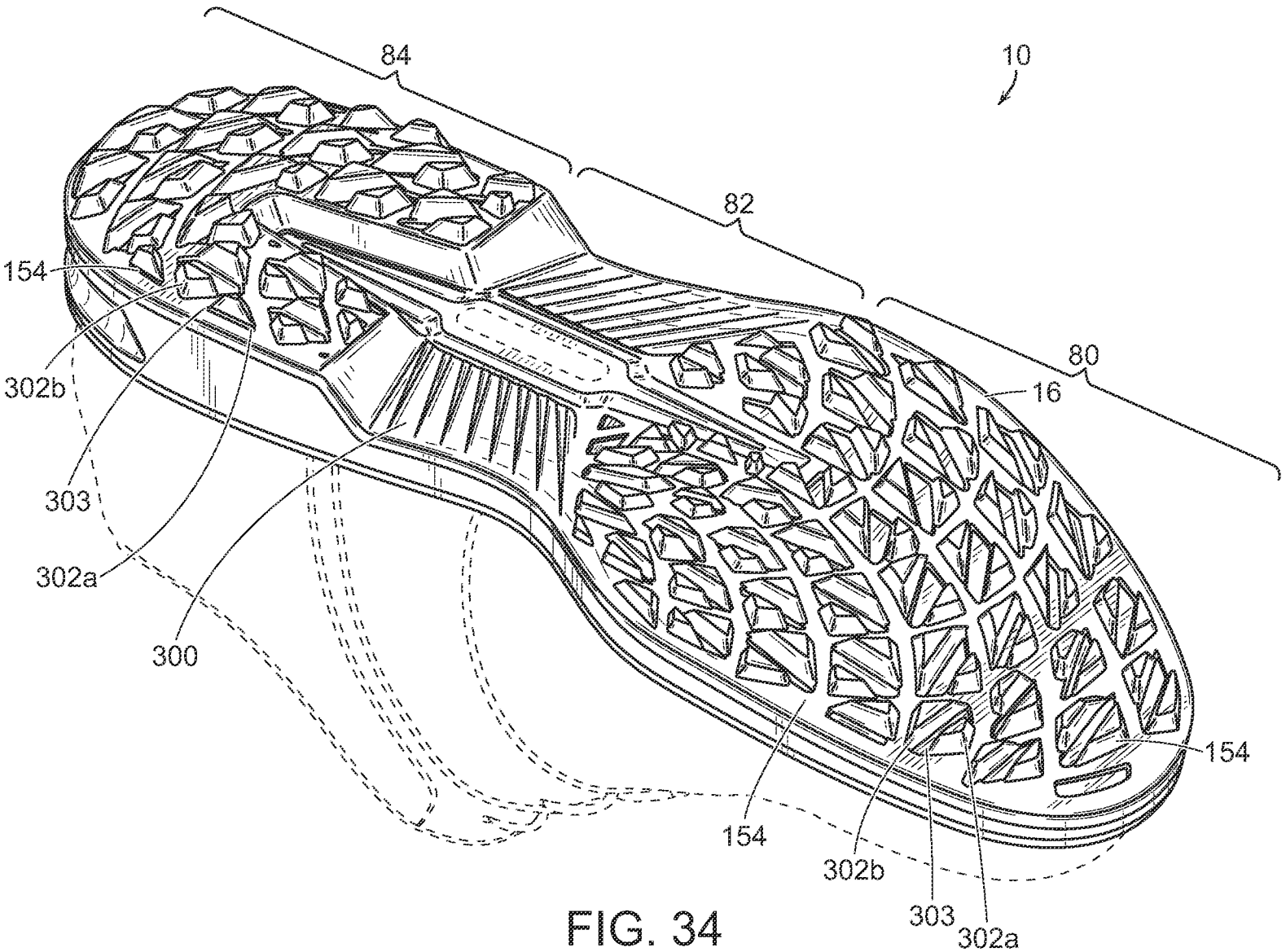
FIG. 34 is a perspective view of one embodiment of a golf shoe of the present invention showing the outsole in detail.
Figure 35:
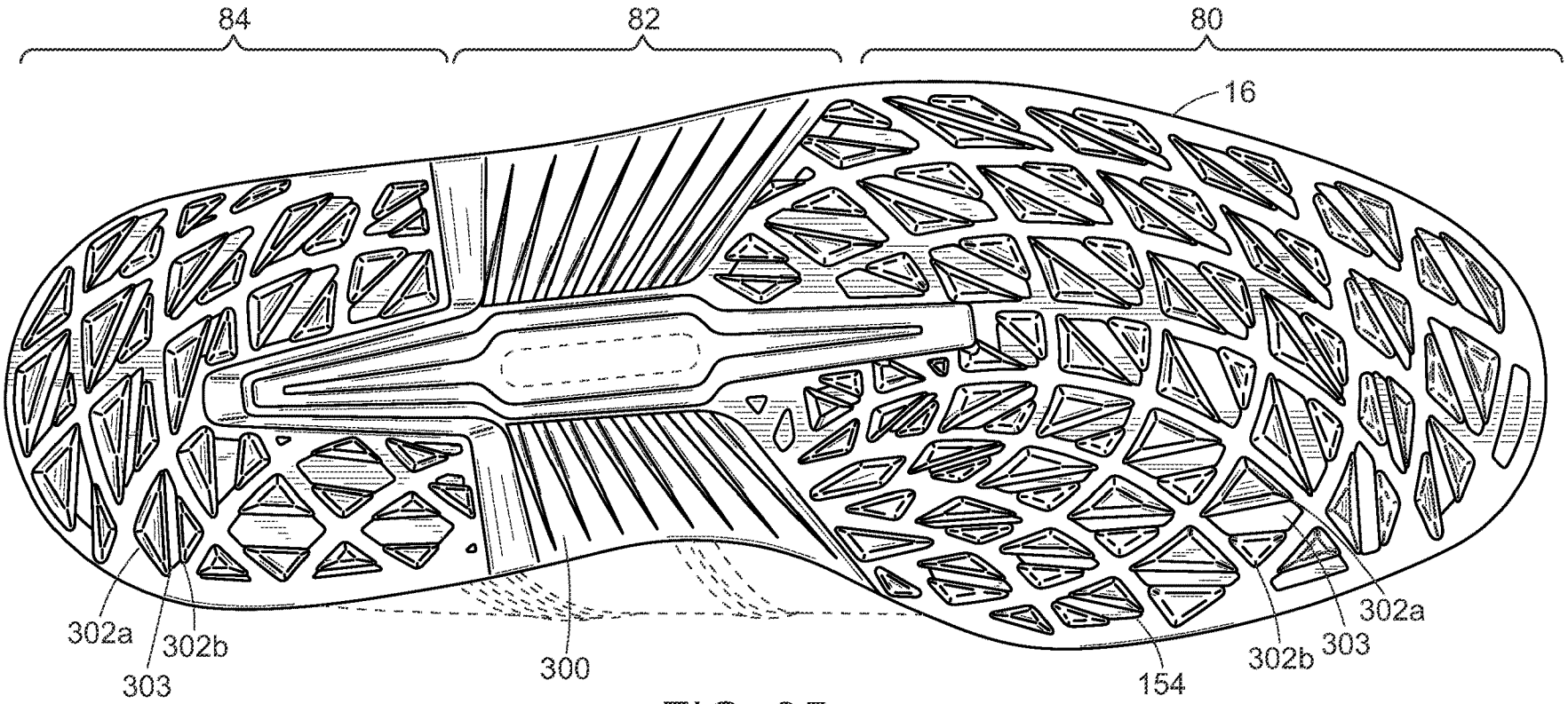
FIG. 35 is a bottom plan view of the embodiment of the outsole of FIG. 34 of the present invention.
Figure 36:
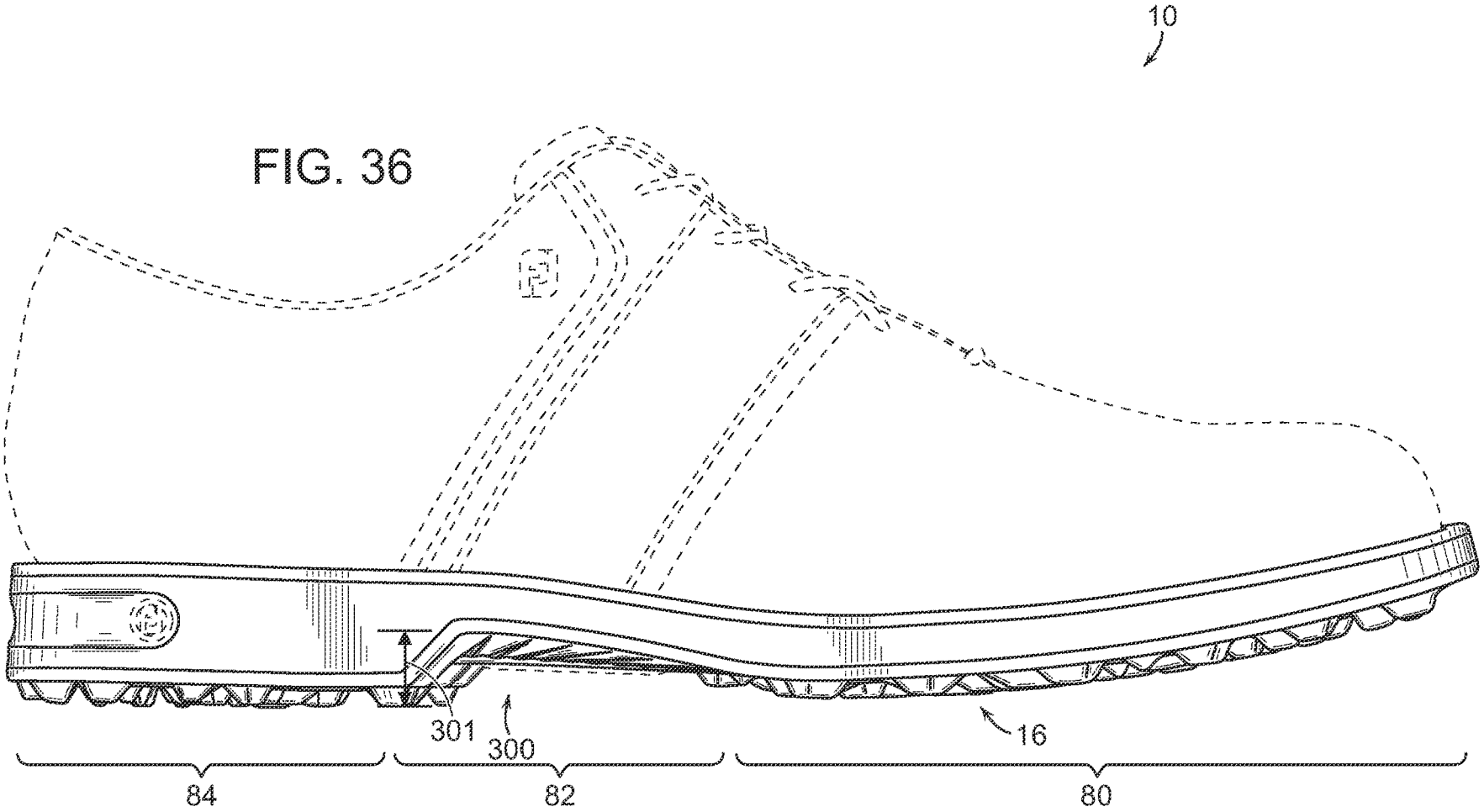
FIG. 36 is a medial side view of the embodiment of a golf shoe of FIG. 34 of the present invention.

Now referring to FIGS. 34-36, as described above the outsole (16) generally includes a forefoot region (80) for supporting the forefoot area; a mid-foot region (82) for supporting the mid-foot including the arch area; and rearward region (84) for supporting the rear-foot including heel area. In general, the forefoot region (80) includes portions of the outsole corresponding with the toes and the joints connecting the metatarsals with the phalanges. The mid-foot region (82) generally includes portions of the outsole corresponding with the arch area of the foot. The rear-foot region (84) generally includes portions of the outsole corresponding with rear portions of the foot, including the calcaneus. The forefoot region (80) and rearward region (84) include the tile structures (154) as previously described, while the mid-foot region incorporates a heel step region (300). The tile structures (154) shown in FIGS. 34-36 are provided as described with regard to FIGS. 18-33D. It will be appreciated that alternatively the traction members may also be provided as previously described and shown in FIGS. 1-17. In the embodiment shown in FIGS. 34-36, heel step region (300) is provided extending from the forefoot region (80) through the mid-foot region (82) to the rearward region (84) sloping upward and away from the outermost portion of the tile structures (154) where they contact the ground. As is known in the art the heel step region (300) generally slopes to a maximum height (301) of about 5 mm to about 20 mm, preferably 8-17 mm. It will be appreciated that the heel step region (300) does not come into contact with the ground and does have any tile structures (154). Typically, this heel step region (300) is provided on golf shoes having a more traditional classic dress design for the upper.

In the embodiment of FIGS. 34-37, the tile structures (154) located on the outsole (16) comprise a first protruding traction member (302*b*); an opposing second protruding traction member (302*a*); and a non-protruding, base segment (window) (303) disposed between the first and second traction members (302*b*, 302*a*). As described previously, the traction members of this embodiment can have various sizes, shapes, and/or material properties. In this embodiment, preferably the first traction members (302*b*) can be made from a relatively hard, first thermoplastic polyurethane composition having a hardness of greater than 80 Shore A; and the second traction members (302*a*) can be made from a relatively soft, second thermoplastic polyurethane composition having a hardness of 80 Shore A or less. Such first and second traction members (302*b*, 302*a*) can be made from commercially-available polyurethane compositions such as, for example, Estane® TRX thermoplastic polyurethanes, available from the Lubrizol Corporation. Moreover, as described previously, the traction members (302*b*, 302*a*) also can have various dimensions. In this embodiment, the lengths (heights) of the relatively hard traction members (302*b*) and lengths (heights) of the relatively soft traction members (302*a*) are substantially the same. For example, the heights of the relatively hard and soft traction members can be in the range of about 2 mm to about 6 mm. Preferably, the heights of the relatively hard and soft traction members are in the range of about 2.5 mm to about 4.5 mm.

Heeled Outsole with Spikes

Figure 37:
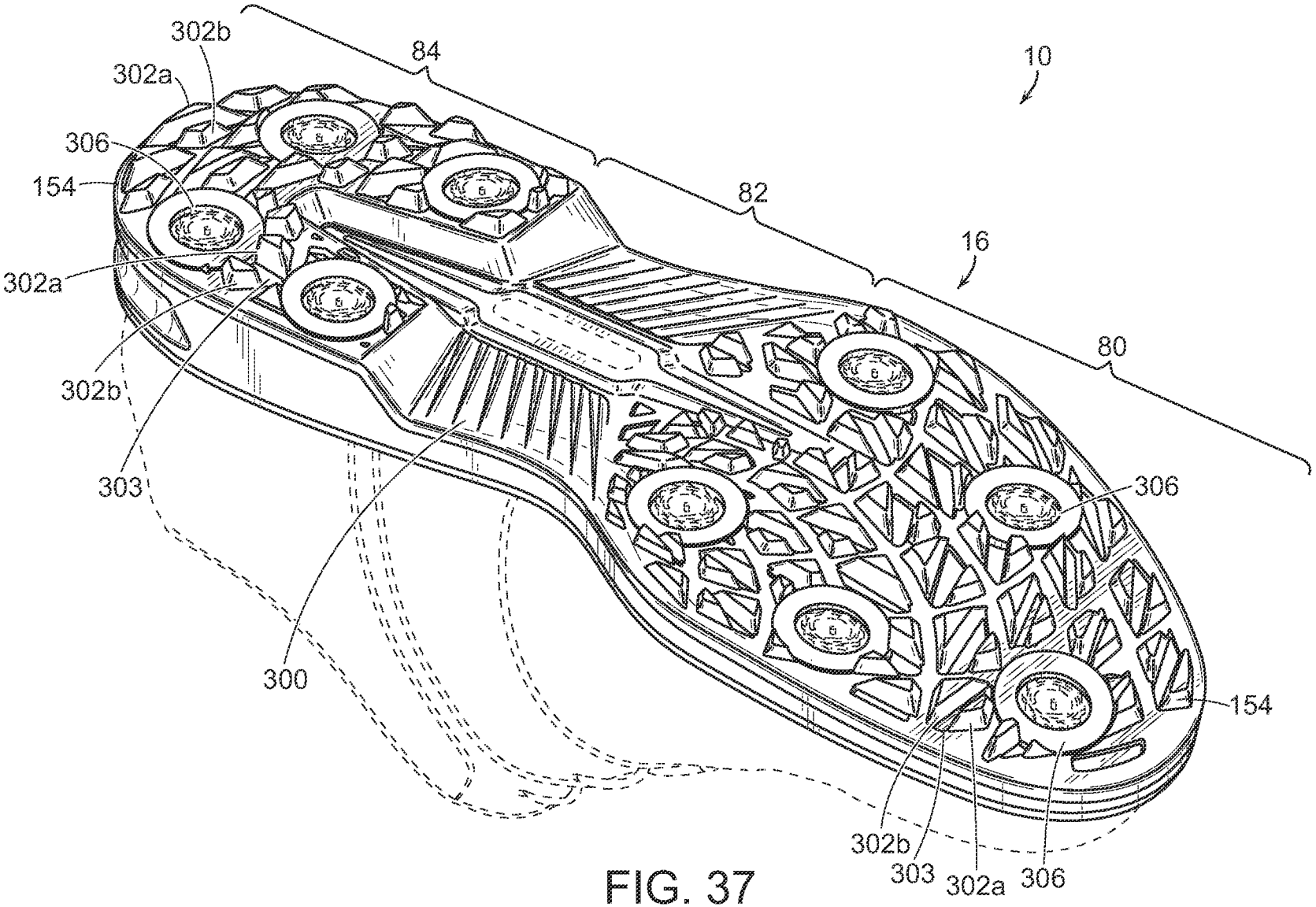
FIG. 37 is a perspective view of one embodiment of a golf shoe of the present invention showing the outsole in detail with spike receptacles.
Figure 38:
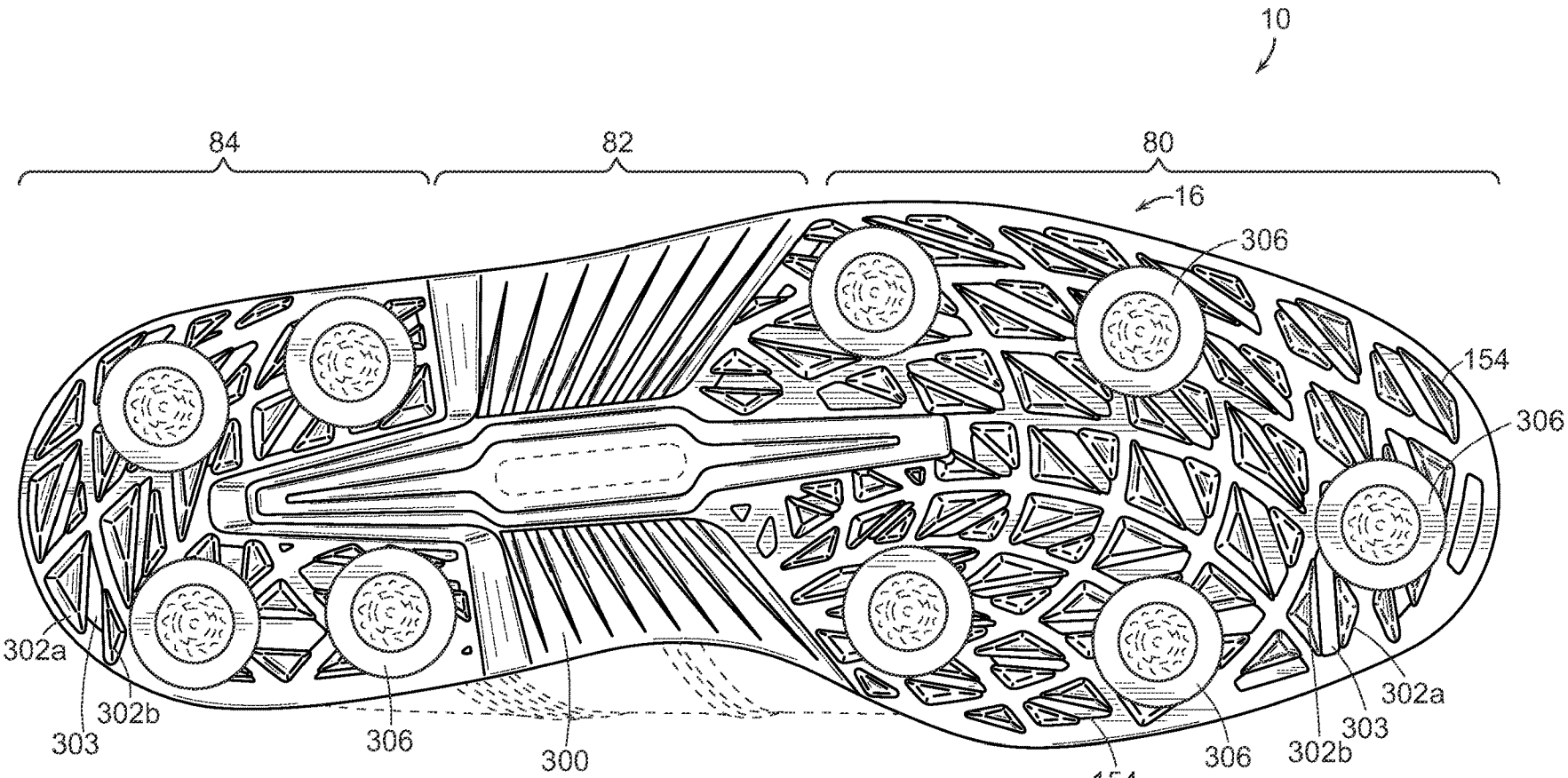
FIG. 38 is a bottom plan view of the embodiment of the outsole of FIG. 37 of the present invention with spike receptacles.
Figure 39:
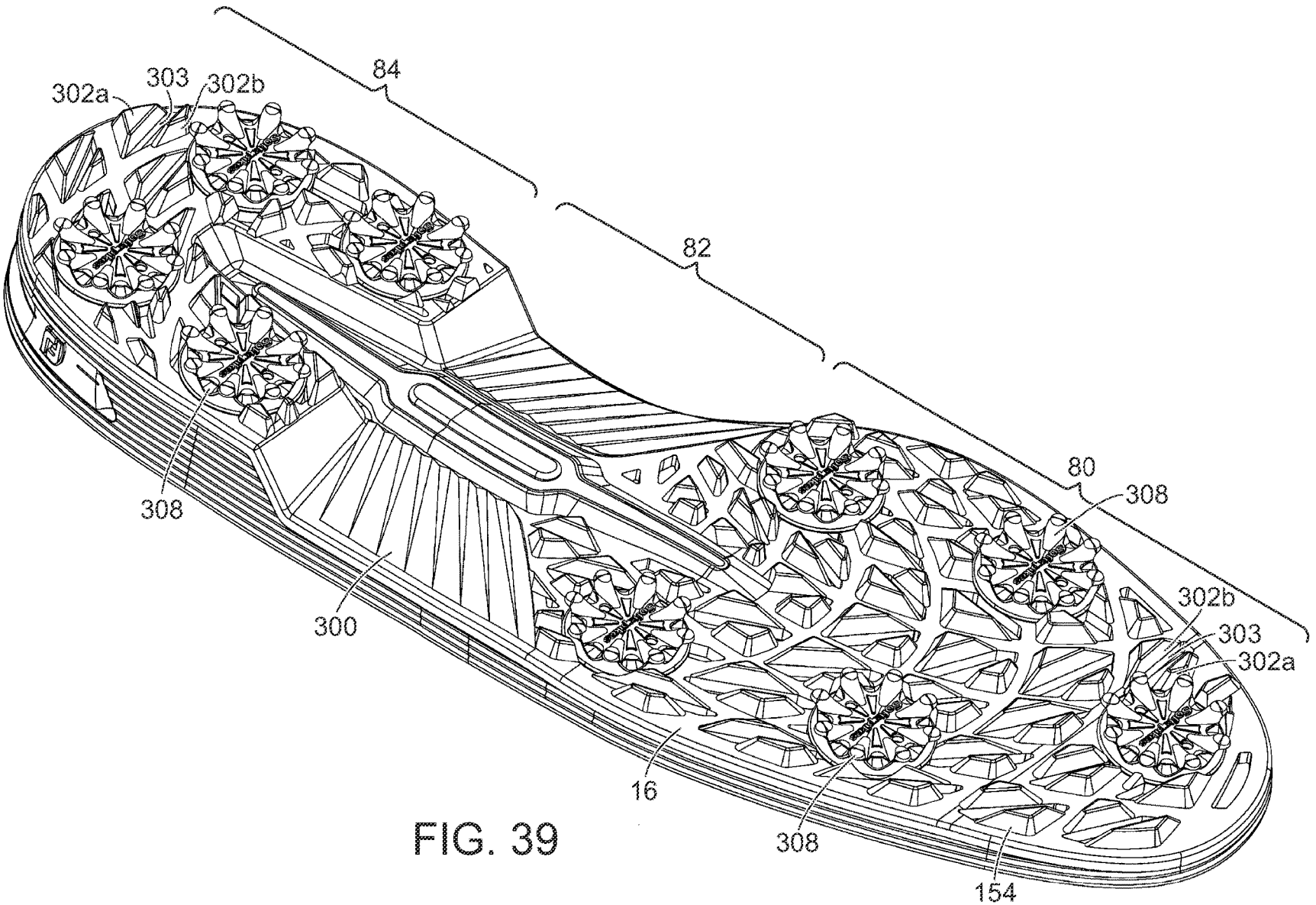
FIG. 39 is a perspective view of the embodiment of FIG. 37 of the present invention showing the outsole in detail with spikes secured in the spike receptacles.
Figure 41:
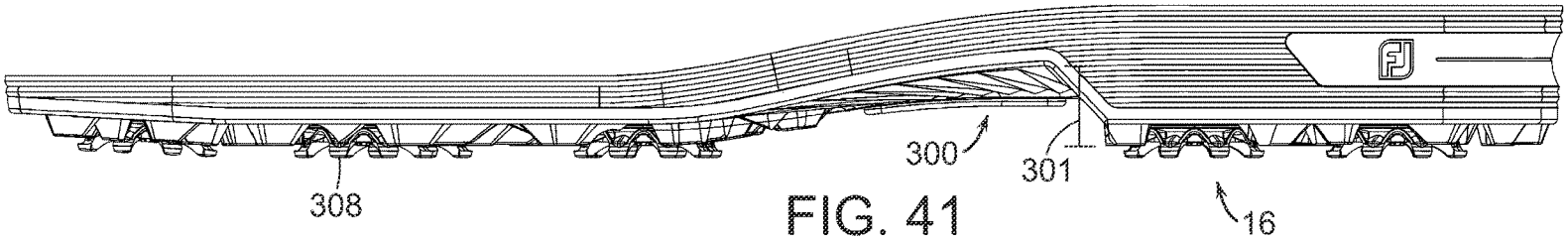
FIG. 41 is a medial side view of the embodiment of a golf shoe of FIG. 39 of the present invention.
Figure 40:
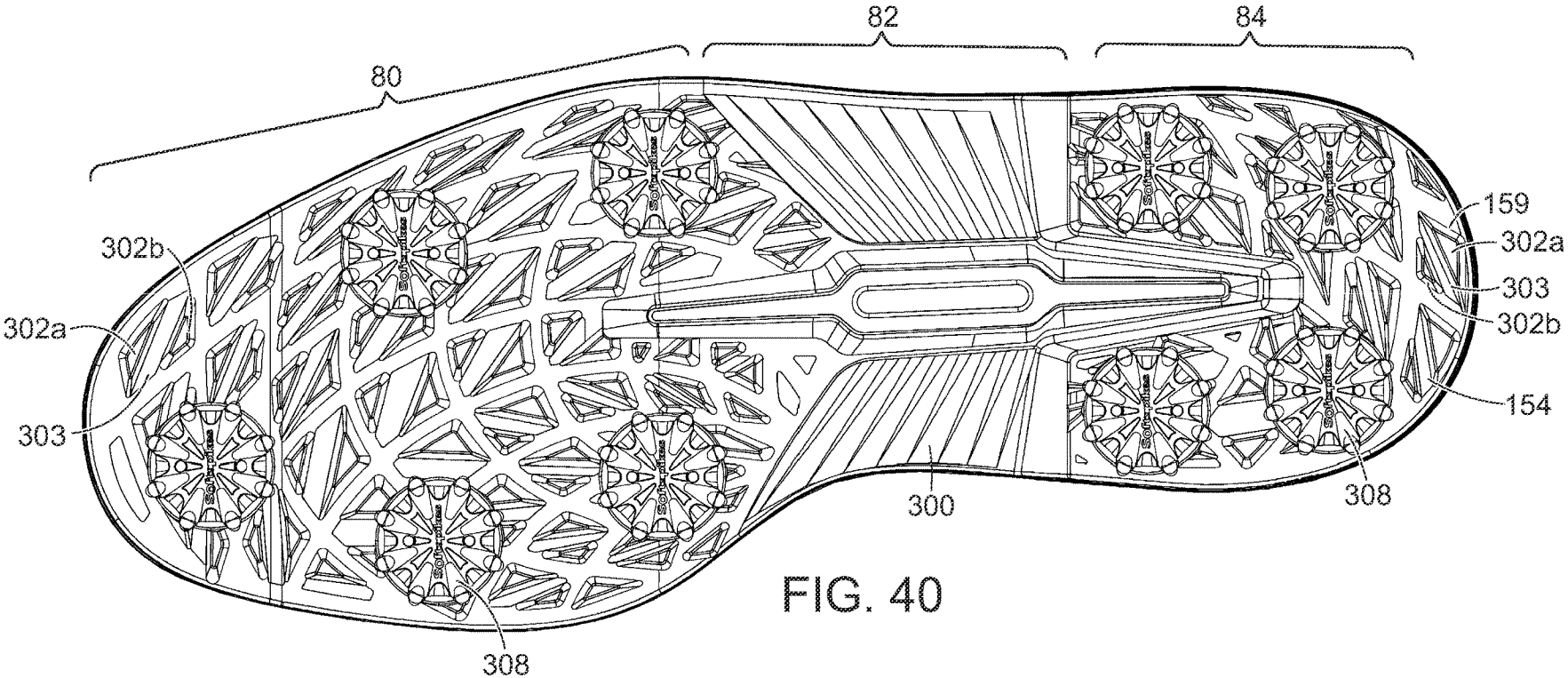
FIG. 40 is a bottom plan view of the embodiment of the outsole of FIG. 39 of the present invention.

Now referring to FIGS. 37-42C, the embodiment shown in FIGS. 34-36 has outsole (16) incorporating spike receptacles (306) for receiving spikes (308). FIGS. 37 and 38 show placement of the spike receptacles (306) on the outsole (16). Generally, five spike receptacles (306) are placed in the forefoot region (80) and four spike receptacles (306) are place in the rear-foot foot region (84). However, it will be appreciated that any number or placement of spike receptacles (306) may be used. The spike receptacles (306) are molded and attached to the outsole (16). The spikes (308) may be secured to and removed easily from the outsole (16). As is known in the art, the spikes (308) may be secured in the spike receptacle (306) by inserting and slight twisting in a clockwise direction and removed with slight twisting in a counter-clockwise direction. Now referring to FIGS. 39-41, spikes (308) are shown secured in the spike receptacles (306) provided in the outsole (16). It will be appreciated that any spikes that may be suitable for use in golf could be attached to the spike receptacles. Typically, the spike (308) will have a rounded base (310) with radial arms (312) having traction projections (314) that contact the ground surface.

Figure 42A:
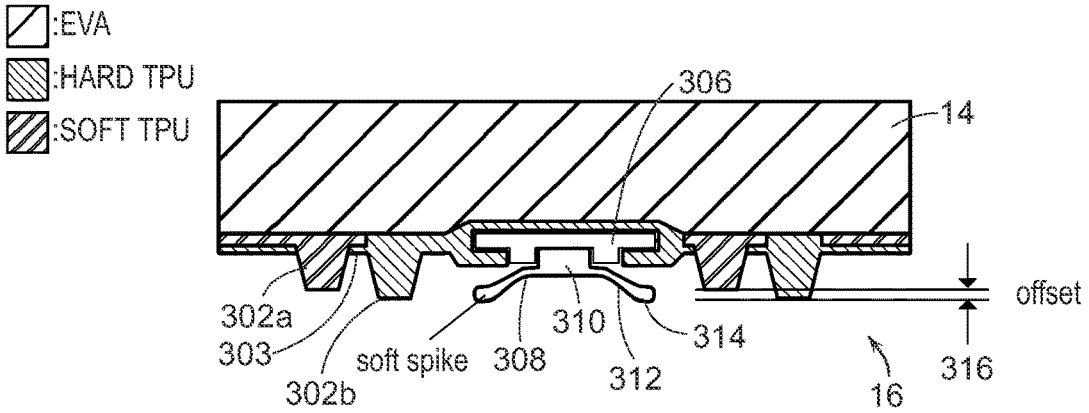
FIGS. 42A-42C are partial cross-sectional views through a spike receptacle and part of the outsole of FIGS. 39-41 showing a spike and multi-surface traction members both without a load and with a load.
Figure 42B:
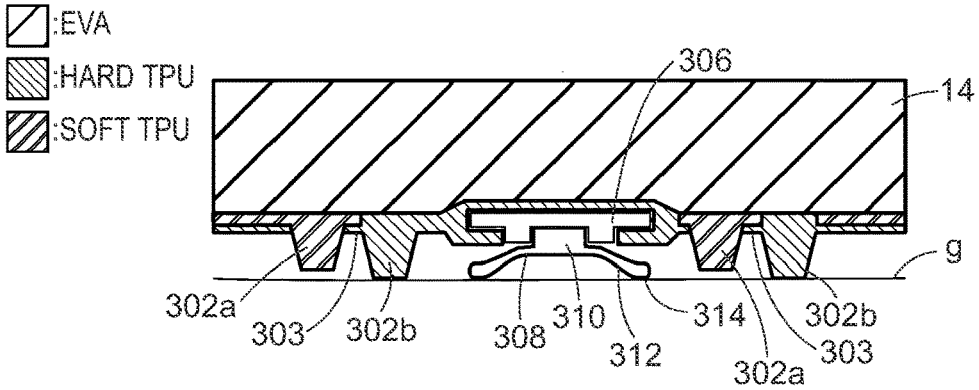
Figure 42C:
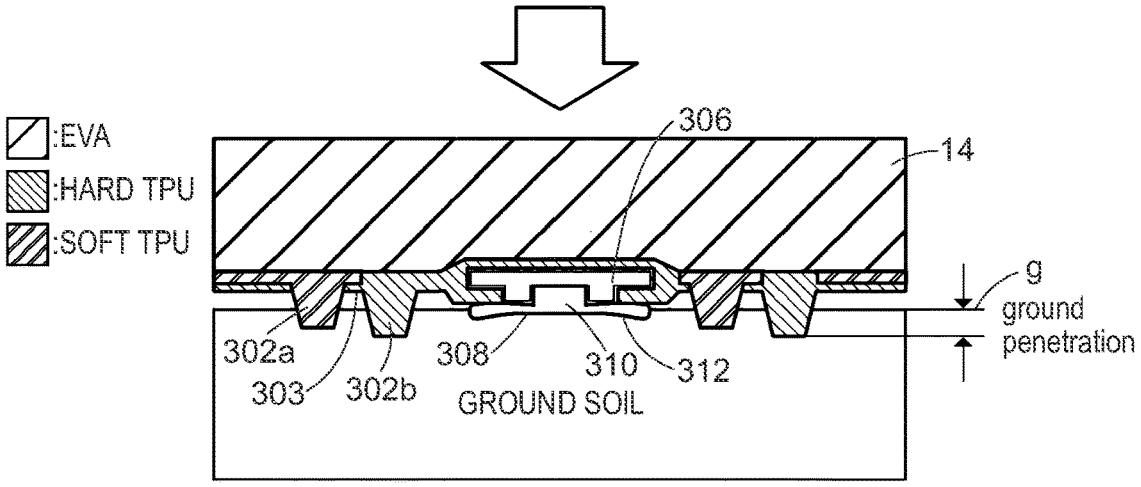

Now referring to FIGS. 42A-42C, the placement of the spikes (308) relative to the tile structure (154), specifically hard traction members (302*b*) and soft traction members (302*a*) and base segment (303) is shown. FIG. 42A shows the midsole (14) and outsole (16) with the tile structure (154) and spike (308) without any load placed on them by a golfer. As shown, the heights of the relatively hard traction members (302*b*) are greater than the heights of the relatively soft traction members (302*a*) by offset (316). For example, the heights of the relatively hard traction members (302*b*) can be in the range of about 2 mm to about 6 mm; and the heights of the relatively soft traction members (302*a*) can be in the range of about 1.75 mm to about 5.75 mm. Preferably, the offset (316) between traction member heights is in the range of about 0 mm to about 6 mm. More preferably, the offset (316) between the heights of the hard and soft traction members is about 0.25 mm to 1 mm. FIG. 42B shows the outsole (16) with the tile structure (154) and spike (308) relative to the ground (g) without any load or pressure placed on them. FIG. 42C shows the outsole (16) with the tile structure (154) and spike (308) relative to the ground (g) with a load placed on the outsole, such as when a golfer places their weight on the outsole (16). When a load is applied to the outsole (16) the spike (308) flexes and expands outwardly, allowing the radial arms (312) to move outwardly and upwardly. At the same time, the harder traction members (302*b*) penetrate the ground (g) further than the softer traction members (302*a*) or spikes (308). In this manner, the firm traction members (302*b*) contact the ground and penetrate the grass and soil more easily. Meanwhile, the relatively soft traction members (302*a*) contact the ground, compress more easily, and help provide some flexibility to the shoe. Thus, this outsole structure combining both tile structures (154) and spikes (308) is particularly effective for on-course use.

Golf Course Turf Grasses

One problem with conventional golf shoes is they can cause damage to the grasses on golf courses, particularly putting greens. There are many different turf grasses that are used over the golf course depending upon the course area, for example, the tee box, fairway, rough, or putting green. Also, different grasses are used based on factors such as geographic region, climate, availability of water and irrigation systems, and soil type. For example, many Northern golf courses use Bentgrass and many Southern golf courses used Bermuda grass on putting greens. Some older courses use ryegrass or poa anna (annual bluegrass) on the greens. All of the turf grasses are generally tough and can withstand some foot traffic; however, some conventional golf shoes are more likely to damage the turf grasses on golf courses. Damage to putting greens is a particular problem.

In general, golf shoe spikes can be made of a metal or plastic material. However, one problem with metal spikes is they are normally elongated pieces with a sharp point extending downwardly that can sharply break through the ground surface tear apart the turf grass. These metal spikes can leave spike holes or other marks on putting greens. These metal spikes also can cause damage to other ground surfaces at a golf course, for example, the carpeting and flooring in a clubhouse. Today, most golf courses require that golfers use non-metal spikes. Plastic spikes normally have a rounded base and a central stud on one face. On the other face of the rounded base, there are radial arms with traction projections for contacting the ground surface. Screw threads are spaced about the stud on the spike for inserting into a threaded receptacle on the outsole of the shoe. These plastic spikes, which can be easily fastened and later removed from the locking receptacle on the outsole, cause less damage to the turf grasses and putting greens and clubhouse flooring surfaces. Still, many conventional shoes with these replaceable plastic cleats have a very aggressive design. These cleats have long projecting arms and teeth that can penetrate into the ground and potentially damage the crown and root network of turf grasses.

In general, grass growth originates from the crown of the grass. The crown grows at the ground level where the grass shoots and roots meet. New blades of grass are continuously produced to replace grass blades that are dying off, and this growth starts at the crown. The roots feed the crown and anchor the grass. The root network can be complex and many roots tend to extend horizontally. When the cleats of some conventional golf shoes first penetrate the soil, they damage the crown portion. As the cleats penetrate more deeply into the soil, they tear against the roots. This chopping or shearing action damages the root structure. The roots are pulled apart in different directions. If the damage to the crown and roots is severe enough, the grass will die.

The outsole structures of this invention contain traction members that provide good traction on the various turf grasses of the golf course. At the same time, the traction members of this invention tend to penetrate the ground to a relatively shallow extent. The traction members of this invention do not bite into the grass to a point where they can completely destroy the plant's structure. The outsole structures and traction members of this invention can be considered "green-friendly" because of their non-putting green damaging nature.

Upper and Midsole Structure

Turning back to FIG. 31, this embodiment of the shoe includes an upper portion and outsole portion along with a midsole connecting the upper to the outsole. The midsole is joined to the upper and outsole as discussed in more detail below.

The upper (235) has a traditional shape and is made from a standard upper material such as, for example, natural leather, synthetic leather, non-woven materials, natural fabrics, and synthetic fabrics. For example, breathable mesh, and synthetic textile fabrics made from nylons, polyesters, polyolefins, polyurethanes, rubbers, and combinations thereof can be used. The material used to construct the upper is selected based on desired properties such as breathability, durability, flexibility, and comfort. In one preferred example, the upper is made of a soft, breathable leather material having waterproof properties. The upper material is stitched or bonded together to form an upper structure using traditional manufacturing methods.

Figure 31:
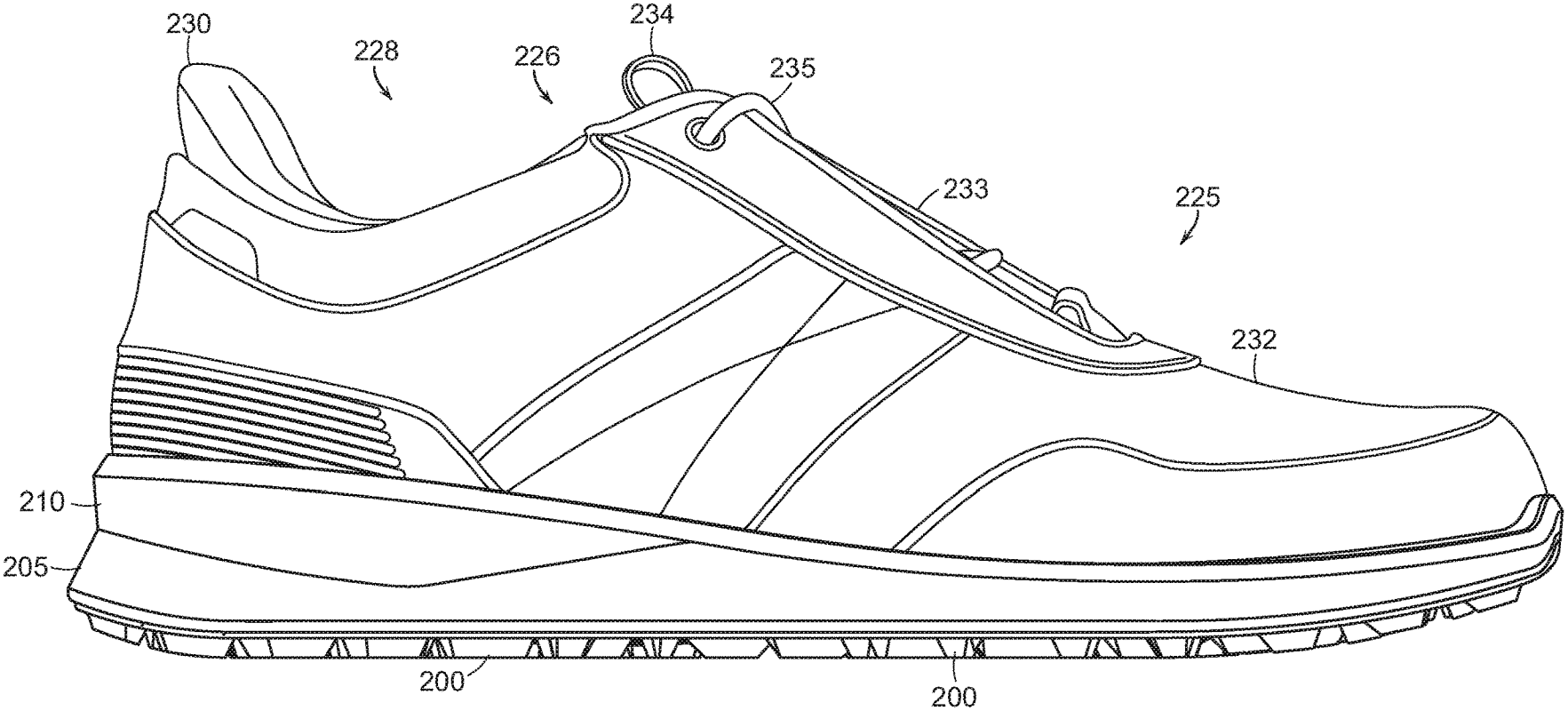
FIG. 31 is a side view of one example of a golf shoe of the present invention showing the shoe upper in detail.

As shown in FIG. 31, the upper (225) generally includes an instep region (226) with an opening (228) for inserting a foot. The upper preferably includes a soft, molded foam heel collar (230) for providing enhanced comfort and fit. An optional ghille strip or pull tab (not shown) can be wrapped around the heel collar. The upper includes a vamp (232) for covering the forepart of the foot. The instep region includes a tongue member (233) overlying the quarter section of the upper. The upper portion of the tongue (233) can include an optional ghille strip or pull tab (234). Normally, laces (235) are used for tightening the shoe around the contour of the foot. However, other tightening systems can be used including metal cable (lace)-tightening assemblies that include a dial, spool, and housing and locking mechanism for locking the cable in place. Such lace tightening assemblies are available from Boa Technology, Inc., Denver, Colo. 80216. It should be understood that the above-described upper shown in FIG. 31 represents only one example of an upper design that can be used in the shoe construction of this invention and other upper designs can be used without departing from the spirit and scope of this invention.

When numerical lower limits and numerical upper limits are set forth herein, it is contemplated that any combination of these values may be used. Other than in the operating examples, or unless otherwise expressly specified, all of the numerical ranges, amounts, values and percentages such as those for amounts of materials and others in the specification may be read as if prefaced by the word "about" even though the term "about" may not expressly appear with the value, amount or range. Accordingly, unless indicated to the contrary, the numerical parameters set forth in the specification and attached claims are approximations that may vary depending upon the desired properties sought to be obtained by the present invention.

It also should be understood the terms, "first", "second", "third", "top", "bottom", "upper", "lower", "downward", "upward", "right", "left", "middle" "proximal", "distal", "lateral", "medial", "anterior", "posterior", and the like are arbitrary terms used to refer to one position of an element based on one perspective and should not be construed as limiting the scope of the invention.

It is understood that the shoe materials, designs, and structures described and illustrated herein represent only some embodiments of the invention. It is appreciated by those skilled in the art that various changes and additions can be made to materials, designs, and structures without departing from the spirit and scope of this invention. It is intended that all such embodiments be covered by the appended claims.

We claim:

1. A golf shoe comprising:

an upper, an outsole, and a midsole connected to the upper and outsole, the upper, midsole, and outsole each having forefoot, midfoot, and rear-foot regions and lateral and medial sides; and the outsole comprising a first set of spiral pathways (A), each spiral pathway having a point of origin with a plurality of spiral segments radiating from that point, and wherein each segment has a different degree of curvature and contains sub-segments;

a second set of spiral pathways (B), each spiral pathway having a point of origin with a plurality of spiral segments radiating from that point, and wherein each segment has a different degree of curvature and contains sub-segments; and the first set of spiral pathways (A) being normal and the second set of spiral pathways (B) being an inverse of the first set of spiral pathways, so that when the spiral pathways are superposed over each other, the sub-segments of spiral segments from set (A) and the sub-segments of spiral segments from set (B) form four-sided tile pieces on the surface of the outsole, the tile pieces containing traction members, wherein a plurality of tile pieces comprise a first protruding traction member, an opposing second protruding traction member, and a non-protruding segment disposed between the first and second traction members, wherein the outsole further comprises a heel step region, the heel step region being without tile pieces.

2. The golf shoe of claim 1, wherein the first traction member has a hardness greater than the second traction member.

3. The golf shoe of claim 1, wherein the first and second traction members each comprise a thermoplastic polyurethane composition.

4. The golf shoe of claim 1, wherein the non-protruding segment disposed between the first and second traction members comprises an ethylene vinyl acetate composition.

5. The golf shoe of claim 1, wherein the first and second traction members have substantially the same heights.

6. The golf shoe of claim 1, wherein the first and second traction members have substantially the different heights.

* * * * *